US009696662B2

(12) United States Patent
Yogosawa et al.

(10) Patent No.: US 9,696,662 B2
(45) Date of Patent: Jul. 4, 2017

(54) CLEANING DEVICE AND IMAGE FORMING APPARATUS INCORPORATING SAME

(71) Applicants: Kazuki Yogosawa, Kanagawa (JP); Mitsuru Takahashi, Kanagawa (JP); Hiroyoshi Haga, Kanagawa (JP); Kenji Sugiura, Kanagawa (JP); Naohiro Kumagai, Kanagawa (JP); Seiichi Kogure, Kanagawa (JP); Kenji Sengoku, Kanagawa (JP); Takehide Mizutani, Tokyo (JP); Junpei Fujita, Kanagawa (JP); Yuuji Wada, Kanagawa (JP); Tatsuya Ohsugi, Kanagawa (JP)

(72) Inventors: Kazuki Yogosawa, Kanagawa (JP); Mitsuru Takahashi, Kanagawa (JP); Hiroyoshi Haga, Kanagawa (JP); Kenji Sugiura, Kanagawa (JP); Naohiro Kumagai, Kanagawa (JP); Seiichi Kogure, Kanagawa (JP); Kenji Sengoku, Kanagawa (JP); Takehide Mizutani, Tokyo (JP); Junpei Fujita, Kanagawa (JP); Yuuji Wada, Kanagawa (JP); Tatsuya Ohsugi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/003,239

(22) Filed: Jan. 21, 2016

(65) Prior Publication Data

US 2016/0216647 A1 Jul. 28, 2016

(30) Foreign Application Priority Data

Jan. 23, 2015 (JP) ..... 2015-011146
Jan. 23, 2015 (JP) ..... 2015-011655
Jan. 23, 2015 (JP) ..... 2015-011665

(51) Int. Cl.
*G03G 15/00* (2006.01)
*G03G 15/16* (2006.01)
(Continued)

(52) U.S. Cl.
CPC ..... *G03G 15/161* (2013.01); *B08B 1/007* (2013.01); *B08B 1/02* (2013.01); *B08B 1/04* (2013.01);
(Continued)

(58) Field of Classification Search
CPC ..... G03G 15/161; G03G 15/168; G03G 21/0035; G03G 21/105; G03G 2215/1661; B08B 1/002; B08B 6/00
(Continued)

(56) References Cited

U.S. PATENT DOCUMENTS

2011/0103822 A1* 5/2011 Sugiura ..... G03G 15/161 399/101
2011/0158677 A1 6/2011 Kikuchi et al.
(Continued)

FOREIGN PATENT DOCUMENTS

JP 2003-271030 9/2003
JP 2004-109917 4/2004
(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A cleaning device includes an upstream cleaner, an upstream cleaner, and a collection member. The upstream cleaner is configured to remove toner from a surface of a cleaning target. The downstream cleaner is disposed downstream from the upstream cleaner in a direction of movement of the surface of the cleaning target. The downstream cleaner is
(Continued)

configured to remove toner from the surface of the cleaning target. The collection member is configured to collect toner from the downstream cleaner.

21 Claims, 21 Drawing Sheets

(51) Int. Cl.

| | |
|---|---|
| ***B08B 6/00*** | (2006.01) |
| ***B08B 1/02*** | (2006.01) |
| ***B08B 1/04*** | (2006.01) |
| *B08B 1/00* | (2006.01) |
| *G03G 21/00* | (2006.01) |

(52) U.S. Cl.
CPC ..... *B08B 6/00* (2013.01); *B08B 1/002* (2013.01); *G03G 21/0035* (2013.01); *G03G 21/0058* (2013.01); *G03G 21/0076* (2013.01); *G03G 2215/0129* (2013.01); *G03G 2221/001* (2013.01)

(58) Field of Classification Search
USPC ..... 399/71, 99, 101, 302, 308, 354
See application file for complete search history.

(56) References Cited

U.S. PATENT DOCUMENTS

| | | | | |
|---|---|---|---|---|
| 2011/0229187 | A1 | 9/2011 | Hozumi et al. | |
| 2011/0229234 | A1 | 9/2011 | Hozumi et al. | |
| 2012/0008973 | A1* | 1/2012 | Sakakibara ..... | G03G 15/161 399/71 |
| 2012/0034006 | A1 | 2/2012 | Asaoka et al. | |
| 2012/0087704 | A1 | 4/2012 | Asaoka et al. | |
| 2012/0099883 | A1 | 4/2012 | Kikuchi et al. | |
| 2012/0224870 | A1 | 9/2012 | Kikuchi et al. | |
| 2012/0230740 | A1 | 9/2012 | Mikami et al. | |
| 2013/0084095 | A1* | 4/2013 | Meguro ..... | G03G 15/161 399/71 |
| 2013/0243473 | A1* | 9/2013 | Noguchi ..... | G03G 15/0131 399/101 |
| 2013/0315617 | A1 | 11/2013 | Sugiura et al. | |
| 2014/0064769 | A1 | 3/2014 | Sugiura | |
| 2014/0147181 | A1 | 5/2014 | Sugiura et al. | |
| 2014/0314461 | A1 | 10/2014 | Ishizuka et al. | |
| 2014/0321874 | A1 | 10/2014 | Sugiura et al. | |
| 2015/0147074 | A1 | 5/2015 | Wada et al. | |
| 2015/0205248 | A1 | 7/2015 | Yogosawa et al. | |
| 2015/0261137 | A1 | 9/2015 | Mitani et al. | |

FOREIGN PATENT DOCUMENTS

| | | |
|---|---|---|
| JP | 2004-341190 | 12/2004 |
| JP | 2007-057829 | 3/2007 |
| JP | 2007-121568 | 5/2007 |
| JP | 2010-244072 | 10/2010 |
| JP | 2011-133664 | 7/2011 |
| JP | 2012-208485 | 10/2012 |
| JP | 2013-057811 | 3/2013 |

* cited by examiner

CLEANING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2015-011665, filed on Jan. 23, 2015, 2015-011655, filed on Jan. 23, 2015, and 2015-011146, filed on Jan. 23, 2015, in the Japan Patent Office, the entire disclosure of each of which is incorporated by reference herein.

BACKGROUND

Technical Field

Aspects of this disclosure relate to a cleaning device and an image forming apparatus incorporating the cleaning device.

Related Art

Image forming apparatuses, such as printers, facsimile machines, and copiers, may include an electrostatic cleaning device as an intermediate-transfer-belt cleaning device to remove post-transfer residual toner on an intermediate transfer belt. Such an electrostatic cleaning device removes the toner from the intermediate transfer belt by action of electrostatic force.

The electrostatic cleaning device includes, for example, a cleaning brush roller to rotate while contacting the intermediate transfer belt as a cleaning target and a collection roller to rotate while contacting the cleaning brush roller. The cleaning brush roller and the collection roller are rotatably held in a casing. The cleaning brush roller is applied with a cleaning voltage, and the collection roller is applied with a collection voltage.

The post-transfer residual toner adhered on the surface of the intermediate transfer belt is electrostatically transferred from the surface of the intermediate transfer belt to the cleaning brush roller by the cleaning voltage and removed from the intermediate transfer belt. Toner electrostatically transferred to the cleaning brush roller is delivered with rotation of the cleaning brush roller to a contact position at which the cleaning brush roller contacts the collection roller, electrostatically transferred to the collection roller by the collection voltage, and collected from the cleaning brush roller to the collection roller.

However, when such a cleaning device is used for a long time of period, toner may re-adhere from the cleaning brush roller to the intermediate transfer belt. Such re-adhesion toner may pass through the cleaning device while remaining on the intermediate transfer belt and cause a stain-shaped abnormal image.

SUMMARY

In an aspect of this disclosure, there is provided a cleaning device that includes an upstream cleaner, an upstream cleaner, and a collection member. The upstream cleaner is configured to remove toner from a surface of a cleaning target. The downstream cleaner is disposed downstream from the upstream cleaner in a direction of movement of the surface of the cleaning target. The downstream cleaner is configured to remove toner from the surface of the cleaning target. The collection member is configured to collect toner from the downstream cleaner.

In another aspect of this disclosure, there is provided an image forming apparatus that includes an image bearer, a toner image forming unit, a transfer device, and a cleaning device. The image bearer has a surface to bear a toner image. A toner image forming unit is configured to form a toner image on the surface of the image bearer. The transfer device is configured to transfer the toner image from the surface of the image bearer onto a recording medium. The cleaning device includes an upstream cleaner, a downstream cleaner, and a collection member. The upstream cleaner is configured to remove toner from the surface of a the image bearer. The downstream cleaner is disposed downstream from the upstream cleaner in a direction of movement of the surface of the image bearer. The downstream cleaner is configured to remove toner from the surface of the image bearer. The collection member is configured to collect toner from the downstream cleaner.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
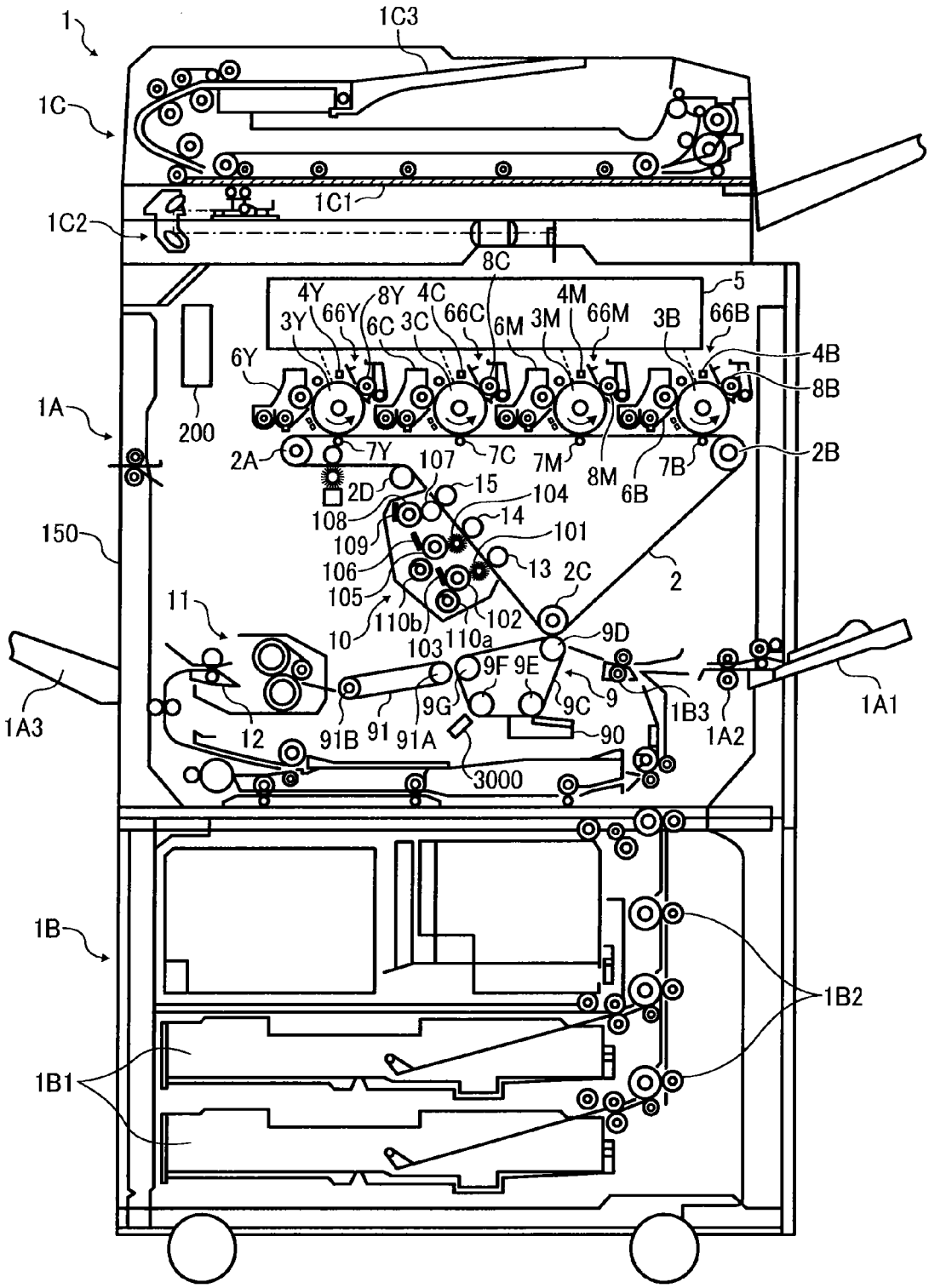
FIG. 1 is a schematic view of an entire configuration of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Below, embodiments and variations of the present disclosure are described with reference to drawings. In the embodiments and variations described below, the same reference numerals are given to components having the same functions and configuration, and the descriptions thereof are omitted as needed. In the drawings attached, components may partially be omitted for ease of understanding. It is to be noted that suffixes Y, M, C, and K denote colors yellow, magenta, cyan, and black, respectively. These suffixes may be omitted unless otherwise specified.

FIG. 1 is a schematic view of an entire configuration of an image forming apparatus 1 according to an embodiment of the present disclosure.

In FIG. 1, the image forming apparatus 1 is illustrated as a copier and has a configuration of a tandem system in which photoconductors 3 (3Y, 3C, 3M, and 3B) as latent image bearers to bear toner images of colors corresponding to color separation colors are disposed side by side. Tone images on the photoconductors 3 (3Y, 3C, 3M, and 3B) are superimposingly transferred one on another on an intermediate transfer belt 2 as an intermediate transferer being an image bearer (primary transfer), and the superimposed toner images are collectively transferred on a recording sheet as a recording material (second transfer). Thus, the image forming apparatus 1 forms a multi-color image on the recording sheet.

In FIG. 1, the image forming apparatus 1 includes an image forming section 1A, a sheet feed section 1B, and a document read section 1C. The image forming section 1A is disposed at a central portion in a vertical direction of the image forming apparatus 1. The sheet feed section 1B is disposed below the image forming section 1A. The document read section 1C is disposed above the image forming section 1A.

The image forming section 1A includes the intermediate transfer belt 2 having a horizontally stretched surface. Above an intermediate transfer unit 70 of the image forming section 1A, the four photoconductors 3 (3Y, 3C, 3M, and 3B) to bear toner images of color toners (yellow, magenta, cyan, and black) complementary to each other are disposed side by side in a direction along the stretched surface of the intermediate transfer belt 2. In the following descriptions, for the contents common to all colors, color suffixes M, C, Y, and B may be omitted for simplicity.

The photoconductors 3 (3Y, 3C, 3M, and 3B) are drums that are rotatable in the same direction (counterclockwise in FIG. 1). A charging device 4, a writing device 5, a developing device 6, a primary transfer device, and a photoconductor cleaning device 8 to perform image forming processing during rotation of the photoconductor 3 are disposed around the photoconductor 3 to constitute an image forming unit 66.

The primary transfer device transfers toner images in turn from the photoconductors 3 (3Y, 3C, 3M, and 3B) onto the intermediate transfer belt 2. The intermediate transfer belt 2 is looped around a plurality of belt stretching rollers (2A, 2B, 2C, and 2D) and driven to rotate. The plurality of belt stretching rollers include a secondary transfer opposite roller 2C as a belt stretching roller other than the two belt stretching rollers 2A and 2*b* constituting the stretched surface. The secondary transfer opposite roller 2C is disposed opposite a secondary transfer device 9 via the intermediate transfer belt 2 and is applied with a bias having the same polarity as a normal charge polarity of toner. Note that the normal charge polarity of toner used herein refers to a charge polarity of toner in developer in the developing device 6. In this embodiment, the normal charge polarity of toner is negative. However, in other embodiments, the normal charge polarity of toner may be positive. In addition, a tension roller 2D is provided as another belt stretching roller.

After secondary transfer, a belt cleaning device 10 removes post-transfer residual toner remaining on the intermediate transfer belt 2. The belt cleaning device 10 is an electrostatic cleaning system to apply a bias to a cleaning roller or a cleaning brush to electrostatically attract post-transfer residual toner on the intermediate transfer belt 2.

The secondary transfer device 9 includes a secondary transfer belt 9C looped around four secondary transfer belt support rollers (9D, 9E, 9F, and 9G). One of the secondary transfer belt support rollers is a drive roller driven to rotate the secondary transfer belt 9C counterclockwise in FIG. 11.

The image forming apparatus 1 illustrated in FIG. 1 includes a conveyor belt 91 between the secondary transfer belt 9C and a fixing device 11. The conveyor belt 91 is looped around a conveyor belt drive roller 91A and a conveyor belt driven roller 91B. When the conveyor belt drive roller 91A is driven to rotate, the conveyor belt 91 is rotated counterclockwise in FIG. 1.

An optical sensor unit 3000 is disposed opposite a surface of the secondary transfer belt 9C at a position downstream from a secondary transfer portion, at which the secondary transfer belt 9C opposes the intermediate transfer belt 2, in a direction (indicated by arrow BTD in FIG. 4) of travel (rotation) of the surface of the secondary transfer belt 9C. A secondary transfer belt cleaning device 90 to remove foreign substances from the surface of the secondary transfer belt 9C is disposed downstream from the position, at which the optical sensor unit 3000 is disposed opposite the surface of the secondary transfer belt 9C, in the direction BTD of travel of the surface of the secondary transfer belt 9C.

One of the secondary transfer belt support rollers is the secondary transfer belt support roller 9D opposite the secondary transfer opposite roller 2C, which is to be applied with a secondary transfer bias having the same polarity as the polarity of toner on the intermediate transfer belt 2, via the secondary transfer belt 9C and the intermediate transfer belt 2 at the secondary transfer portion. The secondary transfer belt support roller at the left side of the secondary transfer belt support roller 9D in FIG. 1 is a separation roller 9E that stretches the secondary transfer belt support belt 9C at a sheet separation portion at which, after passing the secondary transfer portion, a recording sheet borne on the surface of the secondary transfer belt 9C moves onto the conveyor belt 91. The secondary transfer belt support roller below the separation roller 9E is a sensor opposite roller 9F that stretches the secondary transfer belt 9C at a detection position at which the secondary transfer belt 9C opposes the optical sensor unit 3000. The secondary transfer belt support roller at the right side of the sensor opposite roller 9F in FIG. 1 is a secondary transfer belt cleaning opposite roller 9G that stretches the secondary transfer belt 9C at a position at which a cleaning blade of the secondary transfer belt cleaning device 90 contacts the secondary transfer belt 9C.

In this embodiment, the secondary transfer belt 9C is a belt of a single-layer structure. The secondary transfer belt 9C is made of, for example, a single layer of a moderate resistance resin having a resistance adjusted by dispersing carbon or blending ion conductant into a material, such as polyimide (PI), polyamideimide (PAI), polycarbonate (PC), ethylene-tetrafluoroethylene (ETFE), polyvinylidene difluoride (PVDF), or polyphenylene sulfide (PPS). Alternatively, a surface layer having a volume resistivity slightly higher than the volume resistivity of the single layer may be disposed only on the outer surface side of the secondary transfer belt 9C having the single-layer structure. In such a case, the thickness of the surface layer is, preferably, about 1 μm to about 10 μm.

In the image forming apparatus 1 according to this embodiment, when one of the four secondary transfer belt support rollers is driven to rotate as the drive roller, the surface of the secondary transfer belt 9C is moved (rotated) in the same direction as the intermediate transfer belt 2 at the secondary transfer portion at which the secondary transfer belt 9C contacts the intermediate transfer belt 2. The secondary transfer belt support roller 9D, though depending on the bias characteristics of the primary transfer device, may have charging characteristics to electrostatically attract a recording sheet. In a process of conveying the recording sheet with the secondary transfer belt 9C, the secondary transfer device 9 transfers superimposed toner images or a single-color toner image from the intermediate transfer belt 2 onto the recording sheet.

The recording sheet is fed from the sheet feed section 1B to the secondary transfer device 9. The sheet feed section 1B includes a plurality of sheet feed trays 1B1 and a plurality of conveyance rollers 1B2 disposed at a delivery path of recording sheets fed from the sheet feed trays 1B1. A tiltable bypass tray 1A1 and feed rollers 1A2 are disposed at a wall of the image forming section 1A.

A delivery path of a recording sheet fed from the bypass tray 1A1 joins to a course of the delivery path of a recording sheet from the sheet feed tray 1B1 to the registration rollers 1B3. The registration rollers 1B3 upstream from the secondary transfer portion in the direction of delivery of the recording sheet determines registration timing for the recording sheet fed from any of the delivery paths.

The writing device 5 controls writing light in accordance with image data obtained by scanning of a document on a document table 1C1 of the document read section 1C or output from a computer. The writing device 5 forms electrostatic latent images onto the photoconductors 3 (3Y, 3C, 3M, and 3B) in accordance with image data.

The document read section 1C includes a scanner 1C2 to expose and scan a document on the document table 1C1 with light. An automatic document feeder 1 C3 is disposed on an upper face of the document table 1C1. The automatic document feeder 1 C3 has a configuration of reversing a document fed onto the document table 1C1 and scanning both front and back sides of the document.

The electrostatic latent images formed on the photoconductors 3 (3Y, 3C, 3M, and 3B) with the writing device 5 are developed with the developing devices 6 (6Y, 6C, 6M, and 6B). The developed images are primarily transferred onto the intermediate transfer belt 2. Respective color toner images are superimposingly transferred one on another onto the intermediate transfer belt 2. The superimposingly transferred toner images are secondarily transferred collectively onto the recording sheet with the secondary transfer device 9.

The image forming apparatus 1 illustrated in FIG. 1 includes a conveyor belt 91 between the secondary transfer belt 9C and a fixing device 11. The conveyor belt 91 is looped around the conveyor belt drive roller 91A and the conveyor belt driven roller 91B. When the conveyor belt drive roller 91A is driven to rotate, the conveyor belt 91 is rotated counterclockwise in FIG. 1. After the secondary transfer, the recording sheet is conveyed leftward in FIG. 1 with travel of the surface of the secondary transfer belt 9C, and separated from the secondary transfer belt 9C at the position of the separation roller 9E and moved onto the conveyor belt 91. The conveyor belt 91 conveys the recording sheet received from the secondary transfer belt 9C, to the fixing device 11. An unfixed image borne on the surface of the recording sheet is fixed with the fixing device 11.

The fixing device 11 has a belt fixing structure including a fixing belt to be heated with a heating roller and a pressure roller disposed opposite and in contact with the fixing belt. A contact area, in other words, a nip area between the fixing belt and the pressure roller allows a heating area for the recording sheet to be more extended than a heating area in a fixing structure of other roller system. When the recording sheet passes out the fixing device 11, a delivery path switcher 12 downstream from the fixing device 11 switches the direction of delivery of the recording sheet, and the recording sheet is fed to a sheet ejection tray 1A3 or the registration rollers 1B3 again after reversed.

In the image forming apparatus 1 illustrated in FIG. 1, the primary transfer device as a transfer device includes primary transfer rollers 7 (7Y, 7C, 7M, and 7B) to be applied with a transfer bias of a positive polarity. Elastic bodies, such as bearings and compression springs, press the primary transfer rollers 7 (7Y, 7C, 7M, and 7B) against the photoconductors 3 (3Y, 3C, 3M, and 3B) via the intermediate transfer belt 2.

With rotation of the intermediate transfer belt 2, the primary transfer rollers 7 (7Y, 7C, 7M, and 7B) rotate at positions offset in the direction of travel of the surface of the intermediate transfer belt 2 by about 1 mm to about 2 mm from positions opposite the central positions of the photoconductors 3 (3Y, 3C, 3M, and 3B). Such a configuration prevents a pre-transfer in which a transfer by a transfer bias is started before a normal transfer position and an abnormal image, such as an image flow, arises.

The primary transfer rollers 7 (7Y, 7C, 7M, and 7B) has a configuration in which, for example, a rubber material having electric characteristics of moderate resistance is rolled around a cored bar. In this embodiment, the primary transfer rollers 7 are made of a moderate resistance foamed rubber having a volume resistivity of from $10^6$ Ω·cm to $10^{10}$ Ω·cm, preferably from $10^7$ Ω·cm to $10^9$ Ω·cm. Note that the material is not limited to foamed rubber, and for example, a moderate resistance solid rubber can be used as well.

A constant-current controlled power supply applies a primary transfer voltage of a positive polarity to the primary transfer rollers 7 (7Y, 7C, 7M, and 7B), and the setting value of the electric current (the setting value of the primary transfer current) is controlled to be in a range of from about 10 μA to about 40 μA. The application of the primary transfer voltage to the primary transfer rollers 7 (7Y, 7C, 7M, and 7B) forms a primary transfer electric field in a primary transfer portion between the photoconductors 3 (3Y, 3C, 3M, and 3B) and the intermediate transfer belt 2. The primary transfer electric field is a primary transfer electric field acting in a direction to attract toner (of the negative polarity) from the photoconductors 3 (3Y, 3C, 3M, and 3B) to the intermediate transfer belt 2.

A constant-current controlled power supply applies a secondary transfer voltage of a negative polarity to the secondary transfer opposite roller 2C. In the configuration in which the secondary transfer opposite roller 2C is applied with the secondary transfer voltage, the secondary transfer belt support roller 9D as a drive roller is electrically earthed. The secondary transfer opposite roller 2C is disposed opposite the secondary transfer belt support roller 9D earthed, and thus a secondary transfer electric field in a direction to push toner (of the negative polarity) from the intermediate transfer belt 2 to the recording sheet is formed in the secondary transfer portion.

The intermediate transfer belt 2 used in this embodiment is an elastic intermediate transfer belt constituted of a three-layer belt having a base layer of from 50 μm to 100 μm, an elastic layer of from 100 μm to 500 μm on the base layer, and a surface layer on the elastic layer. The base layer is made of, for example, a moderate resistance resin having a resistance adjusted by dispersing carbon or blending ion conductant into a material, such as polyimide (PI), polyamideimide (PAI), polycarbonate (PC), ethylene-tetrafluoroethylene (ETFE), polyvinylidene difluoride (PVDF), or polyphenylene sulfide (PPS). The elastic layer includes, for example, a material having a resistance adjusted by dispersing carbon or blending ion conductant into a rubber material, such as urethane, nitrile rubber (NBR), or chloroprene rubber (CR). As the surface layer, for example, coating of fluorinated rubber or fluorinated resin (or a hybrid material thereof) having a thickness of from about 1 μm to about 10 μm is disposed on the surface of the elastic layer.

In this embodiment, the intermediate transfer belt 2 has a volume resistivity of from $10^6$ Ω·cm to $10^{10}$ Ω·cm, preferably from $10^8$ Ω·cm to $10^{10}$ Ω·cm. In this embodiment, the intermediate transfer belt 2 also has a surface resistivity of from $10^6$Ω/□ to $10^{12}$Ω/□, preferably from $10^8$Ω/□ to $10^{12}$Ω/□. Young's modulus (longitudinal elastic modulus) of the base layer is preferably not less than 3000 Mpa, and thus the base layer has a sufficient mechanical strength to endure extension, bending, folding, or waving due to driving. Using the elastic intermediate transfer belt 2 having such an elasticity allows the elastic layer to follow asperities of, for example, a sheet of paper having a low density of paper fibers or an embossed sheet having concave and convex portions of 20 μm to 30 μm in a surface thereof. Such a configuration enhances the transfer performance of toner to concave portions of the recording sheet, thus enhancing uniform filling performance.

The image forming apparatus 1 in this embodiment changes the contact state of the photoconductors 3 and the intermediate transfer belt 2 between a monochrome mode to form a monochromatic image and a color mode to form a color image.

Specifically, of the primary transfer rollers 7 (7Y, 7C, 7M, and 7B) of the primary transfer device, the primary transfer roller 7B for black is supported with a dedicated bracket, separately from the other primary transfer rollers 7Y, 7C, and 7M.

The primary transfer rollers 7Y, 7C, and 7M for yellow, cyan, and magenta, respectively, are supported with a common moving bracket. By driving of a solenoid, the common moving bracket is moved in a direction to approach or away from the primary transfer rollers 7Y, 7C, and 7M.

When the moving bracket is moved in the direction away from the primary transfer rollers 7Y, 7C, and 7M, the stretched attitude of the intermediate transfer belt 2 is changed, thus separating the intermediate transfer belt 2 from the primary transfer rollers 7Y, 7C, and 7M.

However, the photoconductor 3B for black and the intermediate transfer belt 2 remain in contact with each other. In the monochrome mode, as described above, image forming operation is performed with only the photoconductor 3B for black being in contact with the intermediate transfer belt 2.

When the moving bracket is moved in the direction to approach the primary transfer rollers 7Y, 7C, and 7M, the stretched attitude of the intermediate transfer belt 2 is changed, thus bringing the intermediate transfer belt 2, which is separated from the primary transfer rollers 7Y, 7C, and 7M, into contact with the primary transfer rollers 7Y, 7C, and 7M.

At this time, the photoconductor 3B for black and the intermediate transfer belt 2 remain in contact with each other. In the color mode, as described above, image forming operation is performed with all of the photoconductors 3 (3Y, 3C, 3M, and 3B) being in contact with the intermediate transfer belt 2.

In such a configuration, the moving bracket and the solenoid act as a contact-separation adjuster to contact and separate the photoconductors 3 and the intermediate transfer belt 2 with and from each other.

After Y, M, C, and K toner images are primarily transferred onto the intermediate transfer belt 2, the photoconductor cleaning devices 8 (8Y, 8C, 8M, and 8B) perform cleaning to remove post-transfer residual toner from the surfaces of the photoconductors 3 (3Y, 3C, 3M, and 3B). After electric neutralization is performed on the photoconductors 3 (3Y, 3C, 3M, and 3B) with neutralization lamps, the photoconductors 3 (3Y, 3C, 3M, and 3B) are uniformly electrically charged with the charging devices 4 (4Y, 4M, 4C, and 4B) to be ready for the next image formation.

After the toner images are secondarily transferred onto a recording sheet, the belt cleaning device 10 perform cleaning to remove post-transfer residual toner from the surface of the intermediate transfer belt 2.

The image forming apparatus 1 according to this embodiment performs image-quality adjustment control at predetermined timing. For image-quality adjustment control, the image forming apparatus 1 forms a toner pattern and performs image density control and positional deviation control, based on results of detection of the image density and the image formed position of the toner pattern. In the image density control, for example, the image forming apparatus 1 detects a toner adhesion amount (image density) of a density control pattern (gradation pattern) obtained by developing predetermined patterned latent images. In accordance with the results of detection of the toner adhesion amount, the image forming apparatus 1 changes, for example, the toner density of developer in developing device, writing conditions (e.g., exposure power), and the setting values of charging bias and development bias. The positional deviation control adjusts the writing timing of latent images for respective color toners in accordance with the detection timing of a positional deviation control pattern (chevron patch).

The density control pattern is detected, for example, on a region of each photoconductor 3 from the development area to the primary transfer portion or on the intermediate transfer belt 2 after the density control pattern is primarily transferred. However, when the diameter of the photoconductors 3 is relatively small, it might be difficult to detect the pattern on the photoconductor due to a setting space of image density detection sensors. Therefore, the density control pattern is preferably detected on the intermediate transfer belt 2 or the secondary transfer belt 9C. The positional deviation control pattern is used to monitor position deviations between different color toners due to, for example, variations in distance between the photoconductors 3 and deviations in writing timings of latent images for difference colors. Accordingly, the positional deviation control pattern is detected on a surface travel body to bear toner images after the intermediate transfer belt 2. In this embodiment, both the density control pattern and the positional deviation control pattern are detected on the secondary transfer belt 9C.

For medium- and low-speed image forming apparatuses, a member having a shape of small-diameter roller is typically used as a secondary transferor disposed opposite an intermediate transfer belt in a secondary transfer portion, to form a secondary transfer electric field between the secondary transfer opposite roller and the secondary transferor. However, in such a configuration in which the roller-shaped member is used as the secondary transferor, it may be difficult to detect an image-quality adjustment pattern on the surface of the secondary transferor. By contrast, in this embodiment, as illustrated in FIG. 1, the secondary transfer belt 9C is employed as the secondary transferor, thus allowing detection of the image-quality adjustment pattern on the surface of the secondary transferor.

Note that the secondary transferor is not limited to the belt-shaped member. For example, a roller of a large diameter may be used as the secondary transferor.

A constraint to the intermediate transfer belt 2 is the followability of the surfaces of recording media having different surface properties in the secondary transfer portion to form images on various types of recording media, such as recording sheets.

Regarding the surface followability, recently, full-color electrophotographic technologies have been increasingly developed to form images on various types of recording media. Not only normal smooth recording sheets of paper but also, for example, slipply recording media having high degrees of smoothness, such as coated paper, and recording media having rough surfaces, such as recycled paper, embossed paper, Japanese paper, and craft paper, have been increasingly used as the recording media If the surface followability of the intermediate transfer belt 2 relative to recording media having various surface properties in the secondary transfer portion is poor, uneven density or uneven color tone may arise in toner images transferred on recording media.

Figure 2:
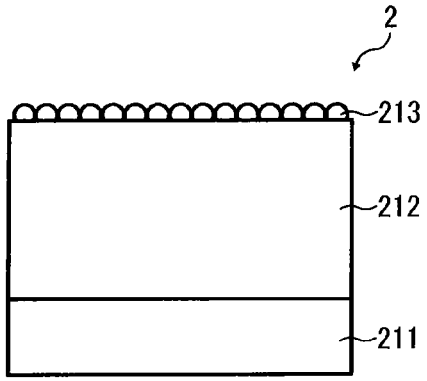
FIG. 2 is an enlarged cross-sectional view of a layer structure of an intermediate transfer belt.

An example of the intermediate transfer belt 2 having such followability to various recording media is illustrated in FIG. 2.

FIG. 2 is an enlarged cross-sectional view of a layer structure of the intermediate transfer belt 2. The intermediate transfer belt 2 illustrated in FIG. 2 includes a rigid base layer 211 having relatively bendability, a flexible, elastic layer 212 on the base layer 211, and a surface layer 213 containing fine particles on the elastic layer 212.

First, a description is given of the base layer 211.

The base layer 211 includes, for example, a resin material containing a filler (or an additive) for adjusting electric resistance, in other words, an electric resistance adjusting material.

The resin material of the base layer 211 is preferably, for example, a fluorinated resin, such as PVDF or ETFE, a polyimide resin, or a polyamideimide resin in terms of fire resistance. In terms of mechanical strength (high elasticity) and heat resistance, specifically, a polyimide resin or a polyamideimide resin is more preferable.

Examples of the electrical resistance adjusting material contained in the resin material of the base layer 211 include, but are not limited to, metal oxides, carbon blacks, ion conductive materials, and conductive polymers.

Next, a description is given of the elastic layer 212 on the base layer 211.

An elastic rubber layer may be used as the elastic layer 212. For example, acrylic rubber may be used for the elastic layer 212. The acrylic rubber may be commercially-available one and is not limited to any specific acrylic rubber. However, among cross-linking systems (epoxy group, active chlorine group, and carboxyl group) of acrylic rubber, the cross-linking system of the carboxyl group is advantageous in rubber properties (in particular, compression set) and workability. The cross-linking system of the carboxyl group is preferably selected.

Next, a description is given of the surface layer 213 containing spherical resin fine particles on the elastic layer 212. The spherical resin fine particles are not limited to any particular materials, but may be spherical resin fine particles (hereinafter, also simply referred to as resin fine particles) containing, as a main component, a resin, such as an acrylic resin, a melamine resin, a polyamide resin, a polyester resin, a silicone resin, or a fluororesin. Alternatively, in some embodiments, the surfaces of the fine particles made of the resin materials may be treated with different types of materials.

The resin fine particles used herein include rubber materials. The surfaces of the spherical resin fine particles made of rubber material may be coated with hard resin.

The shape of the resin fine particles may be hollow or porous.

Of the above-described resin materials, silicone resin fine particles are most preferable in smoothness, releasability from toner, and abrasion resistance.

The resin fine particles to be used are preferably fine particles prepared in spherical shape by a polymerization method, and more preferably as the shape approaches a true sphere. The volume average particle diameter of the particle is preferably in a range from 0.5 μm to 5.0 μm, and the particle dispersion is monodisperse with a sharp distribution. If the volume average particle diameter is less than 0.5 μm, the fine particles strikingly aggregate together, thus hampering uniform application of the fine particles to the surface of the elastic layer of acrylic rubber. If the volume average particle diameter is 5 μm or greater, the asperities of the belt surface after application of the fine particles increases in size. When the fine particles are used as the surface layer of the intermediate transfer belt 2, cleaning failure might occur in the cleaning of the belt cleaning device 10.

The Martens hardness of the elastic layer 212 when pressed to a depth of 10 μm is in a range of from 0.2 $N/mm^2$ to 0.8 $N/mm^2$. The surface layer 213 on the outer surface of the elastic layer 212 are made of independent spherical resin particles arrayed in a surface direction to form uniform asperities. Such a configuration of the intermediate transfer belt 2 secures the releasability of toner from the surface layer 213 and obtains an excellent followability to the surfaces of different types of recording media in the secondary transfer portion.

The elastic layer 212 is an elastic layer of fire-resistant acrylic rubber showing a result of VTM-0 in a UL94VTM combustion test, thus obtaining both excellent followability and excellent fire resistance.

The surface of the intermediate transfer belt 2 including the elastic layer 212 illustrated in FIG. 2 follows paper sheets having rough surfaces, thus reducing occurrence of uneven density or uneven color tone in different types of recording media and allowing excellent image formation.

However, rubber materials constituting the elastic layer 212 are typically poor in the releasability from toner. Without a surface layer made of other materials having excellent releasability from toner, the secondary transfer rate or the cleaning performance might be so poor as not to be practically used.

For an intermediate transfer belt including a typical elastic layer, a coat layer may be disposed on the surface of the elastic layer. For example, by applying and drying a liquid material of a coat layer on the surface of the elastic layer, an intermediate transfer belt can be formed that has the coat layer on the surface of the elastic layer. However, materials used for the coat layer may not deform following the deformation, such as extension and contraction, of rubber materials used for the elastic layer over time. If the belt is used over a long time, the belt surface may crack. Such cracks may degrade the transferability and cleaning performance of toner adhered to the cracks.

By contrast, the intermediate transfer belt 2 illustrated in FIG. 2 has a configuration in which the surface layer 213 is made of resin fine particles paved on the surface of the elastic layer 212. Accordingly, when the surface side of the elastic layer 212 deforms to extend, the resin fine particles of the surface layer 213 displace so as to increase spaces among adjacent resin fine particles. When the surface side of the elastic layer 212 deforms to contract, the resin fine particles of the surface layer 213 displace so as to reduce spaces among adjacent resin fine particles. Thus, even if rubber materials of the elastic layer 212 deform, only the positional relationships among the resin fine particles change and no cracks occur in the surface layer 213. Accordingly, the releasability from toner is stably maintained over time, thus enhancing the transferability and cleaning performance of toner.

Next, a description is given of a toner pattern to be transferred onto the secondary transfer belt 9C.

Figure 3:
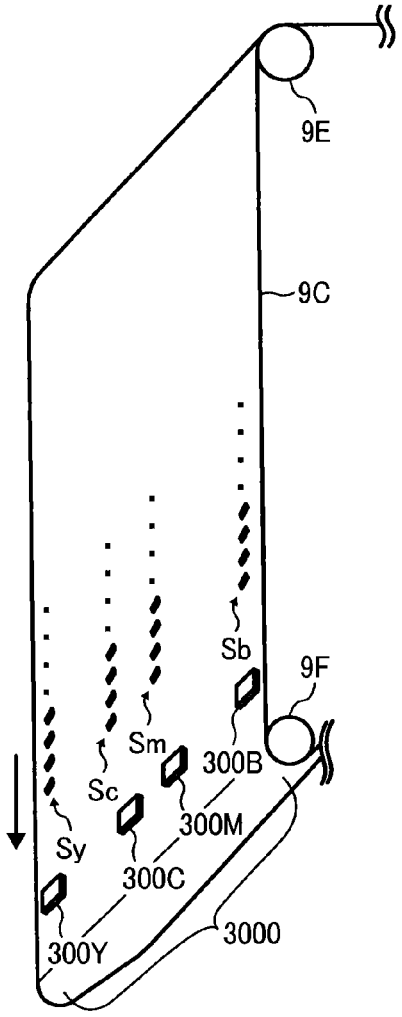
FIG. 3 is an enlarged schematic view of gradation patterns on a secondary transfer belt and optical sensors.

FIG. 3 is an enlarged view of a configuration of the secondary transfer belt bearing gradation patterns and optical sensors near the secondary transfer belt.

As illustrated in FIG. 3, the optical sensor unit 3000 includes an optical sensor 300Y for yellow, an optical sensor 300C for cyan, an optical sensor 300M for magenta, and an optical sensor 300B for black.

Each of all the optical sensors 300Y, 300C, 300M, and 300B is formed of a reflective photosensor in which light emitted from a light-emitting element is reflected by the outer surface of the secondary transfer belt 9C and a toner image on the secondary transfer belt 9C, and the reflected light amount is detected with a light-receiving element. Based on output voltages from the optical sensors 300Y, 300C, 300M, and 300B, a controller 200 (see FIG. 1) detects a toner image on the secondary transfer belt 9C and an image density (the amount of adhesion of toner per unit area) of the toner image.

For the image forming apparatus 1 according to this embodiment, when the image forming apparatus 1 is powered on or each time a predetermined number of prints are finished, image density control is executed to optimize the image densities of the four colors of Y, C, M, and B. In the image density control, as illustrated in FIG. 3, first, the image forming apparatus 1 forms gradation patterns Sy, Sc, Sm, and Sb of the four colors of Y, C, M, and B as density control patterns at positions opposite the optical sensors 300Y, 300C, 300M, and 300B on the secondary transfer belt 9C. The gradation patterns of the four colors constitute of ten toner patches having different image densities and areas of 2 cm×2 cm.

In formation of the gradation patterns Sy, Sc, Sm, and Sb of the four colors, the charge potentials of the photoconductors 3Y, 3C, 3M, and 3B are gradually increased, unlike uniform drum charge potentials in a print process. A plurality of patch electrostatic latent images to form gradation pattern images are formed on the photoconductors 3 (3Y, 3C, 3M, and 3B) by scanning of laser beams, and are developed with the developing devices 6Y, 6C, 6M, and 6B for Y, C, M, and B. In the development process, development biases applied to developing rollers of the developing devices 6Y, 6C, 6M, and 6B for Y, C, M, and B are gradually increased.

With the development, the gradation patterns Sy, Sc, Sm, and Sb of the four colors of Y, C, M, and B are formed on the photoconductors 3Y, 3C, 3M, and 3B, respectively. The gradation patterns Sy, Sc, Sm, and Sb are also primarily transferred onto the secondary transfer belt 9C at predetermined spaces in a main scanning direction, which is indicated by arrow MSD in FIG. 5, of the secondary transfer belt 9C. An amount of adhesion of toner of a toner patch in each of the gradation patterns Sy, Sc, Sm, and Sb is 0.1 mg/cm$^2$ at the minimum and 0.55 mg/cm$^2$ at the maximum. When toner charge-per-diameter (Q/d) distributions are measured, the polarities of toner particles are almost equalized to the normal charge polarity. Note that the normal charge polarity of toner used herein refers to a charge polarity of toner in developer in the developing device 6. In this embodiment, the normal charge polarity of toner is negative. However, in other embodiments, the normal charge polarity of toner may be positive.

The gradation toner patterns Sy, Sc, Sm, and Sb formed on the secondary transfer belt 9C pass through positions opposite the optical sensors 300Y, 300C, 300M, and 300B, respectively, with endless movement of the secondary transfer belt 9C. At this time, the optical sensors 300Y, 300C, 300M, and 300B receive the amounts of light corresponding to the amounts of adhesion of toner per unit area to the toner patches of the gradation patterns Sy, Sc, Sm, and Sb.

Based on output voltages from the optical sensors 300Y, 300C, 300M, and 300B on detection of the toner patches and an adhesion amount conversion algorithm, the amounts of adhesion of toner of respective toner patches of each gradation pattern in colors are calculated. Based on the calculated amounts of adhesion, image forming conditions are adjusted.

More specifically, based on the results of detection of the amounts of adhesion of toner in the toner patches and developing potentials obtained when the toner patches are formed, a function ($y=ax+b$) representing a linear graph is calculated by regression analysis. Target values of the image densities are assigned to the function to calculate appropriate development biases, so that development biases for Y, C, M, and B are specified.

In a memory, an image formation condition data table is stored in which several tens of different development biases and appropriate drum charge potentials respectively corresponding to the development biases are associated with each other. With respect to the image forming units 66Y, 66C, 66M, and 66B, development biases that are closest to the specified development biases are selected from the image formation condition table to specify drum charge potentials associated with the selected development biases.

The image forming apparatus 1 is configured to also perform color deviation correction processing when the image forming apparatus 1 is powered on or when a predetermined number of prints are finished. In the color deviation correction processing, color deviation detection images called chevron patches PV illustrated in FIG. 4 and constituted of Y, C, M, and B toner images are formed at each of one end and the other end of the secondary transfer belt 9C in the lateral direction of the secondary transfer belt 9C.

Figure 4:
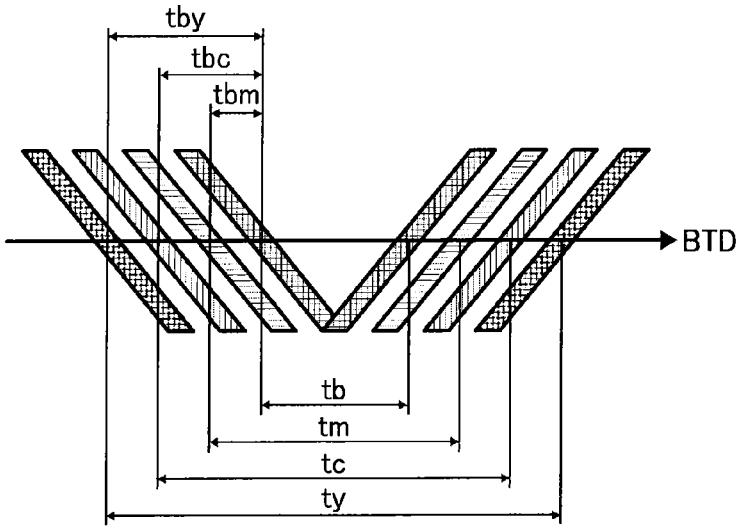
FIG. 4 is an enlarged schematic view of a chevron patch on the secondary transfer belt.
Figure 5:
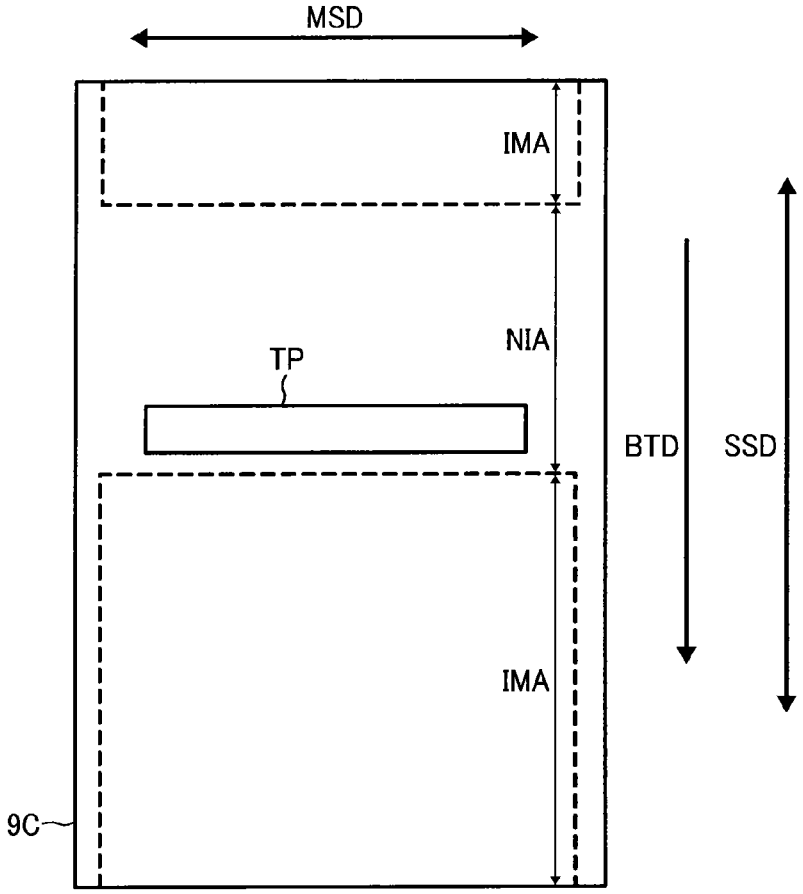
FIG. 5 is an illustration of a toner consumption pattern on the secondary transfer belt.

The chevron patch PV, as illustrated in FIG. 4, is a group of line patterns in which Y, C, M, and B toner images are arrayed at predetermined pitches in a belt travel direction (indicated by arrow BTD), which is a sub-scanning direction indicated by arrow SSD in FIG. 5, while the toner images are tilted at about 45 angle degrees relative to the main scanning direction MSD. An amount of adhesion of the chevron patch PV is about 0.3 mg/cm$^2$.

The positions in the main scanning direction MSD (the axial direction of the photoconductor 3), the positions in the sub-scanning direction SSD (belt travel direction BTD), the magnification errors in the main scanning direction D1, and skew from the main scanning direction MSD in the toner images of each color are detected by detecting the toner images of each color in the chevron patch PV. The main scanning direction mentioned here represents a direction in which a laser beam is phase-shifted on the surface of the photoconductor 3 with reflection on a polygon mirror.

Detection time differences between the Y, C, and M toner images in the chevron patch PV and the B toner image are read with the optical sensors 300Y, 300M, 300C, and 300B. In FIG. 4, the vertical direction corresponds to the main scanning direction MSD, and Y, C, M, and B toner images are arrayed in turn from the left. Then, B, M, C, and Y toner images having postures different from those of the Y, C, M, and B toner images by 90° are further arrayed.

Based on differences between measured values and ideal values of detection time differences tby, tbc, and tbm obtained with reference to the B color serving as a reference color, deviations of the color toner images in the sub-scanning direction SSD, in other words, registration deviations, are calculated. Based on the amounts of registration deviations, every other surface of the polygon mirror in the writing device 5, i.e., using one scanning line pitch as one unit, optical writing start timing for each photoconductor 3 is corrected to reduce the registration deviations of the color toner images. Based on the differences of deviations in sub-scanning direction SSD between both the ends of the belt, tilts (skews) of the color toner images from the main scanning direction MSD are calculated. Based on the results, plate tilt correction of an optical reflecting mirror is performed to reduce skew deviations of the color toner images.

Processing that corrects optical writing start timing and a plate tilt based on timings at which the toner images in the chevron patch PV are detected to reduce registration deviations and skew deviations is color deviation correction processing. The color deviation correction processing can reduce color deviation of an image caused by shifting forming positions of the color toner images on the secondary transfer belt 9C with time due to a change in temperature or the like.

When the image forming operation in a small image area continues, old toner continuously remaining in the developing device for a long time increases. For this reason, the toner charging characteristics are degraded, and use of the toner in image formation degrades image quality (deterioration in development capability and transfer properties). The image forming apparatus 1 has a refresh mode in which old toner is discharged into a non-image area (NIA in FIG. 5) between image areas (IMA in FIG. 5) of the photoconductor 3 at a predetermined timing not to be accumulated in the developing device 6, and, after the toner is discharged, a new toner is supplied to the developing device 6 having a decreased toner concentration to refresh the interior of the developing device 6.

The controller 200 stores a consumption amount of toner and an operation time of each developing device 6, and examines at a predetermined timing whether, in an operation time of each developing device 6 in a predetermined period of time, the consumption amount of toner in each of the developing device 6 is a threshold value or less. Then, the controller 200 executes the refresh mode to a developing device 6 in which the consumption amount of toner is the threshold value or less.

When the refresh mode is executed, a toner consumption pattern TP as a toner pattern is formed in a non-image-forming region corresponding to a region between recording sheets on the photoconductor 3 and transferred to the secondary transfer belt 9C (see FIG. 5). In this embodiment, the size of the toner consumption pattern TP is set to 330 mm in main scanning direction MSD.

An amount of adhesion of toner in the toner consumption pattern TP is determined based on the consumption amount of toner for the operation time of the developing device 6 in the predetermined period of time.

The toner consumption patterns of the four colors are formed on the secondary transfer belt 9C by superimposing two toner patterns one on another in an order of Y to C or M to B by the following sizes:

maximum length of each color in sub-scanning direction: 15 mm maximum length of each color in main scanning direction: 330 mm The length of the toner consumption pattern in sub-scanning direction SSD is determined by an image formation history of normal image forming operation. Accordingly, the toner consumption patterns of Y, C, M, and B in sub-scanning direction SSD do not constantly have a certain length of, e.g., 15 mm. The lengths of the toner consumption patterns of Y, C, M, and B in the sub-scanning direction SSD are variable in a range of, for example, 0 mm to 15 mm.

In a combination of small particle size polymerization toner and an elastic intermediate transfer belt recently used to enhance image quality, it might be difficult to secure the cleaning performance of the belt cleaning device 10.

For example, the belt cleaning device 10 collects color gradation patterns of Y, C, M, and B colors, chevron patches, and toner consumption patterns on the intermediate transfer belt 2. At this time, the belt cleaning device 10 removes from the intermediate transfer belt 2 a large amount of toner of untransferred toner images, such as color gradation patterns, chevron patches, and toner consumption patterns.

However, for the configuration of the present embodiment with a combination of small particle size polymerization toner and the elastic intermediate transfer belt, a cleaning device including a polarity controller and a brush roller or a cleaning device including two brush rollers for removing toner particles of positive and negative polarities may not remove untransferred toner images at a time from the intermediate transfer belt 2. In such a case, residual toner particles on the intermediate transfer belt 2 that cannot be completely cleaned are transferred onto a recording sheet in the next print operation, and an abnormal image may be formed.

Hence, for the image forming apparatus 1 according to the present embodiment, toner patterns, such as color gradation patterns of the respective colors, chevron patches, and toner consumption patterns, are transferred onto the secondary transfer belt 9C, and the secondary transfer belt cleaning device 90 removes untransferred toner particles from the secondary transfer belt 9C. Accordingly, only residual toner having not been secondarily transferred are left for the belt cleaning device 10, thus reducing the amount of toner input to the belt cleaning device 10. Such a configuration reduces occurrence of cleaning failure in the belt cleaning device 10, thus reducing occurrence of an abnormal image.

The secondary transfer belt 9C is a belt having no elastic layer and easy to secure the cleaning performance. Accordingly, the image forming apparatus 1 according to the present embodiment excellently removes toner patterns, such as toner consumption patterns, transferred on the secondary transfer belt 9C, with the secondary transfer belt cleaning device 90.

For a comparative configuration in which toner consumption patterns are removed with the belt cleaning device 10, for example, the toner consumption patterns are formed with halftone images in consideration of the load of the belt cleaning device 10. By contrast, in this embodiment, toner consumption patterns are formed with solid images. This is because the transfer rate of toner from the intermediate transfer belt 2 to the secondary transfer belt 9C is low in halftone images than in solid images. Formation of toner consumption patterns with solid images reduce the amount of post-transfer residual toner input to the belt cleaning device 10. Accordingly, even in the configuration of this embodiment with a combination of the elastic intermediate transfer belt and the small particle size polymerization toner which might be difficult to secure the cleaning performance, the belt cleaning device 10 excellently removes toner on the intermediate transfer belt 2.

A secondary transfer bias to secondarily transfer a toner pattern, such as a gradation pattern, a chevron patch, and a toner consumption pattern, onto the secondary transfer belt 9C is preferably set separately from a secondary transfer bias to secondarily transfer a toner image onto a recording sheet. This is because, a secondary transfer bias at which a good transfer rate is obtained when a toner pattern is secondarily transferred onto the secondary transfer belt is different from a secondary transfer bias at which a good transfer rate is obtained when a toner image is secondarily transferred onto a recording sheet. Accordingly, a secondary transfer bias to secondarily transfer a toner pattern onto the secondary transfer belt 9C is set to have a good transfer rate to secondarily transfer a toner image on a recording sheet, the transfer rate may decrease, thus increasing the amount of toner input to the belt cleaning device 10. Accordingly, cleaning failure might occur.

By contrast, by separately setting the secondary transfer bias to secondarily transfer a toner pattern onto the secondary transfer belt 9C and the secondary transfer bias to secondarily transfer a toner image on a recording sheet, the amount of post-transfer residual toner input to the belt cleaning device 10 after the secondary transfer is reduced both when the toner pattern is secondarily transferred onto the secondary transfer belt 9C and when the toner image is secondarily transferred onto the recording sheet. Such a configuration reduces occurrence of cleaning failure in the belt cleaning device 10.

Next, a description is given of the belt cleaning device 10 in this embodiment.

Figure 6:
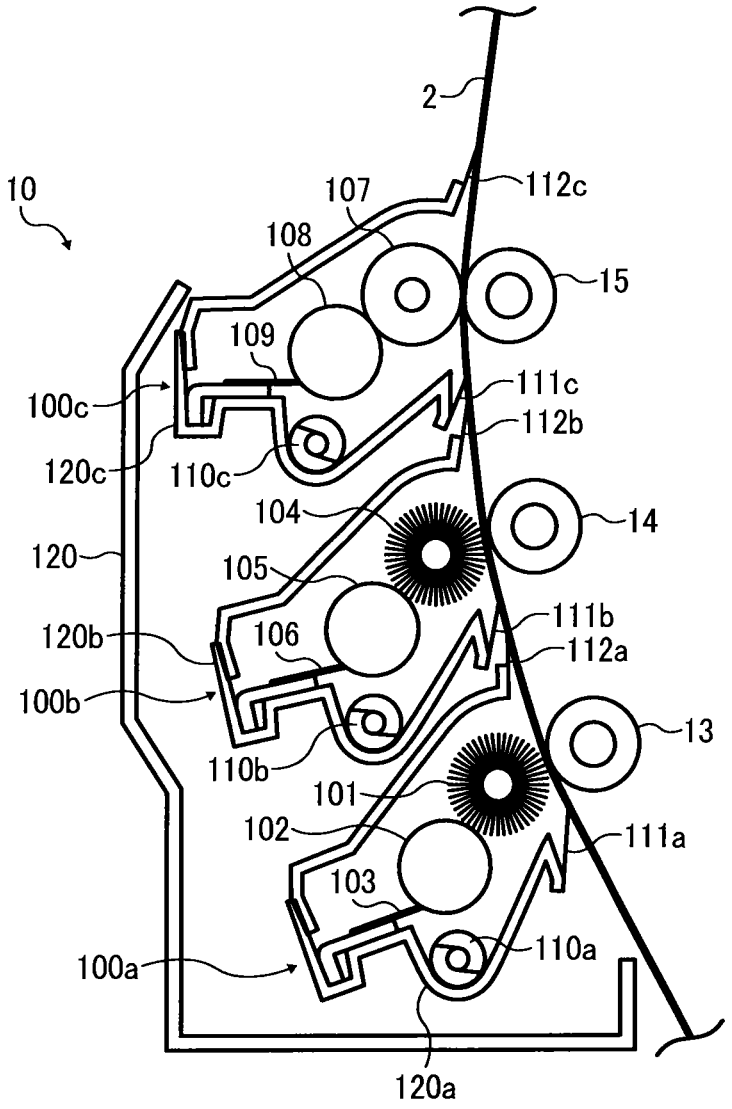
FIG. 6 is an enlarged view of a configuration of a belt cleaning device and a periphery of the belt cleaning device.

FIG. 6 is an enlarged view of a configuration of the belt cleaning device 10 of the image forming apparatus 1 and an area around the belt cleaning device 10 in this embodiment.

In FIG. 6, the belt cleaning device 10 includes a first cleaning unit 100*a* and a second cleaning unit 100*b* in a cleaning case 120. The second cleaning unit 100*b* is disposed adjacent to and downstream from the first cleaning unit 100*a* in the belt travel direction BTD of the intermediate transfer belt 2. The belt cleaning device 10 also includes a post cleaning unit 100*c* in the cleaning case 120, and the post cleaning unit 100*c* is disposed adjacent to and downstream from the second cleaning unit 100*b* in the belt travel direction BTD.

In a first casing 120*a* of the first cleaning unit 100*a* is disposed a first cleaning brush roller 101 as a first cleaner to remove post-transfer residual toner from the surface of the intermediate transfer belt 2. In the first casing 120*a* of the first cleaning unit 100*a* are disposed a first collection roller 102 as a collection member to rotate while contacting the first cleaning brush roller 101 to collect post-transfer residual toner from the first cleaning brush roller 101 and a first scraping blade 103 to scrape post-transfer residual toner from the surface of the first collection roller 102. In the first casing 120*a* is disposed a first transport screw 110*a* to discharge post-transfer residual toner scraped from the first collection roller 102 to the outside of the first casing 120*a*. The first casing 120*a* is provided with an entry seal 111*a* and an exit seal 112*a* that contact the intermediate transfer belt 2 to prevent toner in the first casing 120*a* from being scattered to the outside of the first casing 120*a*.

Most of post-transfer residual toner having not been transferred from the secondary transfer belt 9C (e.g., about 80% of the post-transfer residual toner) are charged with the polarity opposite the normal charge polarity (the negative polarity). Hence, in this embodiment, a voltage of the normal charge polarity (the negative polarity) is applied to the first cleaning brush roller 101 to electrostatically remove toner of the positive polarity on the intermediate transfer belt 2. A voltage of the negative polarity higher than a voltage applied to the first cleaning brush roller 101 is applied to the first collection roller 102. In the belt cleaning device 10, a voltage applied to the first cleaning brush roller 101 and the like are set such that most of the post-transfer residual toner are removed with the first cleaning brush roller 101. Note that, in this case, some of the post-transfer residual toner may receive negative charge from the first cleaning brush roller 101 and have the normal charge polarity (the negative polarity).

Like the first cleaning unit 100*a*, a second casing 120*b* of the second cleaning unit 100*b* includes a second cleaning brush roller 104 as a second cleaner, a second collection roller 105, a second scraping blade 106, and a second transport screw 110*b* and is provided with an entry seal 111*b* and an exit seal 112*b*.

The second cleaning unit 100*b* removes post-secondary-transfer residual toner charged with the normal charge polarity (the negative polarity), which has not been removed with the first cleaning unit 100*a*, and toner of the normal charge polarity (the negative polarity), which has received negative charge from the first cleaning brush roller 101. For this reason, a positive voltage having a polarity (positive polarity) opposite the normal charge polarity of toner is applied to the second cleaning brush roller 104 to electrostatically remove toner of the negative polarity on the intermediate transfer belt 2. A voltage of the negative polarity higher than a voltage applied to the second cleaning brush roller 104 is applied to the second collection roller 105.

Each of the first cleaning brush roller 101 and the second cleaning brush roller 104 includes a metal rotation shaft rotationally supported and a brush. The brush is made of a plurality of raising fibers standing on the peripheral surface of the rotation shaft. Each of the first cleaning brush roller 101 and the second cleaning brush roller 104 has an external diameter $\phi$ of 15 mm to 16 mm. Each of the raising fibers has a two-layered core-sheath structure in which the inside of each of the raising fibers is made of a conductive material such as conductive carbon, and the surface portion of each of the rising fibers is made of an insulating material such as polyester. In this manner, the core has approximately the same potential as the potential of the cleaning bias applied to each of the first cleaning brush roller 101 and the second cleaning brush roller 104, thus allowing toner to be electrostatically attracted to the surfaces of the raising fibers. As a result, toner particles on the intermediate transfer belt 2 are electrostatically captured to the raising fibers of the first cleaning brush roller 101 and the second cleaning brush roller 104.

In some embodiments, the raising fibers of the first cleaning brush roller 101 and the second cleaning brush roller 104 are made of only conductive fibers, not the two-layered core-sheath structure. In some embodiments, fibers are planted to be slanted with respect to a normal direction of the rotation shaft of each of the first cleaning brush roller 101 and the second cleaning brush roller 104. In some embodiments, the raising fibers of the second cleaning brush roller 104 applied with a cleaning bias of negative polarity have core-sheath structures, and the raising fibers of the first cleaning brush roller 101 are made of only conductive fibers. When the raising fibers of the first cleaning brush roller 101 applied with a cleaning bias of negative polarity are made of only conductive fibers, charge injection from the first cleaning brush roller 101 to toner is facilitated. In this manner, the first cleaning brush roller 101 can equalize toner on the intermediate transfer belt 2 to the negative polarity. Further, when the raising fibers of the second cleaning brush roller 104 have the core-sheath structure, charge injection into toner can be reduced, thus reducing positive charging of the toner on the intermediate transfer belt 2. Such a configuration can reduce occurrence of toner not electrostatically removed with the second cleaning brush roller 104.

Each of the first cleaning brush roller 101 and the second cleaning brush roller 104 is disposed to press against the intermediate transfer belt 2 at a depth of 1 mm. Each of the first cleaning brush roller 101 and the second cleaning brush roller 104 is rotated by a driving unit such that the raising fibers move in a direction (counter direction) opposite the belt travel direction BTD of the intermediate transfer belt 2 at a contact position at which each of the first cleaning brush roller 101 and the second cleaning brush roller 104 contacts the intermediate transfer belt 2. At the contact position, each of the first cleaning brush roller 101 and the second cleaning brush roller 104 is rotated to move the rising fibers in the counter direction so that the difference in linear velocity between the intermediate transfer belt 2 and each of the first cleaning brush roller 101 and the second cleaning brush roller 104 can be increased. In this manner, a contact rate of a certain position of the intermediate transfer belt 2 with the raising fibers increases in a period during which a certain position of the intermediate transfer belt 2 passes through a contact area with each of the first cleaning brush roller 101 and the second cleaning brush roller 104, thus allowing toner to be excellently removed from the intermediate transfer belt 2.

The first cleaning brush roller 101 and the second cleaning brush roller 104 is disposed opposite a first cleaning opposite roller 13 and a second cleaning opposite roller 14, respectively, via the intermediate transfer belt 2. The first cleaning opposite roller 13 is also conductive and grounded to form a cleaning electric field between the first cleaning opposite roller 13 and the first cleaning brush roller 101. The second cleaning opposite roller 14 is also conductive and ground to form a cleaning electric field between the second cleaning opposite roller 14 and the second cleaning brush roller 104.

In this embodiment, each of the first collection roller 102 and the second collection roller 105 is made of stainless steel (SUS). In some embodiments, the first collection roller 102 and the second collection roller 105 are made of any other material capable of achieving the following function. The function is to transfer toner attracted to the first cleaning brush roller 101 and the second cleaning brush roller 104, from the first cleaning brush roller 101 and the second cleaning brush roller 104 to the first collection roller 102 and the second collection roller 105, respectively, by potential gradient between the raising fibers and each of the first collection roller 102 and the second collection roller 105. For example, in some embodiments, each of the first collection roller 102 and the second collection roller 105 has a roller resistance log R of from 12 Ω·cm to 14 Ω·cm obtained by, e.g., covering a conductive metal core with a high-resistance elastic tube having a size of from several micrometers to 100 micrometers or coating the conductive metal core with an insulator. Using the stainless steel (SUS) rollers as the collection rollers allows cost reduction or reduction of an application voltage to a low level, thus allowing electric power saving. Further, setting the roller resistance log R to be 12 Ω·cm to 14 Ω·cm allows reduction of electric charge injection into toner in collection of the toner in the first collection roller 102 and the second collection roller 105. As a result, the polarity of toner becomes the same as the polarity of the voltage applied to the collection rollers, thus suppressing a reduction in toner collection efficiency.

In FIG. 6, as the intermediate transfer belt 2 moves, post-secondary-transfer residual toner on the intermediate transfer belt 2 passes a contact portion at which the first entry seal 111*a* contacts the intermediate transfer belt 2, and moves to the position of the first cleaning brush roller 101. The first cleaning brush roller 101 is applied with a cleaning bias having the normal charge polarity (negative polarity) of toner. By action of an electric field formed by an electric difference in surface potential between the intermediate transfer belt 2 and the first cleaning brush roller 101, toner charged with positive polarity on the intermediate transfer belt 2 is electrostatically attracted to the brush of the first cleaning brush roller 101. At this time, some toner particles receive negative charges from the brush through charge injection or electric discharge, are charged with the normal polarity (negative polarity), and remain on the intermediate transfer belt 2.

Toner particles having the positive polarity attracted to the first cleaning brush roller 101 are moved to a contact position at which the first cleaning brush roller 101 contacts the first collection roller 102 applied with a collection bias having a negative polarity greater in absolute value than the first cleaning brush roller 101. By the electric field formed by the difference in surface potential between the first cleaning brush roller 101 and the first collection roller 102, post-transfer residual toner in the brush of the first cleaning brush roller 101 is electrostatically transferred onto the first collection roller 102. After scraped off from the surface of the first collection roller 102 with the first scraping blade 103, post-transfer residual toner is delivered with the first transport screw 110*a* from the first cleaning unit 100*a* to a toner storage portion.

Post-secondary-transfer residual toner on the intermediate transfer belt 2, which has not been removed with the first cleaning brush roller 101, is delivered to a contact position at which the second cleaning brush roller 104 contacts the intermediate transfer belt 2. The second cleaning brush roller 104 is applied with a voltage of the opposite polarity (positive polarity) to the normal charge polarity of toner. By the electric field formed by the difference in surface potential between the intermediate transfer belt 2 and the second cleaning brush roller 104, toner charged with the negative polarity on the intermediate transfer belt 2 is electrostatically attracted to the second cleaning brush roller 104. Then, after electrostatically transferred to the second collection roller 105, residual toner is scraped off from the second collection roller 105 with the second scraping blade 106 and delivered from the second cleaning unit 100*b* to a toner storage portion.

In this embodiment, most post-secondary-transfer residual toner can be removed with the first cleaning unit 100*a* and the second cleaning unit 100*b*. However, for a configuration in which the belt cleaning device 10 includes only the first cleaning unit 100*a* to electrostatically remove toner of the positive polarity and the second cleaning unit 100*b* to electrostatically remove toner of the negative polarity, a stain-shaped abnormal image may occur which might be caused by cleaning failure. For example, such stain-shaped abnormal images may occur in Y-color solid images formed with the image forming unit 66Y for yellow disposed most upstream of the plurality of image forming units 66 in the belt travel direction BTD of the intermediate transfer belt 2.

Through diligent studies of the above-described stain-shaped abnormal images, the inventors of the present application have found that toner particles may adhere from each of the first cleaning brush roller 101 and the second cleaning brush roller 104 to the intermediate transfer belt 2 again and such re-adhesion toner may appear as the stain-shaped abnormal image.

Hence, the belt cleaning device 10 according to this embodiment includes the post cleaning unit 100*c* downstream from the second cleaning unit 100*b* in the belt travel direction BTD of the intermediate transfer belt 2, to remove re-adhesion toner, which has been adhered from each of the first cleaning brush roller 101 and the second cleaning brush roller 104 to the intermediate transfer belt 2 again.

The post cleaning unit 100*c* includes, e.g., a post cleaning roller 107 made of conductive sponge to remove re-adhesion toner on the intermediate transfer belt 2, a post collection roller 108 as a collection member to rotate while contacting the post cleaning roller 107 to collect toner from the post cleaning roller 107, and a post scraping blade 109 to scrape post-transfer residual toner from the surface of the post collection roller 108. The post cleaning roller 107, the post collection roller 108, and the post scraping blade 109 are disposed in a post casing 120*c*. For example, a post transport screw 110*c* to discharge scraped toner to the outside of the post casing 120*c* is also disposed in the post casing 120*c*.

The post casing 120*c* is provided with an entry seal 111*c* and an exit seal 112*c* that contact the intermediate transfer belt 2 to prevent toner in the post casing 120*c* from being scattered to the outside of the post casing 120*c*.

The post cleaning roller 107 is applied with a voltage of the positive polarity much greater in absolute value than a voltage applied to each of the first cleaning brush roller 101 and the second cleaning brush roller 104. The post collection roller 108 is applied with a voltage of the positive polarity greater than the voltage applied to the post cleaning roller 107. The post cleaning roller 107 is disposed opposite a cleaning opposite roller 15 via the intermediate transfer belt 2. The post cleaning opposite roller 15 is electrically conductive and grounded to from a cleaning electric field between the post cleaning opposite roller 15 and the post cleaning roller 107.

Figure 7:
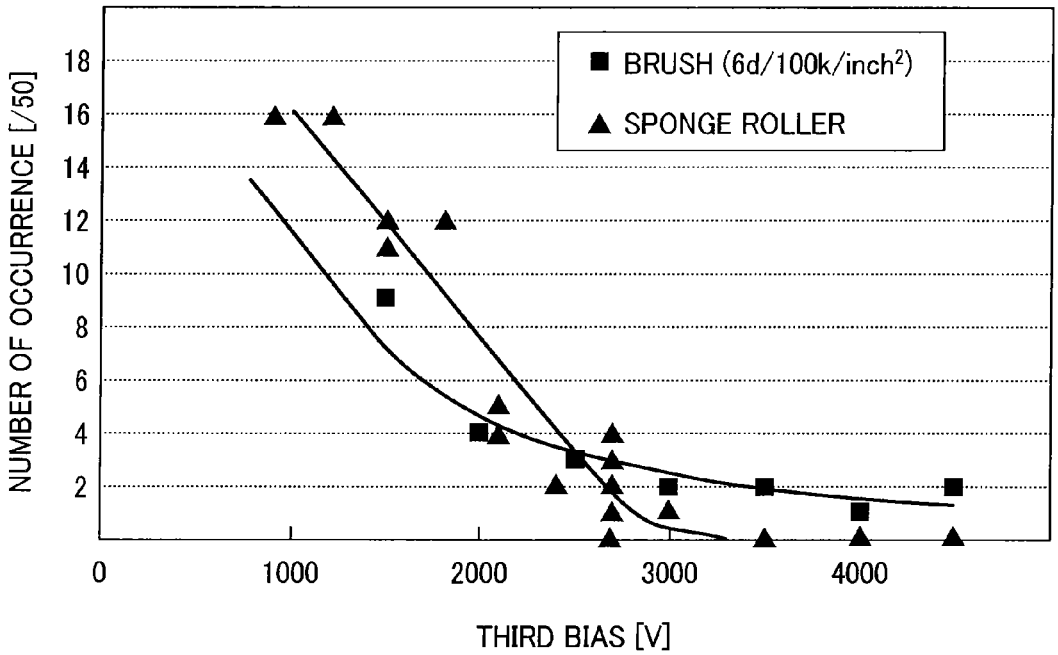
FIG. 7 is a graph of a relationship between the voltage applied to a post cleaning roller and the number of occurrence of stain-shaped abnormal image.

FIG. 7 is a graph of a relationship between the voltage applied to the post cleaning roller 107 and the number of recording sheets on which stain-shaped abnormal images occur. The number of occurrence in the vertical axis represents the number of recording sheets on which stain-shaped abnormal images. M, C, and B-color solid images are continuously formed on 50 recording sheets for each color, and then Y-color solid images are formed on 50 recording sheets. The Y-color solid images on the 50 recording sheets are visually checked for the occurrence of stain-shaped abnormal image.

As illustrated in FIG. 7, as the voltage applied to the post cleaning roller 107 increases, the number of occurrence of stain-shaped abnormal image decreases. In particular, in the configuration in which the post cleaning roller 107 is a conductive sponge roller, increasing the applied voltage can reduce the number of occurrence of stain-shaped abnormal image to zero. In the above-described example, the cleaning performance of the post cleaning unit 100*c* relative to re-adhesion toner and the occurrence of re-adhesion toner are evaluated based on the number of occurrence of stain-shaped abnormal image. However, the tendency of the results does not differ when evaluated by other evaluation methods.

Figure 8:
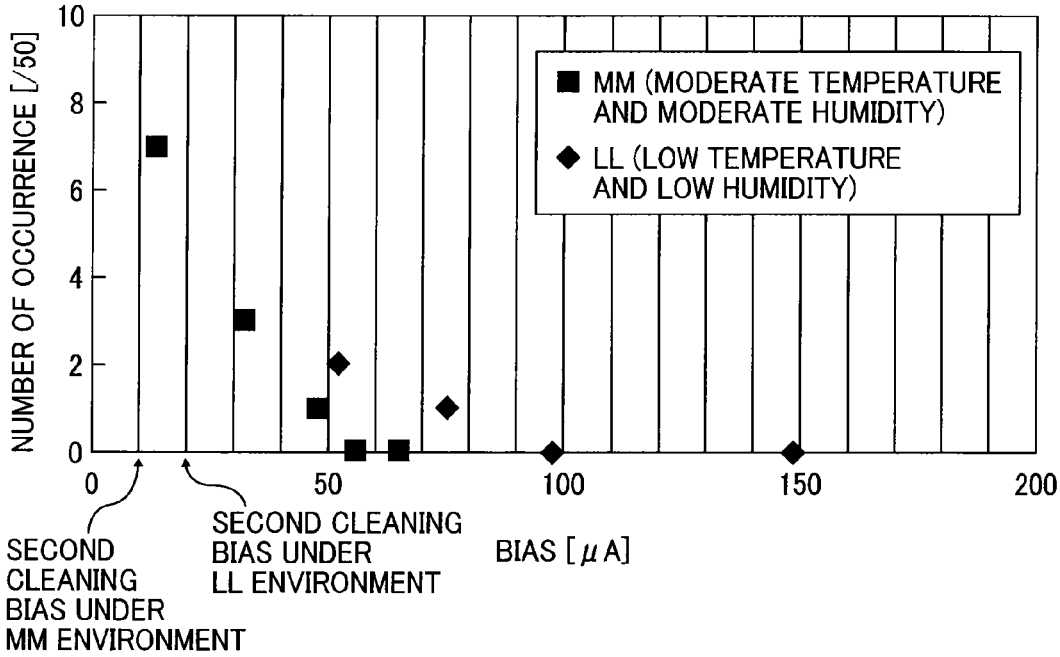
FIG. 8 is a graph of a relationship between the voltage applied to a post cleaning roller and the number of occurrence of stain-shaped abnormal image under a moderate temperature and moderate humidity environment and a low temperature and low humidity environment.

How large an applied bias is enough depends on a target user, system, and environment of the apparatus. In this embodiment, as illustrated in FIG. 8, under a low-temperature and low-humidity (LL) environment, the current setting value of the second cleaning brush roller 104 is set to 20 μA and the current setting value of the first cleaning brush roller 101 is set to −30 μA. In this case, when the current value of the post cleaning roller 107 is set to 55 μA, the number of occurrence of stain-shaped abnormal image is zero. At this time, the absolute value of the current value used for the first cleaning brush roller 101 is |30| μA while the absolute value of the current value used for the post cleaning roller 107 is |55| μA. When the current value of the post cleaning roller 107 is 1.8 times or greater than the current value of the first cleaning brush roller 101, the number of occurrence of stain-shaped abnormal image is zero.

Note that the current value used herein represents a current flowing from the first cleaning brush roller 101 or the post cleaning roller 107 to the intermediate transfer belt 2.

Further, under a room-temperature (moderate-temperature) and moderate-humidity (MM) environment, the current setting value of the second cleaning brush roller 104 is set to 10 μA and the current setting value of the first cleaning brush roller 101 is set to −30 μA. At this time, when a current of 100 μA, which is 3.3 times or greater than the absolute value of the current value used for the first cleaning brush roller 101 is applied to the post cleaning roller 107, the number of occurrence of stain-shaped abnormal image is zero.

Further, in a further research on a high-humidity environment, when a current having an absolute value of 10 or 30 times or greater than the absolute value of the current value used for the first cleaning brush roller 101 is applied to the post cleaning roller 107, the number of occurrence of stain-shaped abnormal image is zero. As described above, as the humidity increases, the current value of the post cleaning roller 107 necessary to prevent an abnormal image due to re-adhesion toner becomes greater.

Thus, the absolute value of the current of the post cleaning roller 107 is set to be at least twice or greater than the absolute value of the current of each of the first cleaning brush roller 101 and the second cleaning brush roller 104. Under the respective environments, the current value of the post cleaning roller 107 is changed to be different. For example, the image forming apparatus 1 includes a temperature-and-humidity sensor to detect temperature and humidity in the image forming apparatus 1 and changes the current value of the post cleaning roller 107 in accordance with detection results of the temperature-and-humidity sensor. Note that, the voltage value applied to the post cleaning roller 107 may be changed depending on the environments.

The post cleaning roller 107 includes a metal rotation shaft rotatably supported and a conductive sponge roller portion covering the peripheral surface of the rotation shaft, and has an outer diameter ϕ of 15 mm to 16 mm. The post collection roller 108 has a configuration similar to, if not the same as, the first collection roller 102 and the second collection roller 105.

As illustrated in FIG. 7, for the first cleaning brush roller 101 and the second cleaning brush roller 104, the number of occurrence of stain-shaped abnormal image can be reduced by increasing the bias applied. However, the number of occurrence is not reduced to zero. By contrast, for the conductive sponge roller, the number of occurrence of stain-shaped abnormal image can be reduced to zero by increasing the bias applied. For the first cleaning brush roller 101 and the second cleaning brush roller 104, toner attracted to the brush may move to a bottom of the brush. Such toner having moved to the bottom of the brush may not be collected with the collection rollers and may remain in the brush. Such toner remaining in the brush is supposed to occasionally adhere to the intermediate transfer belt 2 again. Therefore, for the brush rollers, it is supposed that re-adhesion toner removed with the brush rollers adheres again to the intermediate transfer belt 2 and the number of occurrence of stain-shaped abnormal image is not reduced to zero.

By contrast, for the conductive sponge roller, toner attracted to the sponge roller remains near the surface of the sponge roller. Therefore, it is supposed that toner attracted to the sponge roller is excellently collected with the collection rollers and uncollected toner remaining on the sponge roller hardly occur. As a result, toner adhered from the sponge roller to the intermediate transfer belt 2 again does not occur, and re-adhesion toner does not adhere to a portion of the intermediate transfer belt 2 having passed through the belt cleaning device 10. Accordingly, the number of occurrence of stain-shaped abnormal image is reduced to zero.

In this embodiment, a sponge roller is employed as the post cleaning roller 107. However, in some embodiments, a roller having a planar surface, such as a rubber roller or a metal roller, may be employed. For the roller having a planar surface, such as a rubber roller or a metal roller, toner also adheres to only the surface of the post cleaning roller 107. Accordingly, toner having been removed with the post cleaning roller 107 is excellently collected with the post collection roller 108, thus preventing toner from remaining without being collected with the post collection roller 108. Such a configuration prevents re-adhesion toner having been removed with the post cleaning roller 107 from adhering again from the post cleaning roller 107 to the intermediate transfer belt 2, thus allowing the number of occurrence of stain-shaped abnormal image to be reduced to zero.

In this embodiment, the polarity of voltage applied to the post cleaning roller 107 is positive. Accordingly, the polarity of voltage applied to the post cleaning roller 107 is set to be the same as the polarity of voltage applied to the second cleaning brush roller 104. As a result, the potential difference between the second cleaning brush roller 104 and the post cleaning roller 107 can be set to be smaller than when the polarity of voltage applied to the second cleaning brush roller 104 and the polarity of voltage applied to the post cleaning roller 107 differ from each other. Such a configuration prevents voltage leakage between the second cleaning brush roller 104 and the post cleaning roller 107.

Setting the polarity of voltage applied to the post cleaning roller 107 to the positive polarity allows removal of a slight amount of toner of the negative polarity having not been removed with the second cleaning brush roller 104.

Figure 9:
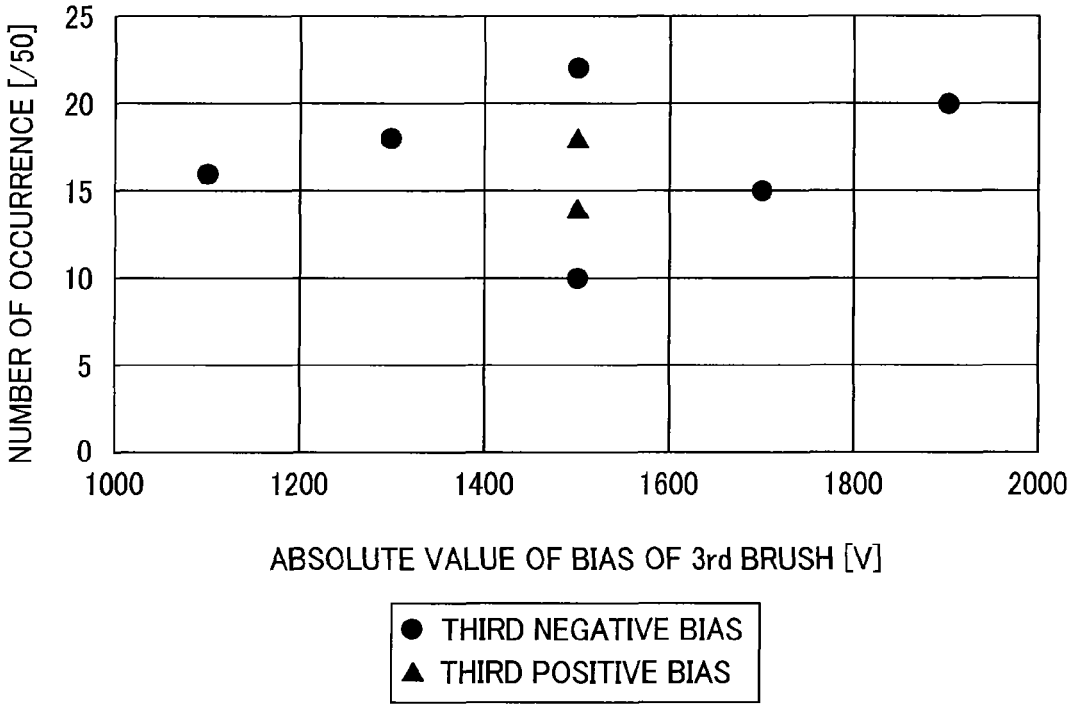
FIG. 9 is a graph of a result of comparison of the number of occurrence of stain-shaped abnormal image when the voltage of a positive polarity is applied to the post cleaning roller and the number of occurrence of stain-shaped abnormal image when the voltage of a negative polarity is applied to the post cleaning roller.

In this embodiment, a voltage of the positive polarity is applied to the post cleaning roller 107. However, in some embodiments, a voltage of the negative polarity may be applied to the post cleaning roller 107. As indicated by triangle marks in FIG. 9, when a voltage of +1500V is applied to the post cleaning roller 107, the number of occurrence of stain-shaped abnormal image is 17 sheets in 50 sheets and 14 sheets in 50 sheets and an average occurrence is 15.5 sheets in 50 sheets. As indicated by circular marks in FIG. 9, when a voltage of −1500V is applied to the post cleaning roller 107, the number of occurrence of stain-shaped abnormal image is 22 sheets in 50 sheets and 10 sheets in 50 sheets and an average occurrence is 16 sheets in 50 sheets. As described above, the average number of occurrence of stain-shaped abnormal image is not so much different between the application of the positive polarity and the application of the negative polarity and has a similar tendency of cleaning performance. The number of occurrence in the vertical axis in FIG. 9 represents the number of recording sheets on which stain-shaped abnormal images are formed under a high-temperature and high-humidity environment. M, C, and B-color solid images are continuously formed on 50 recording sheets for each color, and then Y-color solid images are formed on 50 recording sheets. The Y-color solid images on the 50 recording sheets are visually checked for the occurrence of stain-shaped abnormal image. As described above, there is no difference observed in cleaning performance between the application of voltage of the negative polarity and the application of voltage of the positive polarity to the post cleaning roller 107. Therefore, regardless of the polarity of voltage applied, application of a larger voltage allows excellent removal of re-adhesion toner with the post cleaning roller 107. Accordingly, even when a large voltage of the negative polarity is applied to the post cleaning roller 107, re-adhesion toner having passed the belt cleaning device is prevented from remaining on the intermediate transfer belt 2.

Alternatively, when a conductive sponge roller is employed as the cleaning member of each of the first cleaning unit 100*a* and the second cleaning unit 100*b*, the post cleaning unit 100*c* might be obviated without generating re-adhesion toner. However, if the cleaning member of each of the first cleaning unit 100*a* and the second cleaning unit 100*b* is a conductive sponge roller, post-secondary-transfer residual toner might not be excellently removed. One reason is that, for the conductive sponge roller, a cleaning nip between the intermediate transfer belt and the cleaning member is not so broad as for a brush roller. As a result, a sufficient time may not be obtained for electrostatic attraction of post-secondary-transfer residual toner from the intermediate transfer belt 2 to the cleaning members, thus hampering excellent removal of post-secondary-transfer residual toner. Accordingly, using the brush rollers as the cleaning members of the first cleaning unit 100*a* and the second cleaning unit 100*b* allows excellent removal of post-secondary-transfer residual toner. Further, re-adhesion toner adhered from the cleaning brush roller to the intermediate transfer belt 2 again is infrequent and the amount of re-adhesion toner is smaller than the amount of post-secondary-transfer residual toner. Accordingly, even if the conductive sponge roller is employed and the cleaning nip is narrower than when the brush roller is employed, re-adhesion toner is fully removed.

The average cell diameter of the post cleaning roller 107 made of the conductive sponge roller is preferably 150 μm or smaller.

Figure 10:
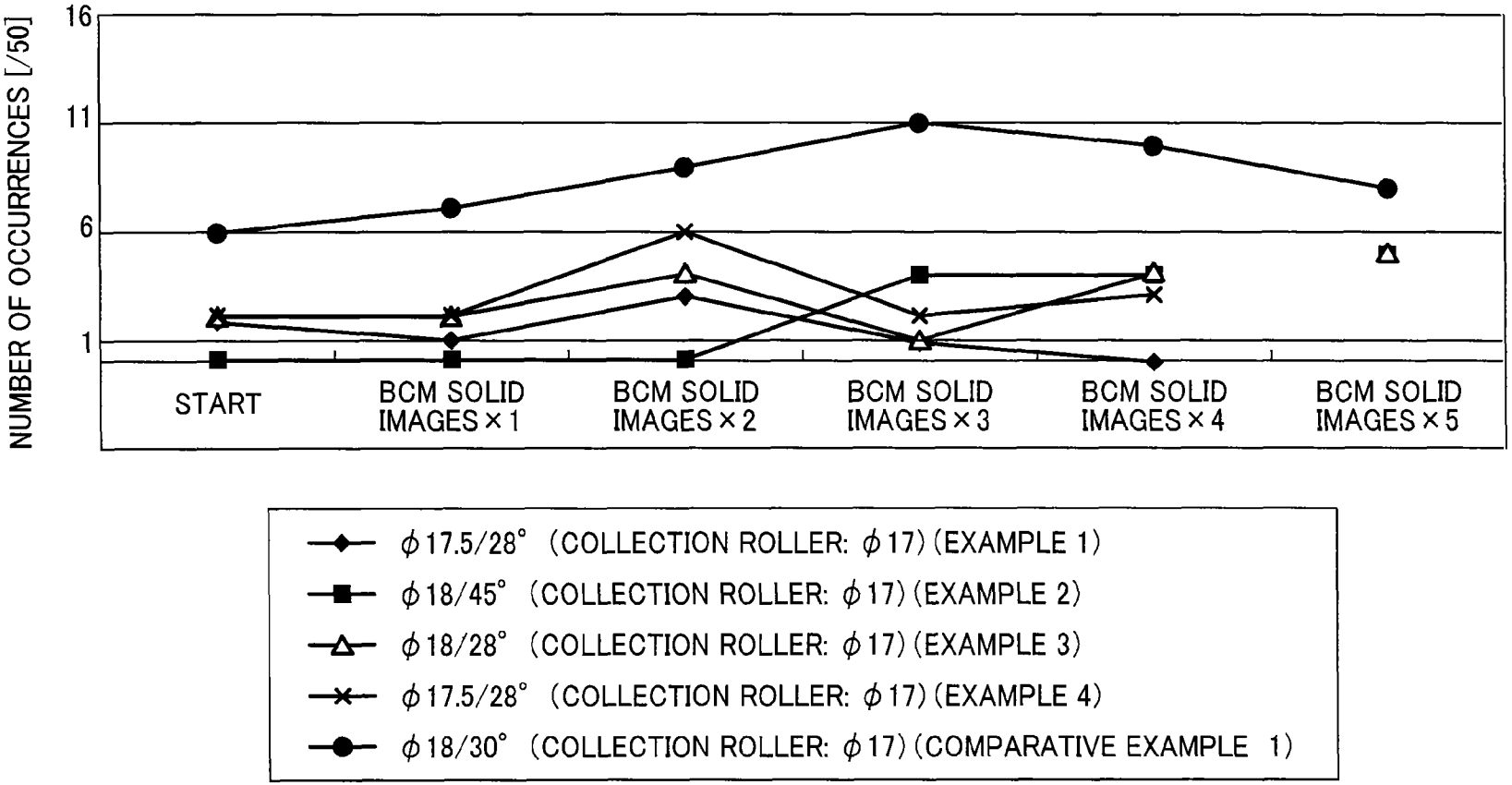
FIG. 10 is a graph of data on the number of occurrence of stain-shaped abnormal image for examples 1 through 4 and a comparative example 1.

FIG. 10 is a graph of data on the number of occurrence of stain-shaped abnormal image for examples 1 through 4 and a comparative example 1. In the examples 1 through 4, a conductive sponge roller having an average cell diameter ϕ of 150 μm or smaller is used. In the comparative example 1, a conductive sponge roller having an average cell diameter 4 of from 386 μm to 795 μm is used. Note that, the cell diameters of the examples 1 through 4 are in a range from 99 μm to 134 μm.

The number of occurrence in the vertical axis in FIG. 10 represents the number of recording sheets on which stain-shaped abnormal images are formed under a high-temperature and high-humidity (HH) environment. Continuous formation of M, C, and B-color solid Images on 50 recording sheets for each color is repeated for a predetermined number of times (0 to 5 times), and then Y-color solid images are formed on 50 recording sheets. The Y-color solid images on the 50 recording sheets are visually checked for the occurrence of stain-shaped abnormal image. The term "start" in the horizontal axis represents visually checked results of Y-color solid images formed on 50 recording sheets without the continuous formation of M, C, and B-color solid images. The term "BCM solid images×1" represents visually checked results of Y-color solid images formed on 50 recording sheets after the continuous formation of M, C, and B-color solid images on 50 recording sheets for each color is performed once. The term "BCM solid images×5" represents visually checked results of Y-color solid images formed on 50 recording sheets after the continuous formation of M, C, and B-color solid images on 50 recording sheets for each color is performed five times. The examples 1 through 4 are different in the diameter and Asker C hardness of the post cleaning roller 107 and the diameters of the collection rollers.

As illustrated in FIG. 10, for the examples 1 through 4 in which the cell diameter is 150 μm or smaller, the number of occurrence of stain-shaped abnormal image is 6 sheets or smaller. By contrast, for the comparative example 1 in which the cell diameter is in a range from 386 μm to 795 μm, the number of occurrence of stain-shaped abnormal image is 6 sheets or greater. This is supposed to be due to the following two reasons. One reason is that, for the comparative example 1 of a larger cell diameter, re-adhesion toner on the intermediate transfer belt 2 passes through the post cleaning roller 107 without being attracted to the post cleaning roller 107 and, as a result, the removal performance of re-adhesion toner decreases. The second reason is that a larger cell diameter increases toner moved inside the sponge roller and such toner is not collected with the post collection roller 108 and remains in the sponge roller. Accordingly, re-adhesion toner from the post cleaning roller 107 to the intermediate transfer belt 2 increases. For the two reasons, it is supposed that the sponge roller having the larger cell diameter does not fully reduce the occurrence of stain-shaped abnormal image due to re-adhesion toner.

By contrast, for the examples 1 through 4 in which the cell diameter is 150 μm or smaller, the post cleaning roller 107 contacts re-adhesion toner on the intermediate transfer belt 2 well, thus allowing re-adhesion toner on the intermediate transfer belt 2 to be excellently attracted to the post cleaning roller 107. Such a configuration prevents the attracted toner from moving deep into cells, thus allowing excellent collection of toner with the post collection roller 108. Thus, the occurrence of stain-shaped abnormal image due to re-attracted toner is excellently reduced.

The post cleaning roller 107 made of the sponge roller is preferably rotated so that a direction of travel of the surface of the post cleaning roller 107 is the same as the belt travel direction BTD of the intermediate transfer belt 2, at a contact position at which the post cleaning roller 107 contacts the intermediate transfer belt 2. Hereinafter, the direction of rotation of the post cleaning roller 107 is referred to as forward rotation. The sponge roller is greater in rotation load than the brush roller. Accordingly, like the first cleaning brush roller 101 and the second cleaning brush roller 104, when the post cleaning roller 107 made of the sponge roller is rotated in a direction opposite to the belt travel direction BTD of the intermediate transfer belt 2 (hereinafter, reverse rotation) at the contact position with the intermediate transfer belt 2, for example, the following failure may occur. In other words, it may be necessary to use an expensive drive motor of a large rated torque, such as an intermediate transfer drive motor to drive the intermediate transfer belt 2 or a cleaning derive motor to drive, e.g., the post cleaning roller 107, thus resulting in an increase in cost of the apparatus. Further, the cleaning performance does not differ between the forward rotation and the reverse rotation of the post cleaning roller 107. In any of the forward rotation and the reverse rotation, re-adhesion toner does not move to the image forming unit 66 and no stain-shaped abnormal image occurs. For these reasons, the forward rotation of the post cleaning roller 107 is preferable.

Figure 11:
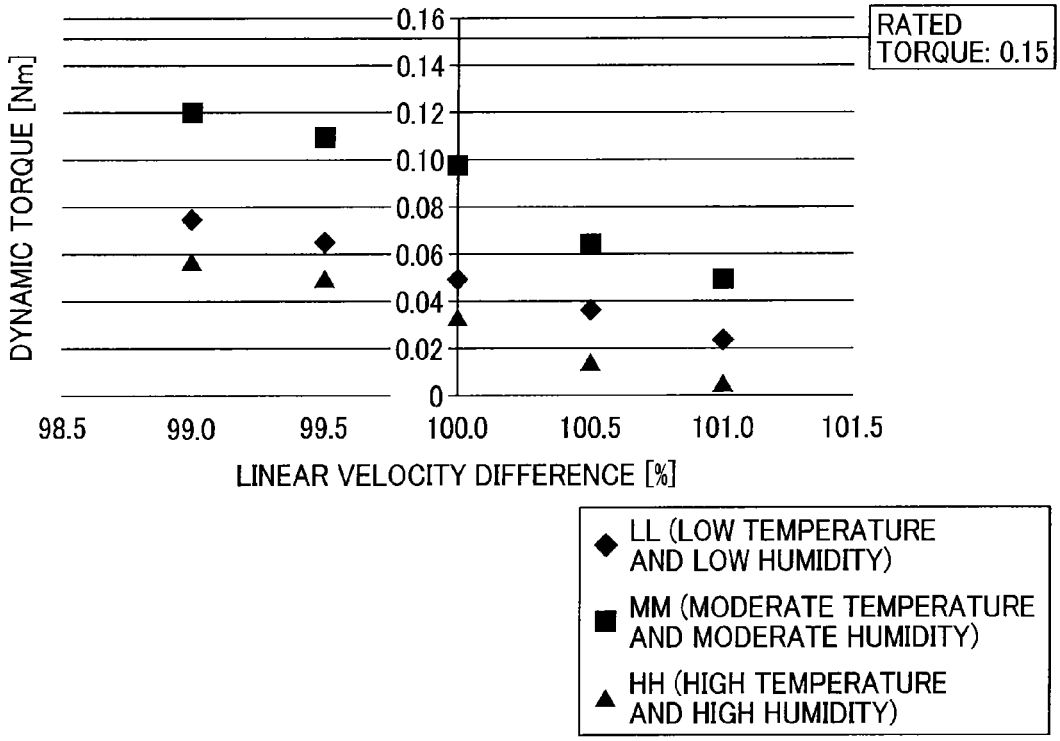
FIG. 11 is a graph of a relationship between the linear velocity difference between the post cleaning roller and the intermediate transfer belt and the torque of an intermediate drive motor to drive the intermediate transfer belt.
Figure 12:
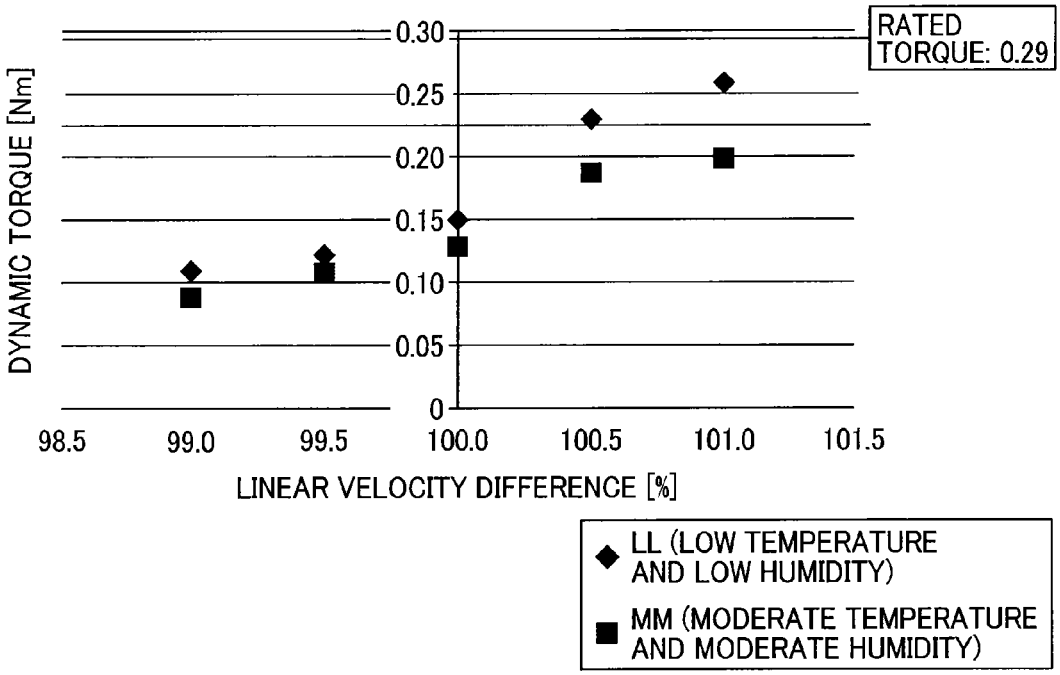
FIG. 12 is a graph of a relationship between the linear velocity difference between the post cleaning roller and the intermediate transfer belt and the torque of a drive motor to drive the belt cleaning device.

FIG. 11 is a graph of a relationship between the linear velocity difference between the post cleaning roller 107 and the intermediate transfer belt 2 and the torque of an intermediate drive motor to drive the intermediate transfer belt 2. FIG. 12 is a graph of a relationship between the linear velocity difference between the post cleaning roller 107 and the intermediate transfer belt 2, each of the collection rollers of the belt cleaning device 10, the torque of a cleaning drive motor to drive each of the cleaning rollers.

The linear velocity difference in FIGS. 11 and 12 is represented by (the linear velocity of the post cleaning roller 107/the linear velocity of the intermediate transfer belt 2)×100. The post cleaning roller 107 is rotated forward.

As illustrated in FIG. 11, when the linear velocity of the post cleaning roller 107 is slower than the linear velocity of the intermediate transfer belt 2 by more than 1%, under the room-temperature and moderate-humidity (MM) environment, the torque of the intermediate drive motor rises near the rated torque. As illustrated in FIG. 12, when the linear velocity of the post cleaning roller 107 is faster than the linear velocity of the intermediate transfer belt 2 by more than 1%, under the low-temperature and low-humidity (LL) environment, the torque of the cleaning drive motor rises near the rated torque.

As seen from FIGS. 11 and 12, the linear velocity of the post cleaning roller 107 is preferably within a range of ±1% of the linear velocity difference being 100%. For example, a configuration in which the post cleaning roller 107 is rotated with rotation of the intermediate transfer belt 2 obviates a drive transmission assembly to drive and rotate the post cleaning roller 107. Such a configuration preferably reduce the number of components and the cost of the apparatus. By contrast, a configuration in which the post cleaning roller 107 is driven and rotated with the cleaning drive motor is advantageous in more stably rotating the post cleaning roller 107 than the configuration in which the post cleaning roller 107 is rotated with rotation of the intermediate transfer belt 2.

Figure 13:
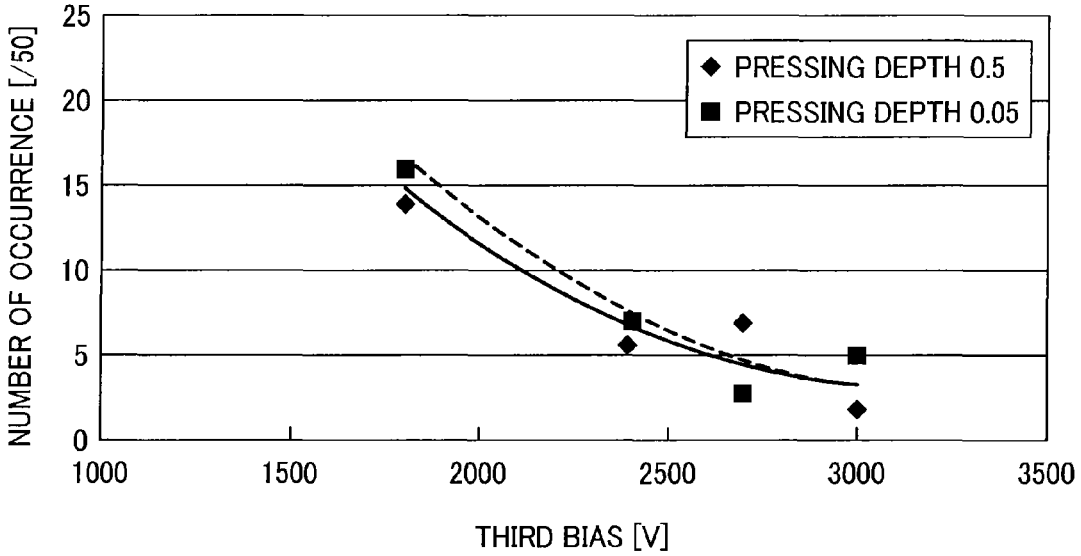
FIG. 13 is a graph of a relationship between the depth at which the post cleaning roller presses the intermediate transfer belt and the number of occurrence of stain-shaped abnormal image.

FIG. 13 is a graph of a relationship between the depth at which the post cleaning roller 107 presses against the intermediate transfer belt 2 and the number of occurrence of stain-shaped abnormal image. The number of occurrence of stain-shaped abnormal image represents the number of recording sheets on which stain-shaped abnormal images are formed under a high-temperature and high-humidity environment. M, C, and B-color solid images are continuously formed on 50 recording sheets for each color, and then Y-color solid images are formed on 50 recording sheets. The Y-color solid images on the 50 recording sheets are visually checked for the occurrence of stain-shaped abnormal image.

As seen from FIG. 13, considering variations of data, there is no difference between the depth of 0.5 mm and the depth of 0.05 mm in the relationship of the applied bias and the number of occurrence of stain-shaped abnormal image. In a viewpoint of drive load, the depth is preferably smaller. However, considering variations of the depth, the desirable range is from 0.05 mm to 0.35 mm for actual use. Since the torque is adjustable by increasing the motor rating, at least the depths from 0.05 mm to 0.5 mm are usable without causing much difference from a viewpoint of the prevention of occurrence of stain-shaped abnormal image.

The inventors of the present application has researched the number of occurrence of stain-shaped abnormal image in a similar manner to the above-described manner, using a sponge roller having an Asker C hardness of 28 degrees and a sponge roller having an Asker C hardness of 45 degrees. As a result, the relationship of the applied bias and the number of occurrence of stain-shaped abnormal image does not differ between 28 degrees and 45 degrees of the Asker C hardness, and exhibits a similar relationship to the graph of FIG. 13. The post cleaning roller 107 is preferably soft from the viewpoints of drive load and the setting property at which the post cleaning roller 107 is set against the post collection roller 108 while compressing the post collection roller 108. From the viewpoint of the prevention of occurrence of stain-shaped abnormal image due to re-adhesion toner, at least Asker C hardness from 28 degrees to 45 degrees are usable without causing much difference.

For example, in this embodiment, the Asker C hardness of the post cleaning roller 107 is set to 35 degrees. Setting the Asker C hardness to 35 degrees allows the Asker C hardness of the post cleaning roller 107 to be in a range of not less than 28 degrees and not greater than 45 degrees even if mass-production variations are included.

Like the first collection roller 102 and the second collection roller 105, the post collection roller 108 is a stainless steel (SUS) roller and has a configuration similar to, if not the same as, each of the first collection roller 102 and the second collection roller 105. The post collection roller 108 may be made of any material as long as a function of dislocating toner adhered to the post cleaning roller 107 with potential gradients between the post collection roller 108 and the post cleaning roller 107. As the post collection roller 108, for example, a roller obtained by covering a conductive metal core with a high-resistance elastic tube having a size of from several micrometers to 100 micrometers or coating the conductive metal core with an insulator to make a roller resistance log R=12 Ω·cm to 14 Ω·cm may be used.

From the viewpoint of drive load, the post collection roller 108 preferably has a configuration in which the post collection roller 108 is rotated with rotation of the post cleaning roller 107. A contact pressure at which the post collection roller 108 and the post cleaning roller 107 being the sponge roller contacts each other is higher than the brush rollers, thus increasing the drive load. Further, the higher contact pressure allows the post collection roller 108 to be stably rotated with rotation of the post cleaning roller 107 even when the post cleaning roller 107 is a metal roller. Such a configuration obviates a drive assembly to drive the post collection roller 108, thus reducing the number of components and the cost of the apparatus. Note that, in some embodiments, a drive motor transmits a drive force to the post collection roller 108 to drive and rotate the post collection roller 108.

As described above, re-adhesion toner adhered from the second cleaning brush roller 104 to the intermediate transfer belt 2 again and a slight amount of toner of the negative polarity having not been removed with the second cleaning brush roller 104 is transferred to the post cleaning roller 107. Such re-adhesion toner and a slight amount of toner of the negative polarity transferred to the post cleaning roller 107 are electrostatically attracted to the post cleaning roller 107 applied with a voltage of the opposite polarity of the normal charge polarity of toner. The re-adhesion toner and the slight amount of toner of the negative polarity are collected with the post collection roller 108 and scraped off from the post collection roller 108 with the post scraping blade 109. Such toner scraped from the post collection roller 108 with the post scraping blade 109 is transported from the post cleaning unit 100*c* to the toner storage portion with the post transport screw 110*c*.

Conditions of each of the first cleaning brush roller 101 and the second cleaning brush roller 104 are as follows.

Conditions of the first cleaning brush roller 101

Brush material: Conductive polyester (having a structure in which fiber surfaces are made of conductive materials, and being available from a brush manufacturer, e.g., TOEISANGYO CO., LTD.)

Resistance of brush: $10^6\Omega$ to $10^8\Omega$

Planting density of brush fibers: sixty thousand to one hundred fifty thousand per square inch Diameter of brush fiber: about 25 μm to about 35 μm Flattening of brush edges: None Brush diameter ϕ: 14 mm to 20 mm Depth of brush fibers pressed into the intermediate transfer belt 2: 1 mm to 1.5 mm Conditions of the second cleaning brush roller 104

Material of brush: conductive polyester (having a core-sheath structure in which the interior of each fiber is made of conductive carbon and the surface of each fiber is made of polyester, and being available from a brush manufacturer, e.g., TOEISANGYO CO., LTD.)

Resistance of brush: $10^6\Omega$ to $10^8\Omega$

Planting density of brush fibers: one hundred and fifty thousand to two hundred thousand per square inch Thickness of brush fiber: 14 denier to 30 denier Flattening of brush edges: None Brush diameter ϕ: 14 mm to 20 mm Depth of brush fibers pressed into the intermediate transfer belt 2: 1 mm to 1.5 mm Conditions of the post cleaning roller 107 are as follows:

Material of cleaning roller: conductive polyurethane (manufactured by Yamauchi Corporation)

Diameter ϕ: 14 mm to 20 mm

Resistance: $10^{7.25\pm0.25}\Omega$

Hardness: Asker C hardness of 35 degrees

Depth of the post cleaning roller 107 pressed into the intermediate transfer belt 2: 0.05 mm to 0.4 mm The voltage applied to the first cleaning brush roller 101 is set so that, when post-secondary-transfer residual toner is input to the intermediate transfer belt 2, toner charged with the opposite polarity does not occur. For example, the voltage applied to the first cleaning brush roller 101 is determined through an experiment in which, after passing the first cleaning brush roller 101, toner may be sucked by air and measured in, e.g., a Faraday cage or through a research about toner adhesion after cleaning.

The second cleaning brush roller 104 is set to remove toner on the intermediate transfer belt 2. The planting density of brush fibers, the resistance of brush, the fiber diameter, the voltage applied, the fiber type, and the depth at which brush fibers press into the intermediate transfer belt 2 can be optimized according to a system used, and are not limited to the above-described types and values. Examples of the fiber type usable include nylon, acryl, polyester, and so on.

Conditions of each of the first collection roller 102, the second collection roller 105, and the post collection roller 108 are as follows:

Material of metal core of collection roller: SUS 303

Depth of brush fibers pressed into collection roller: 1 mm to 1.5 mm

Pressing depth of collection roller: 0.5 mm

Material of the collection rollers, the depth of brush fibers pressing into each collection roller, the voltage applied can be optimized for a system used, and are not limited to the above-described material and values.

Conditions of the first scraping blade 103, the second scraping blade 106, and the post scraping blade 109 are as follows:

Material of scraping blade: SUS 304

Contact angle of blade: 20°

Thickness of blade: 0.1 mm

Depth of blade pressed into collection roller: 0.5 mm to 1.5 mm

The contact angle of blade, the thickness of blade, and the depth of blade pressed into each collection roller can be optimized for a system used, and are not limited to the above-described values.

For the belt cleaning device 10, voltages are applied to each of the first collection roller 102, the second collection roller 105, the post collection roller 108, each of the first cleaning brush roller 101 and the second cleaning brush roller 104, and the post cleaning roller 107. However, in some embodiments, voltages are applied to only the first collection roller 102, the second collection roller 105, and the post collection roller 108.

In such a case, by a potential drop due to, e.g., the resistance of each of the first cleaning brush roller 101, the second cleaning brush roller 104, and the post cleaning roller 107, a bias voltage slightly lower than a bias voltage applied to each collection roller is applied to each of the first cleaning brush roller 101, the second cleaning brush roller 104, and the post cleaning roller 107, via the contact portion with each collection roller. Accordingly, potential differences are formed between the first cleaning brush roller 101 and the first collection roller 102, between the second cleaning brush roller 104 and the second collection roller 105, and between the post cleaning roller 107 and the post collection roller 108, thus allowing toner to be electrostatically moved to each collection roller by a potential gradient toward each collection roller.

Note that the cleaning current to obtain a best cleaning performance is a target current flowing a contact point between the intermediate transfer belt 2 and each of the first cleaning brush roller 101, the second cleaning brush roller 104, and the post cleaning roller 107. Table 1 is a table of an example of target current values. The term "1st" represents the first cleaning brush roller 101, the term "2nd" represents the second cleaning brush roller 104, and the term "3rd" represents the post cleaning roller 107. In this embodiment, the first cleaning brush roller 101 is set to a constant voltage. This is because of a reason of current control, and indeed, current setting is preferable. The 2nd representing the second cleaning brush roller 104 and the 3rd representing the post cleaning roller 107 are set to current setting. Actually, as described below, a voltage is determined when a target current value of Table 1 flows, and cleaning is performed with the determined voltage in an output operation. The values enclosed in the parentheses are reference values.

TABLE 1

| | | 1st | 2nd | 3rd |
|---|---|---|---|---|
| LL | Voltage | −2100 | (2100) | (5700) |
| | Current | (−30) | 20 | 55 |
| MM | Voltage | −2000 | (1400) | (4200) |
| | Current | (−30) | 10 | 110 |
| HH | Voltage | −1500 | (800) | (3000) |
| | Current | (−30) | 10 | 270 |

Note:
The unit of voltage is V and the unit of current is μA

The process linear velocity in this embodiment is set to 350 mm/s. Note that process linear velocities of from 100 mm/s to 800 mm/s are compatible.

The target current is set to a value proportional to the linear velocity. For example, when the process linear velocity is 175 mm/s which is half of 350 mm/s, the target current value is set to half of the target current value for the process linear velocity of 350 mm/s. Alternatively, when the process linear velocity is 700 mm/s which is twice as fast as 350 mm/s, the target current value is set to twice as large as the target current value for the process linear velocity of 350 mm/s.

The planting density of brush fibers of the second cleaning brush roller 104 is preferably set to lower than the planting density of brush fibers of the first cleaning brush roller 101, for example, in a range of from fifteen thousand per square inch to twenty thousand per square inch.

Table 2 is a table of experiment results of different planting densities of brush fibers and thicknesses of the second cleaning brush roller 104.

TABLE 2

| Planting density of brush | Thickness of brush | Frequency of occurrence of stain-shaped image |
|---|---|---|
| One hundred thousand per square inch | 6 denier | 49 sheets/50 sheets |
| Twenty thousand per square inch | 14 denier | 3 sheets/50 sheets |

The frequency of occurrence of stain-shaped abnormal image of Table 2 represents the number of recording sheets on which stain-shaped abnormal images are formed under a high-temperature and high-humidity environment in which a stain-shaped abnormal image is likely to occur. Continuous formation of M, C, and B-color solid images on 50 recording sheets for each color is repeated three times, and then Y-color solid images are formed on 50 recording sheets. The Y-color solid images on the 50 recording sheets are visually checked for the occurrence of stain-shaped abnormal image. The first cleaning brush roller 101 is applied with −1400 V. The second cleaning brush roller 104 is applied with 1200 V. The post cleaning roller 107 is applied with 2500 V.

As illustrated in Table 2, it is found that setting the planting density of brush fibers of the second cleaning brush roller 104 to be lower than the planting density of brush fibers of the first cleaning brush roller 101 reduces the number of occurrence of stain-shaped abnormal image due to re-adhesion toner. This is supposed to be because reducing the planting density reduces the number of raising fibers and the amount of toner caught into the brush and, as a result, the amount of re-adhesion toner adhered from the second cleaning brush roller 104 to the intermediate transfer belt 2 again is reduced. In similar experiments with different experiment environments, when a brush of 14 denier and twenty thousand per square inch is used as the second cleaning brush roller 104, the occurrence of stain-shaped abnormal image is prevented.

The brush fibers are preferably as thick as possible so that the brush contacts the intermediate transfer belt 2 with less clearances at the contact position. By contacting the intermediate transfer belt 2 with less clearances at the contact position, post-secondary-transfer residual toner on the intermediate transfer belt 2 reliably contacts the brush, thus allowing excellent removal of post-secondary-transfer residual toner.

Figure 14:
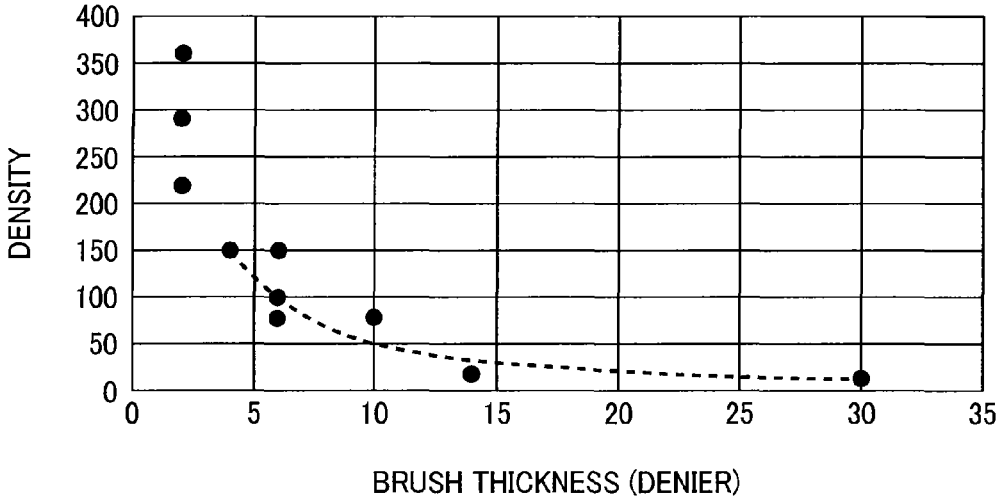
FIG. 14 is a graph of a relationship between the planting density and the thickness of brush fibers.

FIG. 14 is a graph of a relationship between the planting density and the thickness of brush fibers. From FIG. 14, for the planting densities of fifteen thousand to twenty thousand per square inch, the relationship represented by the following formula seems to be approximately satisfied:

the thickness of brush fibers (denier)=0.0032×planting density (number of fibers per square inch)+78.

However, the thickness of brush fibers may be greater than the value obtained by the above formula because the cleaning performance is enhanced.

Next, a description is given of a verification experiment by the inventors of the present application in which a brush member is used instead of the post cleaning roller 107. Table 3 represents a result of the verification experiment.

TABLE 3

| | Number of occurrence of stain-shaped image | |
|---|---|---|
| Brush type | Start | After one round |
| 1) BR-1/6 d/70k | 15 | 18 |
| 2) KCP/14 d/20k | 0 | 3 |
| 3) KCP/30 d/15k | 4 | 3 |

The term "BR-1" in Table 3 is a brush having brush fibers, each of which includes a core made of insulating material and a surface layer made of conductive material. The term "KCP" is a brush having brush fibers, each of which includes a core made of conductive material and a surface layer made of insulating material. The term "start" in Table 3 represents the number of recording sheets on which stain-shaped abnormal images are formed under a moderate-temperature and moderate-humidity environment. After Y-color solid images are formed on 50 recording sheets, the Y-color solid images on the 50 recording sheets are visually checked for the occurrence of stain-shaped abnormal image. The term "after one round" in Table 3 represents the number of recording sheets on which stain-shaped abnormal images. M, C, and B-color solid images are continuously formed on 50 recording sheets for each color, and then Y-color solid images are formed on 50 recording sheets. The Y-color solid images on the 50 recording sheets are visually checked for the occurrence of stain-shaped abnormal image. The verification experiment is conducted under a room-temperature and moderate humidity environment. The bias applied to each brush "BR-1" is the same.

As seen from Table 3, for the brush (1) having a planting density of seventy-thousand brush fibers per square inch, stain-shaped abnormal images due to re-adhesion toner are observed in more than 15 sheets. By contrast, for the brush (1) having a planting density of fifteen-thousand brush fibers per square inch, stain-shaped abnormal images due to re-adhesion toner are observed in not more than 15 sheets. Accordingly, setting the planting density of brush fibers of the post cleaning roller 107 within a range from fifteen thousand to twenty thousand per square inch can reduce re-adhesion toner.

Further, in this experiment by the inventors of the present application, only the first cleaning unit 100*a* is set and a C-color solid image is output. The C-color solid image is cleaned with the first cleaning brush roller 101, thus causing C-color toner to adhere to the first cleaning brush roller 101. Next, a cleaning unit according to a comparative example using the brush (1) of Table 3, a cleaning unit according to Example 1 using the brush (2) of Table 3, and a cleaning unit according to Example 2 using the brush (3) of Table 3 are prepared. A M-color solid image is removed with each cleaning unit and M-color toner is adhered to each brush. The cleaning unit according to the comparative example having removed M-color toner is set downstream from the first cleaning unit 100*a* having removed C-color toner. The intermediate transfer belt 2 and the cleaning units are driven to rotate. As a result, only M-color toner is observed on a portion of the intermediate transfer belt 2 downstream from the cleaning unit according to the comparative example, and C-color toner is not observed on the portion of the intermediate transfer belt 2.

Next, in the same manner, the cleaning unit according to Example 1 having removed M-color toner is set downstream from the first cleaning unit 100*a* having removed C-color toner. The intermediate transfer belt 2 and the cleaning units are driven to rotate. As a result, little toner is observed on a portion of the intermediate transfer belt 2 downstream from the cleaning unit according to Example 1 and a slight amount of toner on the portion of the intermediate transfer belt 2 is M-color toner. Accordingly, setting the planting density of brush fibers to at least twenty thousand per square or lower inch can reduce re-adhesion of toner from the brush roller to the intermediate transfer belt 2.

Next, in the same manner, the cleaning unit according to Example 2 having removed M-color toner is set downstream from the first cleaning unit 100*a* having removed C-color toner. The intermediate transfer belt 2 and the cleaning units are driven to rotate. As a result, little toner is observed on a portion of the intermediate transfer belt 2 downstream from the cleaning unit according to Example 2 and a slight amount of toner on the portion of the intermediate transfer belt 2 is M-color toner. Accordingly, setting the planting density of brush fibers to at least fifteen thousand per square or lower can excellently remove re-adhesion toner from the intermediate transfer belt 2.

From the above-described verification experiment, setting the planting density of brush fibers to fifteen to twenty thousand per square inch allows re-adhesion toner to be excellently removed from the intermediate transfer belt 2 and reduced from the brush to the intermediate transfer belt 2. The inventors of the present application thinks this is because of the following reason. For example, a portion of toner removed with the brush roller enters among brush fibers and partially remains in the brush without being collected with the collection roller. Such toner remaining in the brush is supposed to occasionally adhere to the intermediate transfer belt 2 again. Accordingly, the lower the planting density of brush fibers, the smaller the amount of toner entering among raising fibers and retained in the brush. As a result, re-adhesion of toner from the brush to the intermediate transfer belt 2 is supposed to be reduced.

The lower the planting density of brush fibers, the smaller the amount of brush fibers catch toner on the intermediate transfer belt 2. As a result, the cleaning performance is supposed to be reduced. However, it is observed that setting the planting density of brush fibers to at least fifteen thousand per square or lower can excellently remove re-adhesion toner from the intermediate transfer belt 2.

Further, the inventors of the present application thinks that one reason of re-adhesion of toner from the brush to the intermediate transfer belt 2 is as follow. Through a cleaning bias applied to the brush, charge of the opposite polarity to the charge polarity of toner is injected from the brush to toner adhering to the brush. To toner entering among brush fibers and remaining in the brush, charge of the opposite polarity to the charge polarity of toner is continuously injected over time. Such toner becomes uncharged or turns to the same polarity as the cleaning bias. As a result, when toner particles entering among brush fibers move to the projecting side of the brush, electrostatic attraction force does not act between the toner particles and the brush fibers. Accordingly, the toner particles adhere to the intermediate transfer belt 2 again at the contact position at which the brush contacts the intermediate transfer belt 2.

Each of the brush (2) and the brush (3) in Table 3 having reduced re-adhesion toner is a brush roller having brush fibers, each of which includes a core made of conductive material and a surface layer made of insulating material. As described above, the surface of raising fiber is made of insulating material, thus reducing charge injection to toner. Such a configuration prevents toner entering among brush fibers from being uncharged or charged with the same polarity as the cleaning bias. As a result, even if toner entering among brush fibers move to the projecting side of the brush, the brush excellently attracts such toner by electrostatic force, thus reducing re-adhesion of toner to the intermediate transfer belt 2. Further, such toner is electrostatically attracted and collected with the collection roller at the contact position at which the collection roller contacts the intermediate transfer belt 2. Accordingly, it is supposed that using the KCP brush having raising fibers, each of which includes a core made of conductive material and a surface layer made of insulating material, reduces re-adhesion toner to the intermediate transfer belt 2 and the occurrence of stain-shaped abnormal image.

Further, the planting density of brush fibers of the first cleaning brush roller 101 is preferably set to sixty to one-hundred-fifty per square inch which is greater than the planting density of the cleaning brush downstream from the first cleaning brush roller 101. The greater the number of raising fibers, the greater the amount of toner adheres to the brush roller. As described above, the first cleaning brush roller 101 preferably has a high-level cleaning performance to remove about 80% of post-secondary-transfer residual toner. Hence, the planting density of brush fibers of the first cleaning brush roller 101 is set within a range from sixty to one-hundred-fifty per square inch to secure an excellent cleaning performance. Even if toner is re-adhered from the first cleaning brush roller 101 to the intermediate transfer belt 2, such re-adhesion toner is removed with the second cleaning brush roller 104 and the post cleaning roller 107 downstream from the first cleaning brush roller 101.

Figure 15:
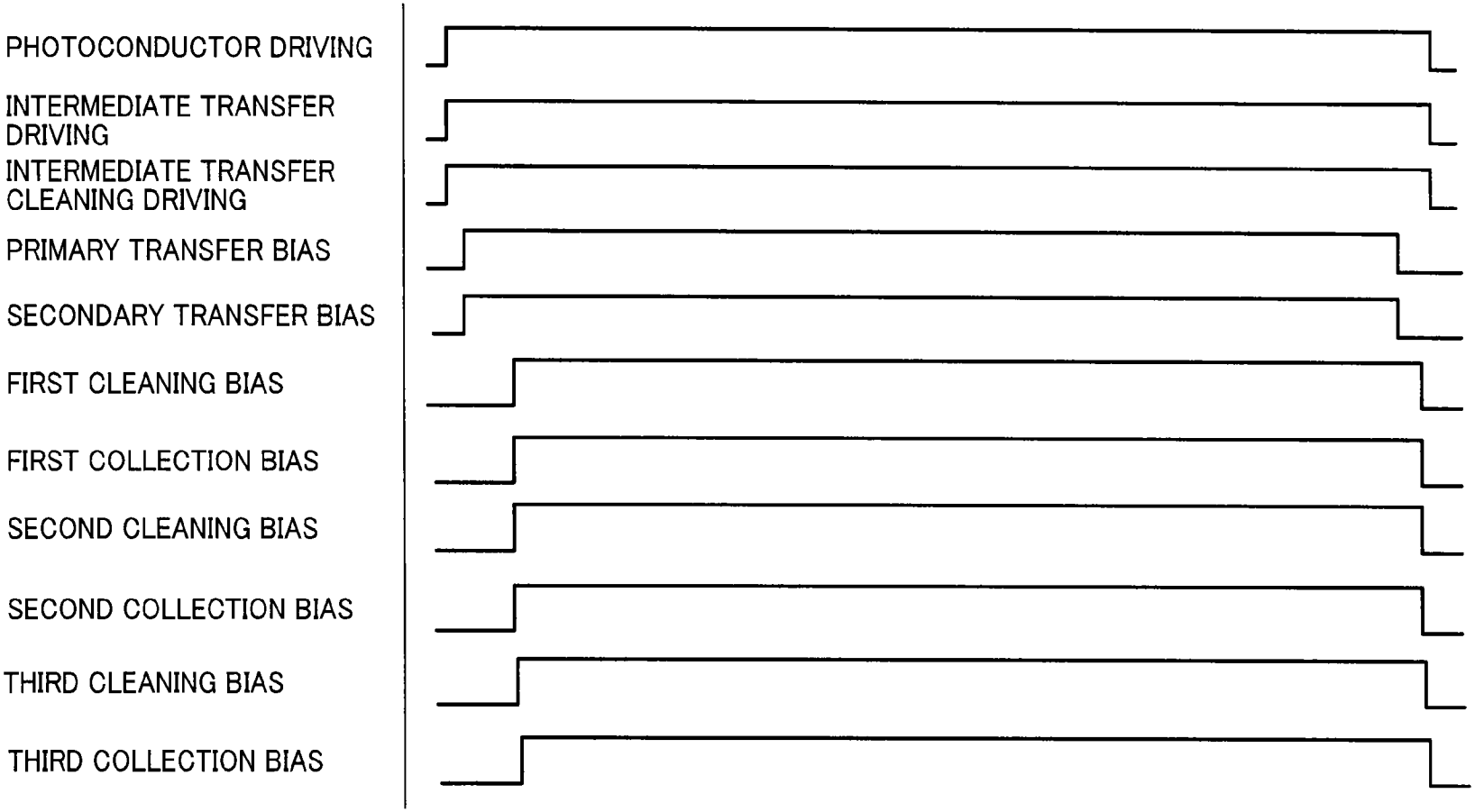
FIG. 15 is a timing chart of on/off timing of biases applied to a cleaning brush roller, the post cleaning roller, and collection rollers.

FIG. 15 is a timing chart of on/off timing of biases applied to the cleaning brush rollers, the post cleaning roller 107, and the collection rollers. In FIG. 15, a first cleaning bias is a bias applied to the first cleaning brush roller 101. A second cleaning bias is a bias applied to the second cleaning brush roller 104. A third cleaning bias is a bias applied to the post cleaning roller 107. A first collection bias is a bias applied to the first collection roller 102. A second collection bias is a bias applied to the second collection roller 105. A third collection bias is a bias applied to the post collection roller 108.

The contact of the photoconductor 3 with the intermediate transfer belt 2 and the contact of the intermediate transfer belt 2 with the secondary transfer belt 9C are conducted before a start of driving of the photoconductor 3. The contact of the photoconductor 3 with the intermediate transfer belt 2 and the contact of the intermediate transfer belt 2 with the secondary transfer belt 9C may be conducted after the start of driving of the photoconductor 3. Even in such a case, the contact of the photoconductor 3 with the intermediate transfer belt 2 and the contact of the intermediate transfer belt 2 with the secondary transfer belt 9C are conducted before application of a transfer bias. As illustrated in FIG. 15, the first to third cleaning biases and the collection bias are controlled to be simultaneously applied after application of the primary transfer bias and the secondary transfer bias. This is because electric currents from the post cleaning roller 107, the first cleaning brush roller 101, and the second cleaning brush roller 104 flow into other brushes or rollers via the intermediate transfer belt 2 and interfere with each other. Simultaneous application of the first to third cleaning biases and the collection bias prevents occurrence of an excessive potential difference. For the same reason, it is preferably to stepwisely raise each bias by a small width of, for example, 300V in unit of several tens of milliseconds rather than sharply raise. The setting of the cleaning biases and so on are started at this timing.

The image forming apparatus 1 executes a setting change process of an application voltage of the belt cleaning device 10 as well as a process control to be executed on the power-on of the image forming apparatus 1 and each time image formation is performed on a predetermined number of recording sheets. For example, when a measurement value of temperature or humidity with the temperature-and-humidity sensor has changed by a predetermined value or greater from the previous measurement value of temperature or humidity with the temperature-and-humidity sensor, the image forming apparatus 1 executes the setting change process of a voltage setting value.

For example, when the temperature change is 10° C. or greater or the humidity change is 50% or greater, the setting change process is executed on the second cleaning brush roller 104 and the post cleaning roller 107 and the setting on the application voltage is changed to obtain a target electric-current value in a setting table corresponding to the present measurement value of temperature or humidity.

In this embodiment, the temperature-and-humidity environment is largely classified into three types, and the image forming apparatus 1 has three types of setting values corresponding to the three types of temperature-and-humidity environments. In some embodiments, the temperature-and-humidity environment may be more finely classified into more than three types, and the image forming apparatus 1 may have more than three types of setting values.

Figure 16:
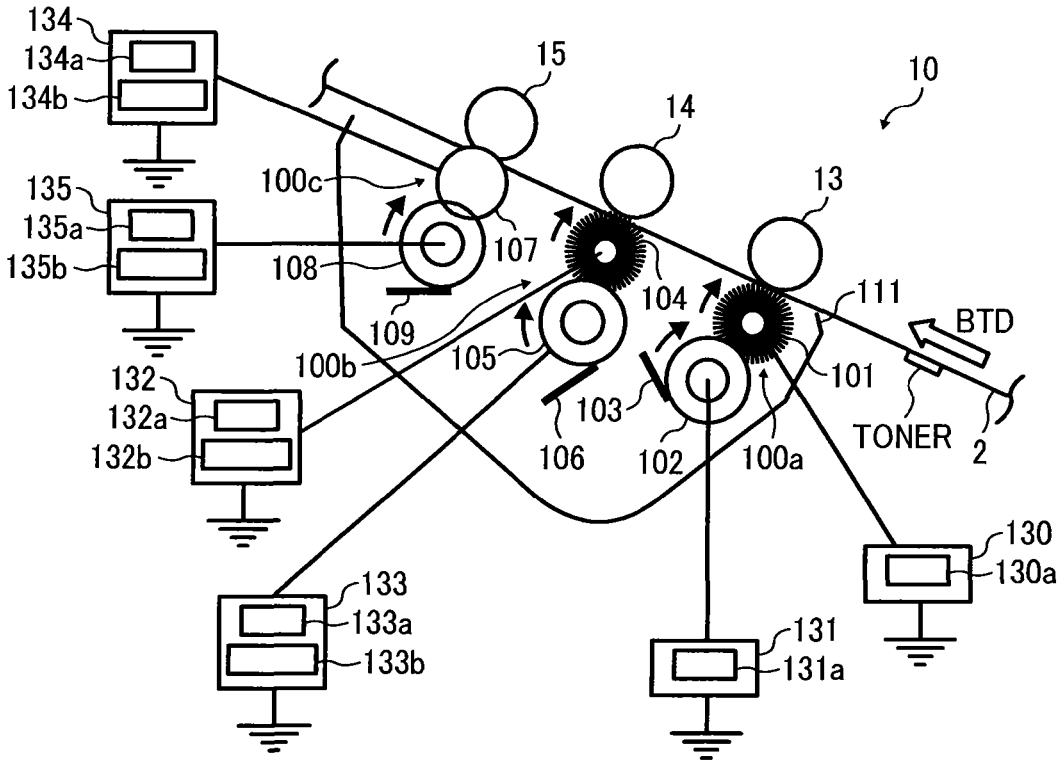
FIG. 16 is a schematic view of a configuration of a power supply unit of the belt cleaning device.

FIG. 16 is a schematic view of a configuration of power supply units of the belt cleaning device 10.

The setting change process of application voltage of the belt cleaning device 10 is executed while the intermediate transfer belt 2 and the belt cleaning device 10 are driven and no toner is input to the belt cleaning device 10. Here, in this embodiment, the setting values of voltage applied to each of the first cleaning brush roller 101, the second cleaning brush roller 104, the post cleaning roller 107, the first collection roller 102, the second collection roller 105, and the post collection roller 108 are simultaneously changed. Accordingly, predetermined voltages are applied from power supply units 130, 131, 132, 133, 134, and 135 connected to the first cleaning brush roller 101, the second cleaning brush roller 104, the post cleaning roller 107, the first collection roller 102, the second collection roller 105, and the post collection roller 108, respectively.

To simplify control, the power supply units 130 and 131 apply to the first cleaning brush roller 101 and the first collection roller 102, respectively, constant voltage in accordance with the type of the environment. Accordingly, the power supply unit (first cleaning power supply unit) 130 to apply voltage to the first cleaning brush roller 101 and the power supply unit (first collection power supply unit) 131 to apply voltage to the first collection roller 102 have no detectors to detect electric current flowing power supplies 130*a* and 131*a* of the power supply units 130 and 131.

The power supply unit (second cleaning power supply unit) 132 to apply voltage to the second cleaning brush roller 104 includes a power supply 132*a* and a detector 132*b* to detect a current value IB2 flowing the power supply 132*a*. The power supply unit (second collection power supply unit) 133 to apply voltage to the second collection roller 105 includes a power supply 133*a* and a detector 133*b* to detect a current value IC2 flowing the power supply 133*a*.

The power supply unit (third cleaning power supply unit) 134 to apply voltage to the post cleaning roller 107 includes a power supply 134*a* and a detector 134*b* to detect a current value IB3 flowing the power supply 134*a*. The power supply unit (third collection power supply unit) 135 to apply voltage to the post collection roller 108 includes a power supply 135*a* and a detector 135*b* to detect a current value IC3 flowing the power supply 135*a*.

A voltage is determined so that each of a total IT2 of the current value IB2 and the current value IC2 and a total IT3 of the current value IB3 and the current value IC3 is equal to a target current value. The setting values of voltage applied to the second cleaning brush roller 104, the post cleaning roller 107, the second collection roller 105, and the post collection roller 108 are simultaneously changed.

In the subsequent image forming operations, the setting values are used until the next setting change process of voltage setting values is executed.

Figure 17:
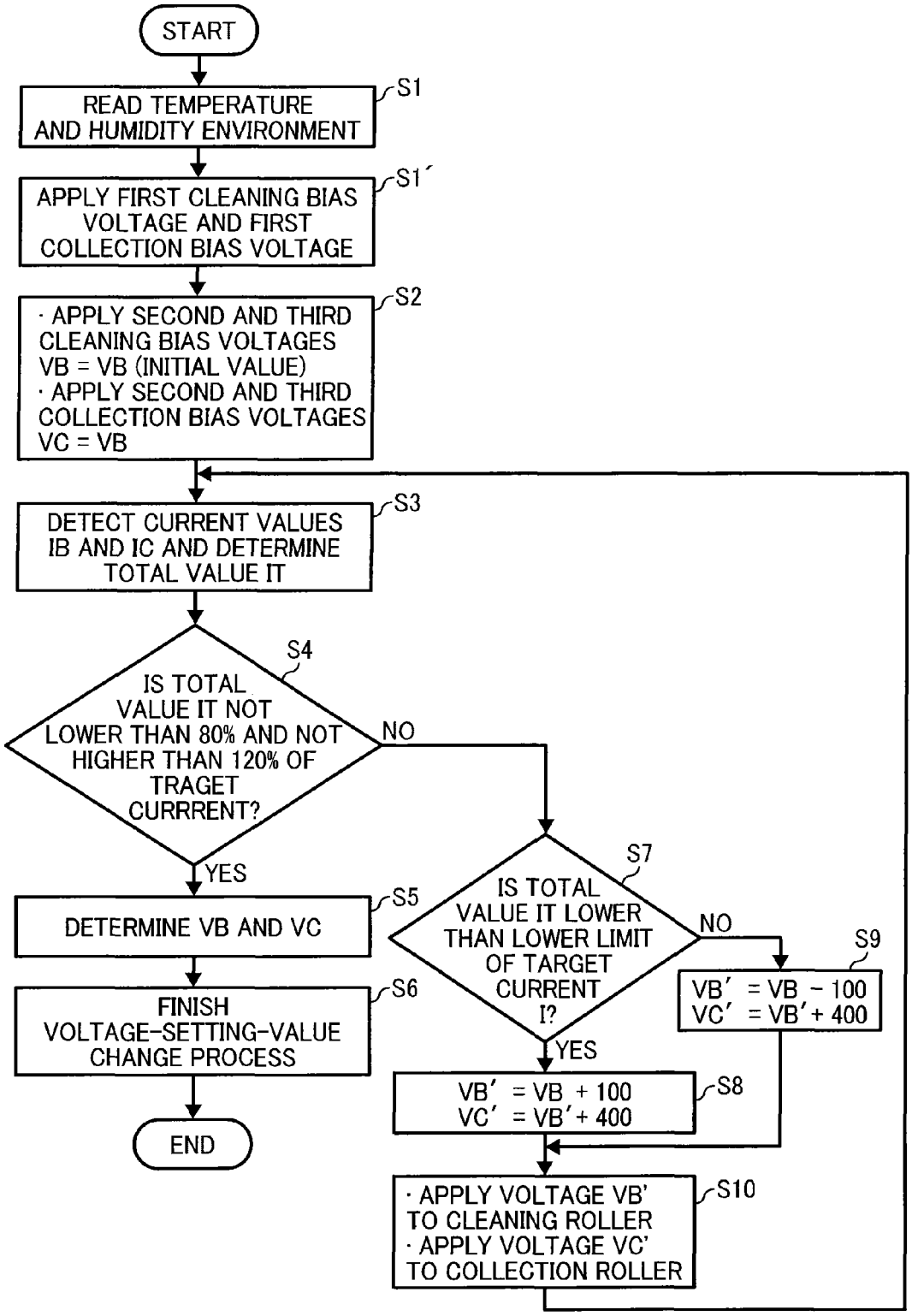
FIG. 17 is a flowchart of an example of a setting change process of voltage setting values.

FIG. 17 is a flowchart of an example of the setting change process of voltage setting values.

In FIG. 17, the second cleaning unit 100*b* and the post cleaning unit 100*c* are not distinguished because the same setting change process of voltage setting values is simultaneously executed on the second cleaning unit 100*b* and the post cleaning unit 100*c*. Hereinafter, the post cleaning roller 107 and the second cleaning brush roller 104 are referred to as "cleaning roller" unless specifically distinguished. A voltage having been set to each of the second cleaning brush roller 104, the post cleaning roller 107, the second collection roller 105, and the post collection roller 108 in the previous setting change process is stored as an initial value in a memory. In changing the voltage setting value, the initial value is read from the memory and used as a voltage first applied to each of the second cleaning brush roller 104, the post cleaning roller 107, the second collection roller 105, and the post collection roller 108. The voltage values of Table 1 are an example of the initial values.

This is because if a voltage largely differing from a desired voltage is applied, an electric current flowing between the cleaning rollers via the intermediate transfer belt 2 would increase and accelerate degradation of the first cleaning brush roller 101, the second cleaning brush roller 104, the post cleaning roller 107, and the intermediate transfer belt 2.

First, based on measurement values of the temperature-and-humidity sensor in the image forming apparatus 1, target current values of a temperature-and-humidity environment corresponding to the measurement values are read from the setting table (S1). Next, the first cleaning bias and the first collection bias are applied (S1').

Then, predetermined voltages are applied from the power supplies 132*a*, 133*a*, 134*a*, and 135*a* connected to the second cleaning brush roller 104, the post cleaning roller 107, the second collection roller 105, and the post collection roller 108, respectively (S2).

At S2, as described above, voltage setting values having been set in the previous setting change process and stored as initial values in the memory are read from the memory and used as a voltage VB2 and a voltage VB3 applied to the second cleaning brush roller 104 and the post cleaning roller 107, respectively. A voltage higher than the voltage VB2 by 400V and a voltage higher than the voltage VB3 by 400V are used as a voltage VC2 and a voltage VC3 applied to the second collection roller 105 and the post collection roller 108, respectively.

The current value IB2 and the current value IB3 flowing the power supply 132*a* and the power supply 134*a* to apply voltage to the second cleaning brush roller 104 and the post cleaning roller 107 are detected with the detector 132*b* and the detector 134*b*, respectively. Likewise, the current value IC2 and the current value IC3 flowing the power supply 133*a* and the power supply 135*a* to apply voltage to the second collection roller 105 and the post collection roller 108 are detected with the detector 133*b* and the detector 135*b*, respectively. From the current values detected, the total IT2 of the current value IB2 and the current value IC2 and the total IT3 of the current value IB3 and the current value IC3 are determined (S3).

It is determined whether the total IT2 or the total IT3 is within a range of not less than 80% and not greater than 120% of the target current value (S4).

If the total IT2 or the total IT3 is within the range of not less than 80% and not greater than 120% of the target current value (YES at S4), the voltage VB2 and the voltage VB3 or the voltage VC2 and the voltage VC3 are determined as voltage setting values (S5). Thus, a series of the setting change process of voltage setting values is finished (S6).

By contrast, If the total IT2 or the total IT3 is not within the range of not less than 80% and not greater than 120% of the target current value (NO at S4), it is determined whether the total IT2 or the total IT3 is smaller than a lower limit of the target current value (S7).

If the total IT2 or the total IT3 is smaller than a lower limit of the target current value (YES at S7), a voltage higher than the voltage VB2 by 100V or a voltage higher than the voltage VB3 by 100V is determined as a voltage VB'2 or a voltage VB'3. Further, a voltage higher than the voltage VB'2 by 400V or a voltage higher than the voltage VB'3 by 400V is determined as a voltage VC'2 or a voltage VC'3 (S8).

By contrast, if the total IT2 or the total IT3 is not smaller than a lower limit of the target current value (NO at S7), a voltage lower than the voltage VB2 by 100V or a voltage lower than the voltage VB3 by 100V is determined as the voltage VB'2 or the voltage VB'3. Further, a voltage higher than the voltage VB'2 by 400V or a voltage higher than the voltage VB'3 by 400V is determined as the voltage VC'2 or the voltage VC'3 (S9).

The voltage VB'2 and the voltage VB'3 are applied to the second cleaning brush roller 104, the post cleaning roller 107, respectively, and the voltage VC'2 and the voltage VC'3 are applied to the second collection roller 105 and the post collection roller 108, respectively (S10). Then, the current value IB2 and the current value IB3 and the current value IC2, and the current value IC3 are detected, and the above-described series of control process is repeatedly performed.

In this embodiment, detection of current value is performed after both the second cleaning brush roller 104 and the post cleaning roller 107 make one rotation or more from the application of voltage. Through examinations of the inventors of the present application, it is found that the current of the brush or roller differs between the first rotation and the subsequent rotation. Accordingly, if the setting operation is performed during the first rotation of the brush or roller, it would adversely take a longer time. Furthermore, the brushes and the rollers have variations in the pressing depths, at which the brushes and the rollers press the intermediate transfer belt 2, or variations in resistance in manufacturing. Hence, the measurement of electric current is performed for at least one rotation of the brush or roller. For example, after a time obtained by dividing the outer peripheral length of the brush or roller by the rotation speed of the brush or roller passes from a start of driving of the intermediate transfer belt 2, data sampling is performed by reading current values in unit of 10 milliseconds in accordance with, for example, clock signals of a central processing unit (CPU), and an average of the current values is determined.

The detection of current values is preferably performed while the primary transfer bias and the secondary transfer bias are turned on and the intermediate transfer belt 2 applied with the primary transfer bias and the secondary transfer bias passes the second cleaning brush roller 104 and the post cleaning roller 107. This is because the resistance of the intermediate transfer belt 2 may be changed by application of the primary transfer bias and the secondary transfer bias to the intermediate transfer belt 2. Accordingly, detecting the current values as described above allows the respective biases to be set in consideration of variations in resistance of the intermediate transfer belt 2, thus allowing more accurate bias setting.

The measurement of electric current may be performed during image output as well as the voltage setting. In the configuration in which the measurement of electric current is performed during image output, it is very convenient for a service person to identify the cause of a cleaning failure.

On the occurrence of a cleaning failure, if a target current is not flowing, the voltage setting can be changed to flow the target current. If the target current is flowing, the service person can speculate other causes, such as defects of brush, thus allowing an earlier identification of the cause.

For the measurement of electric current during image output, the same operation as the measurement during the voltage setting can be performed with the detector 132*b* and the detector 134*b* at the same timing as the measurement during the voltage setting. For example, a service person operates an operation panel to execute a current measurement mode. When the current measurement mode is executed, detection of electric current is started at a timing synchronous with an image output, for example, at a timing, at which a portion of the intermediate transfer belt 2 from which an image has been secondarily transferred passes each cleaning roller, calculated from the linear velocity of the intermediate transfer belt 2 in synchronous with ON timing of the registration rollers. Electric currents are sampled for one rotation of the cleaning roller, and an average of the sampled electric currents is displayed on the operation panel of the image forming apparatus 1.

In the above-described embodiment, in a configuration in which the cleaning case 120 including three cleaning members is removably mountable relative to an apparatus body 150 of the image forming apparatus 1, a specific one cleaning member of the three cleaning members might scratch the outer surface of the intermediate transfer belt 2 on removal or mounting of the cleaning case.

Hence, a separation assembly 60 to move the specific cleaning member or an opposite member opposite the specific cleaning member in a direction away from the intermediate transfer belt 2 to separate the specific cleaning member from the intermediate transfer belt 2 is disposed to prevent the scratches. The separation assembly 60 is described below.

Figure 19:
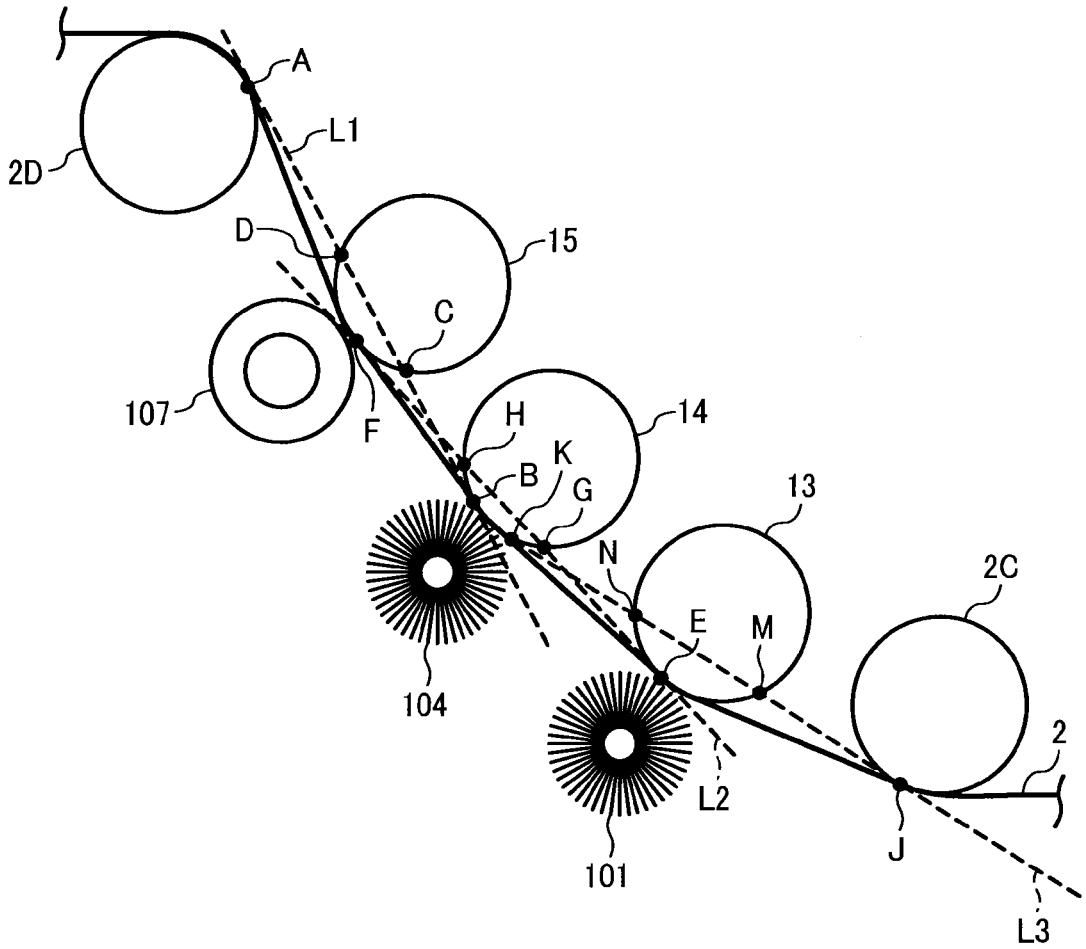
FIG. 19 is a schematic view of positional relationships between a secondary transfer opposite roller, a first cleaning opposite roller, a second cleaning opposite roller, a post cleaning opposite roller, and a tension roller.

First, a description is given of positional relationships of the cleaning members and the opposite rollers. FIG. 19 is a schematic view of positional relationships between a secondary transfer opposite roller 2*c*, the first cleaning opposite roller 13, the second cleaning opposite roller 14, a post cleaning opposite roller 15, and the tension roller 2D. In FIG. 19, the post cleaning opposite roller 15 is disposed at a position such that the outer circumferential circle of the post cleaning opposite roller 15 intersects at two points C and D with a common tangent line L1 passing a contact point A at which the surface of the tension roller 2D contacts the intermediate transfer belt 2 and a contact point B at which the surface of the second cleaning opposite roller 14 contacts the intermediate transfer belt 2. In other words, a portion of the post cleaning opposite roller 15 is disposed at a side of the post cleaning roller 107 relative to the common tangent line L1. Accordingly, a portion of the intermediate transfer belt 2 between the tension roller 2D and the second cleaning opposite roller 14 is pressed toward the side of the post cleaning roller 107 by the post cleaning opposite roller 15, thus applying tension to the portion of the intermediate transfer belt 2. Such a configuration stretches the intermediate transfer belt 2 taut and reduces sagging between the tension roller 2D and the second cleaning opposite roller 14, thus closely contacting the intermediate transfer belt 2 with the post cleaning opposite roller 15 to maintain the contactness.

Further, the second cleaning opposite roller 14 is disposed at a position such that the outer circumferential circle of the second cleaning opposite roller 14 intersects at two points G and H with a common tangent line L2 passing a contact point F at which the surface of the first cleaning opposite roller 13 contacts the intermediate transfer belt 2 and a contact point F at which the surface of the post cleaning opposite roller 15 contacts the intermediate transfer belt 2. In other words, a portion of the second cleaning opposite roller 14 is disposed at a side of the second cleaning brush roller 104 relative to the common tangent line L2. Accordingly, a portion of the intermediate transfer belt 2 between the first cleaning opposite roller 13 and the post cleaning opposite roller 15 is pressed toward the side of the second cleaning brush roller 104 by the second cleaning opposite roller 14, thus applying tension to the portion of the intermediate transfer belt 2. Such a configuration stretches the intermediate transfer belt 2 taut and reduces sagging between the first cleaning opposite roller 13 and the post cleaning opposite roller 15, thus closely contacting the intermediate transfer belt 2 with the second cleaning opposite roller 14 to maintain the contactness.

Further, the first cleaning opposite roller 13 is disposed at a position such that the outer circumferential circle of the first cleaning opposite roller 13 intersects at two points M and N with a common tangent line L3 passing a contact point J at which the surface of the secondary transfer opposite roller 2*c* contacts the intermediate transfer belt 2 and a contact point K at which the surface of the second cleaning opposite roller 14 contacts the intermediate transfer belt 2. In other words, a portion of the first cleaning opposite roller 13 is disposed at a side of the first cleaning brush roller 101 relative to the common tangent line L3. Accordingly, a portion of the intermediate transfer belt 2 between the secondary transfer opposite roller 2*c* and the second cleaning opposite roller 14 is pressed toward the side of the first cleaning brush roller 101 by the first cleaning opposite roller 13, thus applying tension to the portion of the intermediate transfer belt 2. Such a configuration stretches the intermediate transfer belt 2 taut and reduces sagging between the secondary transfer opposite roller 2*c* and the second cleaning opposite roller 14, thus closely contacting the intermediate transfer belt 2 with the first cleaning opposite roller 13 to maintain the contactness.

Such a configuration allows proper cleaning currents to flow from the first cleaning brush roller 101, the second cleaning brush roller 104, and the post cleaning roller 107 to the first cleaning opposite roller 13, the second cleaning opposite roller 14, and the post cleaning opposite roller 15, respectively. Accordingly, toner on the intermediate transfer belt 2 is excellently removed with the first cleaning brush roller 101, the second cleaning brush roller 104, and the post cleaning roller 107, thus preventing a reduction in cleaning performance.

Figure 20:
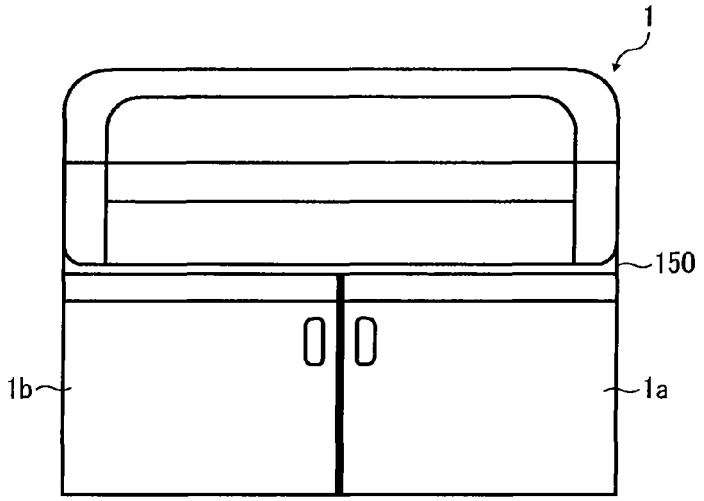
FIG. 20 is an external view of an image forming apparatus seen from the frond side of an apparatus body.
Figure 21:
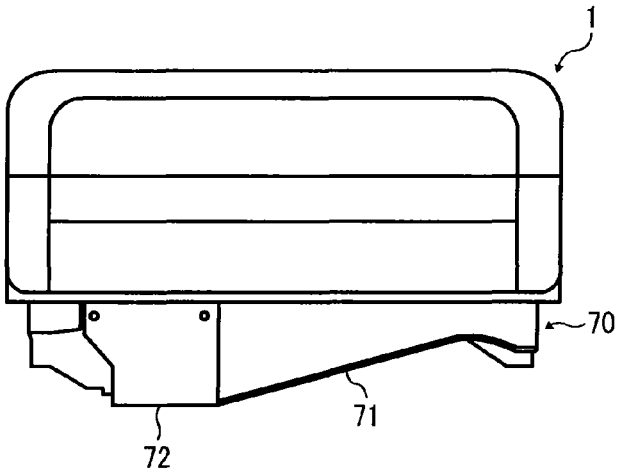
FIG. 21 is an external view of the image forming apparatus in a stage in which front doors of the apparatus body are open and an intermediate transfer unit is exposed.

FIG. 20 is an external view of the image forming apparatus 1 seen from a front side of the apparatus body 150 (a side at which a user usually stands to operate the image forming apparatus 1). At a position corresponding to the intermediate transfer unit 70 of the image forming apparatus 1, two body front doors 1*a* and 1*b* are disposed to be openable and closable relative to the apparatus body 150. Normally, as illustrated in FIG. 20, the body front doors 1*a* and 1*b* are closed. In the image forming apparatus 1 according to this embodiment, the belt cleaning device 10 mounted in the intermediate transfer unit 70 is replaceable with a lubrication device by a user. When the body front doors 1*a* and 1*b* are open on, e.g., replacement of the belt cleaning device with the lubrication device, as illustrated in FIG. 21, a first inner cover 71 and a second inner cover 72 of the intermediate transfer unit 70 appear.

Figure 22:
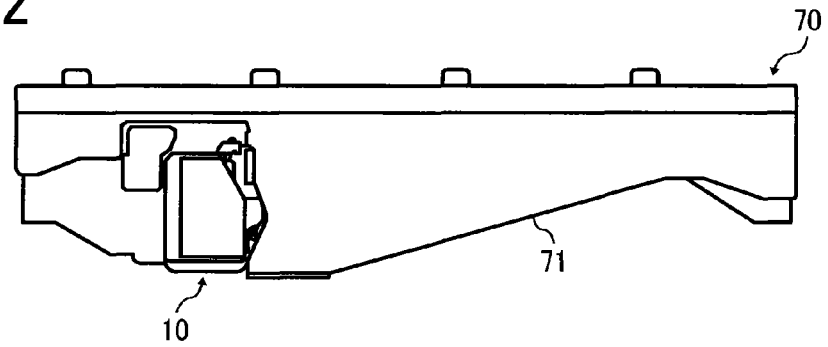
FIG. 22 is an external view of the intermediate transfer unit in a state in which a first inner cover is removed from a second inner cover.

At a side face of the intermediate transfer unit 70 is disposed the first inner cover 71 to prevent a user from contacting a driving body in the intermediate transfer unit 70. The second inner cover 72 as a member differing from the first inner cover 71 is disposed at a side face of the intermediate transfer unit 70, to prevent a user from contacting the belt cleaning device 10 and the lubrication device. The second inner cover 72 is secured to the first inner cover 71 with two screws. By unscrewing the two screws with the body front doors 1*a* and 1*b* open, as illustrated in FIG. 22, the second inner cover 72 is removable from the first inner cover 71. As described above, after the second inner cover 72 is removed, a user performs a replacement operation for removing and mounting the belt cleaning device 10 or the lubrication device relative to the intermediate transfer unit 70.

Figure 23:
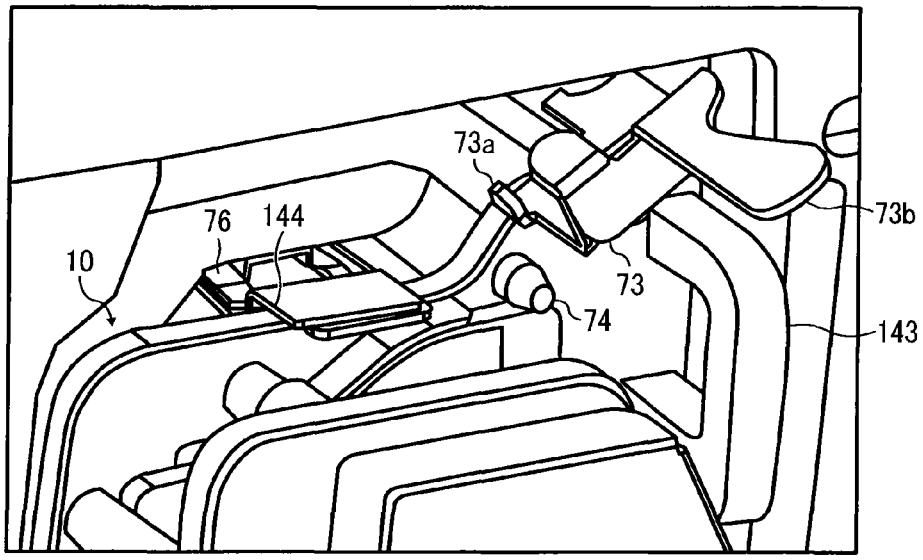
FIG. 23 is a guide rail of the intermediate transfer unit and a slide rail of the belt cleaning device.

As illustrated in FIG. 23, the belt cleaning device 10 has a slide rail 144 on an upper portion of the belt cleaning device 10 and the intermediate transfer unit 70 has a guide rail 76 to guide the belt cleaning device 10 along a mounting-removal direction which is a cleaning-roller axial direction. With the slide rail 144 of the belt cleaning device 10 engaging the guide rail 76, the belt cleaning device 10 is guided along the guide rail 76. The belt cleaning device 10 has a handle 143 on a front side plate 140, and a user grips the handle 143 to pull the belt cleaning device 10. Thus, the belt cleaning device 10 is pulled out from the intermediate transfer unit 70 while the slide rail 144 is guided along the guide rail 76.

Figure 24:
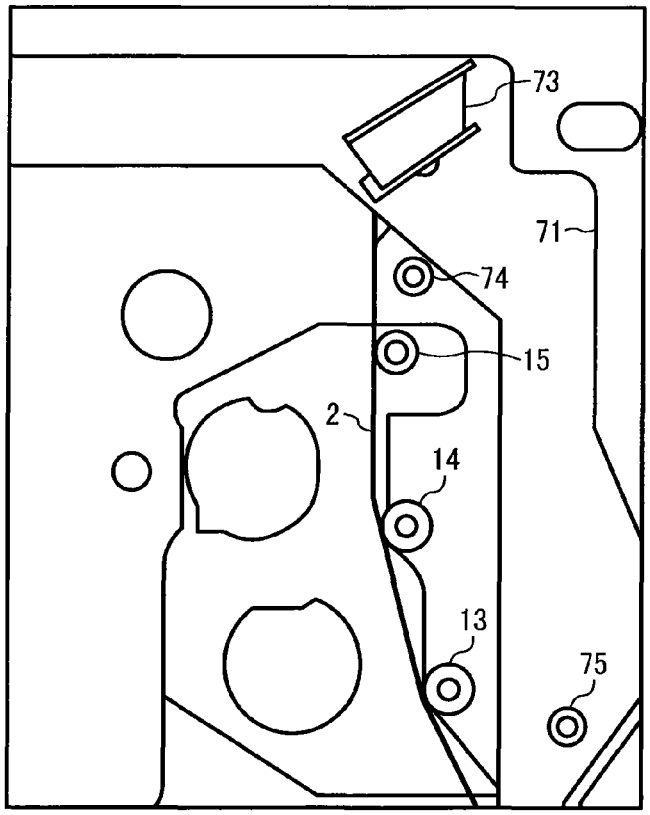
FIG. 24 is an illustration of a state in which the belt cleaning device and a lubrication device are removed from the intermediate transfer unit.

FIG. 24 is an illustration of a state in which the belt cleaning device 10 and the lubrication device are removed from the intermediate transfer unit 70. The intermediate transfer unit 70 includes a main reference pin 74 and a sub reference pin 75 to position the belt cleaning device 10 relative to the intermediate transfer unit 70. The main reference pin 74 is inserted into an insertion hole 141 at an upper portion of the front side plate 140 of the belt cleaning device 10. The insertion hole 141 has approximately the same diameter as the diameter of the main reference pin 74. The sub reference pin 75 is inserted into a long hole 142 at a portion lower than the handle 143 of the front side plate 140 of the belt cleaning device 10. The long hole 142 is longer in a height direction of the image forming apparatus 1.

When the belt cleaning device 10 is mounted to the intermediate transfer unit 70, the slide rail 144 is engaged with the guide rail 76 so that the slide rail 144 is guided with the guide rail 76. Then, a user grips a portion, e.g., the handle 143 of the belt cleaning device 10 to push the belt cleaning device 10. The user inserts the belt cleaning device 10 to a position at which the main reference pin 74 and the sub reference pin 75 of the intermediate transfer unit 70 are inserted into the insertion hole 141 and the long hole 142, respectively, of the front side plate 140 of the belt cleaning device 10. Thus, the belt cleaning device 10 is positioned and mounted at a predetermined mount position in the intermediate transfer unit 70.

Here, as described above, in the image forming apparatus 1 according to this embodiment, the belt cleaning device 10 is removably mountable relative to the intermediate transfer unit 70. Accordingly, if the first cleaning brush roller 101, the second cleaning brush roller 104, and the post cleaning roller 107 contact the outer surface of the intermediate transfer belt 2 on mounting or removal of the belt cleaning device 10, the first cleaning brush roller 101, the outer surface of the intermediate transfer belt 2 is rubbed with the first cleaning brush roller 101, the second cleaning brush roller 104, and the post cleaning roller 107. However, even if the first cleaning brush roller 101 and the second cleaning brush roller 104 rub the outer surface of the intermediate transfer belt 2, the brushes of the first cleaning brush roller 101 and the second cleaning brush roller 104 deform, thus preventing the outer surface to be scratched. By contrast, if the post cleaning roller 107 rubs the outer surface of the intermediate transfer belt 2, the outer surface might be scratched and an abnormal image due to scratches might occur in an image transferred from the intermediate transfer belt 2 onto a recording sheet. Hence, the image forming apparatus 1 according to this embodiment is configured so that the post cleaning roller 107 does not rub the outer surface of the intermediate transfer belt 2 on mounting and removal of the belt cleaning device 10.

Figure 18:
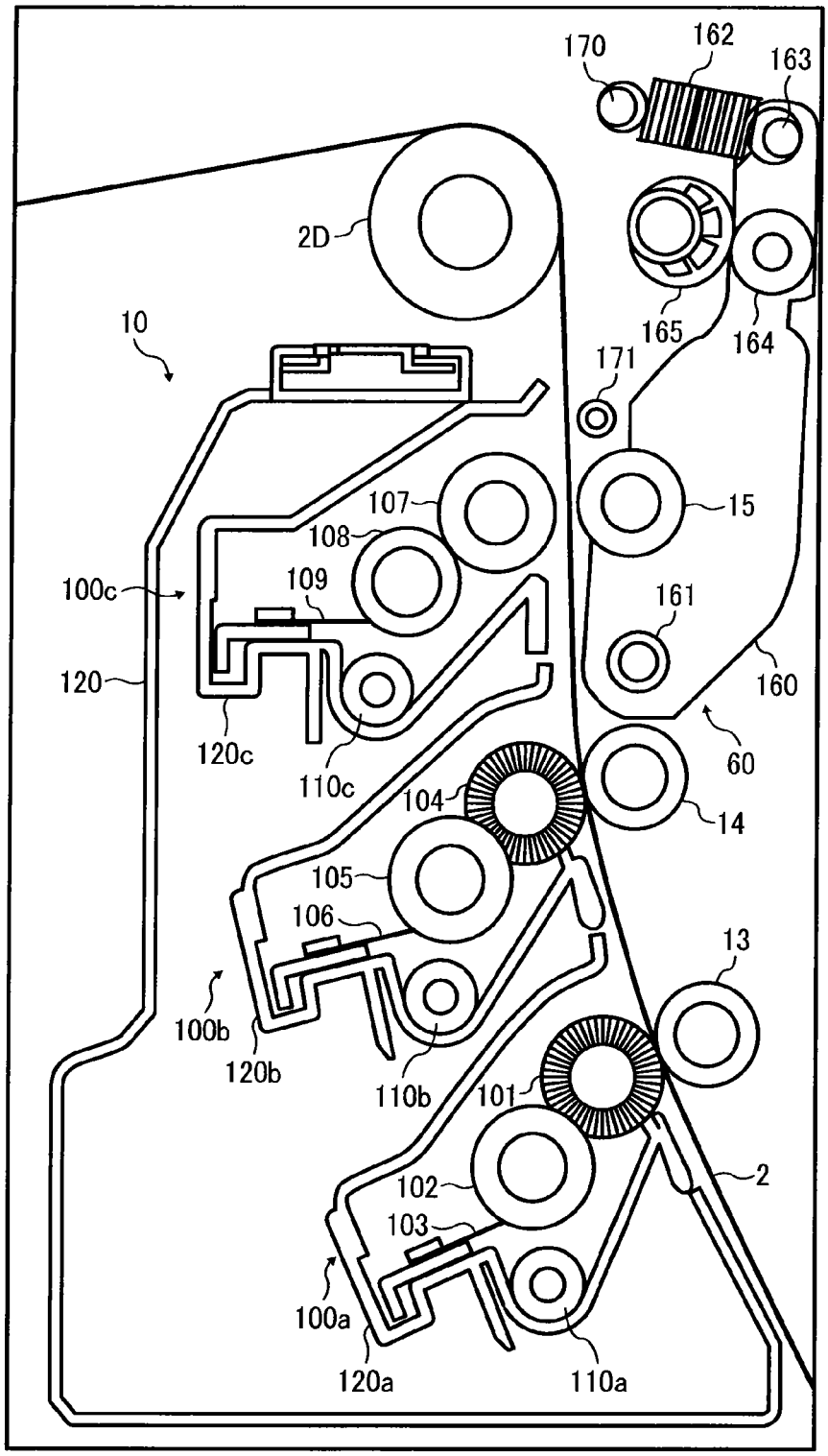
FIG. 18 is an illustration of a separation state in which the post cleaning roller is separated from the intermediate transfer belt.
Figure 25:
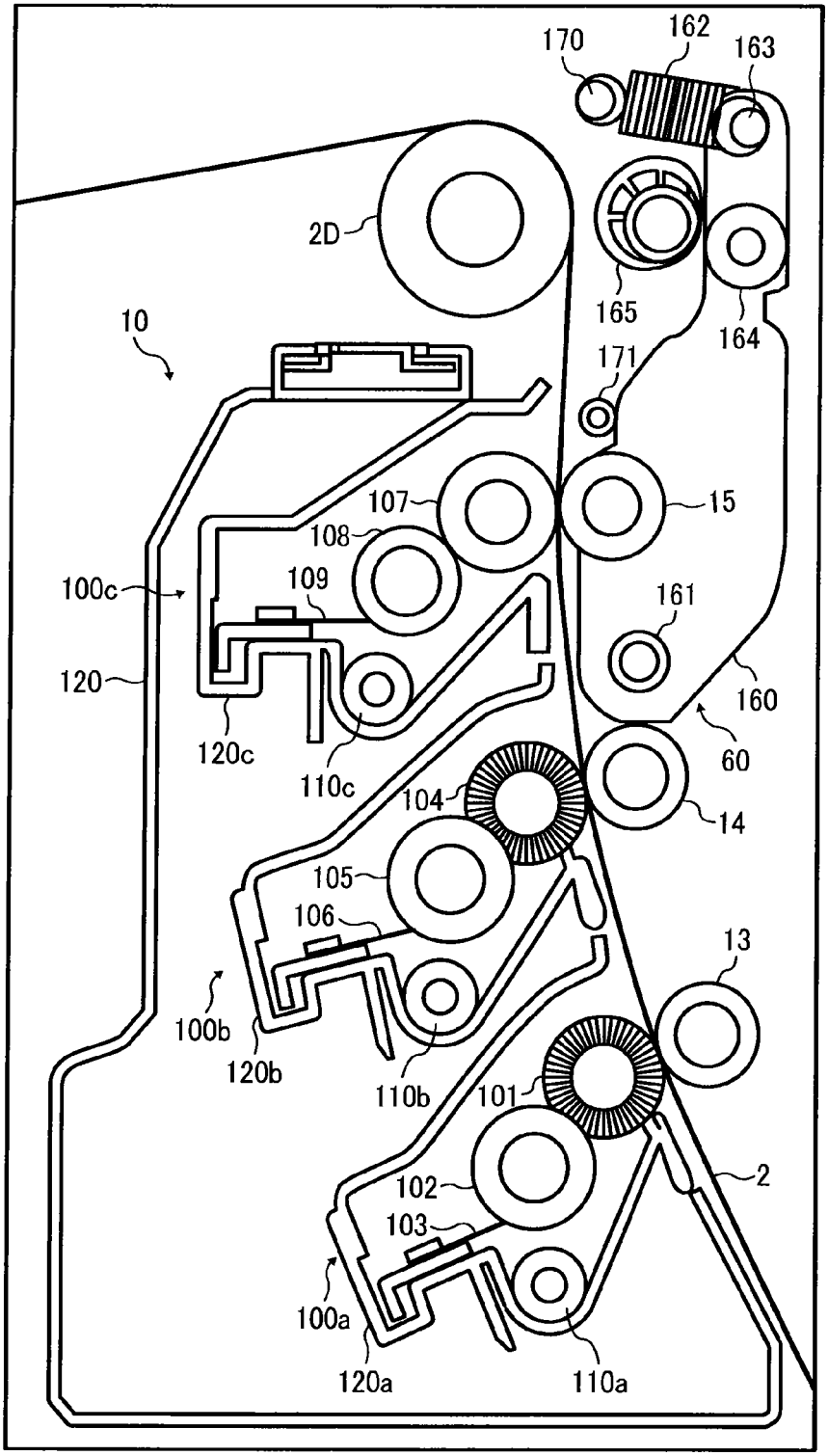
FIG. 25 is an illustration of a contact state in which the post cleaning roller is in contact with the intermediate transfer belt.

FIG. 25 is an illustration of a contact state in which the post cleaning roller 107 is in contact with the intermediate transfer belt 2. FIG. 18 is an illustration of a separation state in which the post cleaning roller 107 is separated from the intermediate transfer belt 2 with the separation assembly 60. In this embodiment, the post cleaning opposite roller 15 is movable between an abutment position at which the post cleaning opposite roller 15 abuts the post cleaning roller 107 via the intermediate transfer belt 2 and a retreat position at which the post cleaning opposite roller 15 is retreated and distanced from the post cleaning roller 107. The separation assembly 60 moves the post cleaning roller 107 from the abutment position to the retreat position to separate the post cleaning roller 107 and the intermediate transfer belt 2 from each other.

As illustrated in FIG. 25, the separation assembly 60 has a bracket 160 longer in the height direction of the image forming apparatus 1, and the post cleaning opposite roller 15 is rotatable relative to the bracket 160. A lower end portion of the bracket 160 at a position lower than the post cleaning opposite roller 15 is supported with a swing shaft 161, and the bracket 160 is swingable around the swing shaft 161. An upper end portion of the bracket 160 at a position higher than the post cleaning opposite roller 15 has a spring mount 163. One end of a tension spring 162 is supported with a support 170 of the image forming apparatus 1, and the other end of the tension spring 162 is mounted on the spring mount 163.

A bump portion 164 is disposed below the spring mount 163 at the upper end portion of the bracket 160. The separation assembly 60 includes an eccentric cam 165 between the bracket 160 and the tension roller 2D so that the eccentric cam 165 can contact and separate from the bump portion 164. When the eccentric cam 165 is rotated and separated from the bump portion 164, the bracket 160 is swung counterclockwise in FIG. 25 around the swing shaft 161 by a pulling force of the tension spring 162. Accordingly, the post cleaning opposite roller 15 approaches the post cleaning roller 107. The bracket 160 bumps a regulation pin 171 of the image forming apparatus 1 at a position at which the post cleaning opposite roller 15 abuts the post cleaning roller 107 via the intermediate transfer belt 2, thus stopping the swing of the bracket 160.

By contrast, as illustrated in FIG. 18, when the eccentric cam 165 is rotated and bumped against the bump portion 164, the bracket 160 is swung clockwise in FIG. 18 around the swing shaft 161 against the pulling force of the tension spring 162. Accordingly, the post cleaning opposite roller 15 moves away from the post cleaning roller 107. At this time, the tension generated by the pressing of the post cleaning opposite roller 15 decreases in the portion of the intermediate transfer belt 2 between the tension roller 2D and the second cleaning opposite roller 14. Meanwhile, the tension roller 2D presses the intermediate transfer belt 2 to apply tension to the portion of the intermediate transfer belt 2. Then, as illustrated in FIG. 18, when the post cleaning opposite roller 15 moves to a position away from the intermediate transfer belt 2, the portion of the intermediate transfer belt 2 between the tension roller 2D and the second cleaning opposite roller 14 moves to the position of the common tangent line L1 illustrated in FIG. 19. In other words, the portion of the intermediate transfer belt 2 moves to a position away from the post cleaning roller 107, thus separating the post cleaning roller 107 from the intermediate transfer belt 2.

As described above, mounting and removing the belt cleaning device 10 relative to the intermediate transfer unit 70 with the post cleaning roller 107 separated from the intermediate transfer belt 2 prevents the post cleaning roller 107 from rubbing the outer surface of the intermediate transfer belt 2. Such a configuration prevents an abnormal image due to scratches from occurring in an image transferred from the intermediate transfer belt 2 onto a recording sheet.

Alternatively, in some embodiments, a configuration may be employed in which the post cleaning roller 107 and the intermediate transfer belt 2 are separated from each other by moving the post cleaning roller 107. For example, the post cleaning unit 100*c* is disposed to be displaceable relative to the belt cleaning device 10 by a displacement assembly including, e.g., the eccentric cam 165 and a spring. The post cleaning unit 100*c* is displaced by the displacement assembly so that the post cleaning roller 107 moves away from the intermediate transfer belt 2, thus separating the post cleaning roller 107 and the intermediate transfer belt 2 from each other.

Figure 26:
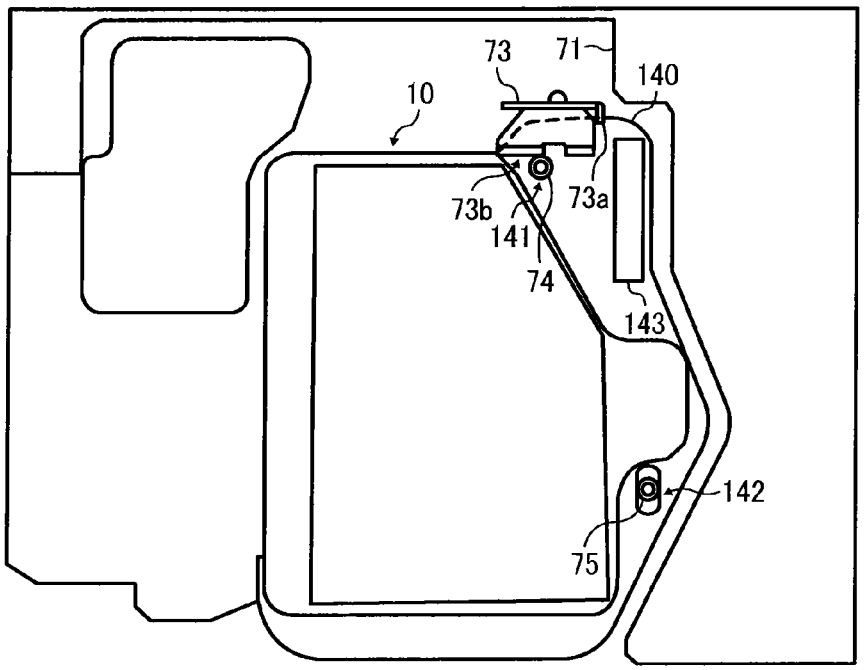
FIG. 26 is an external view of the belt cleaning device and an adjacent area of the belt cleaning device, in which the belt cleaning device is mounted to the intermediate transfer unit with the post cleaning roller contacting the intermediate transfer belt.
Figure 27:
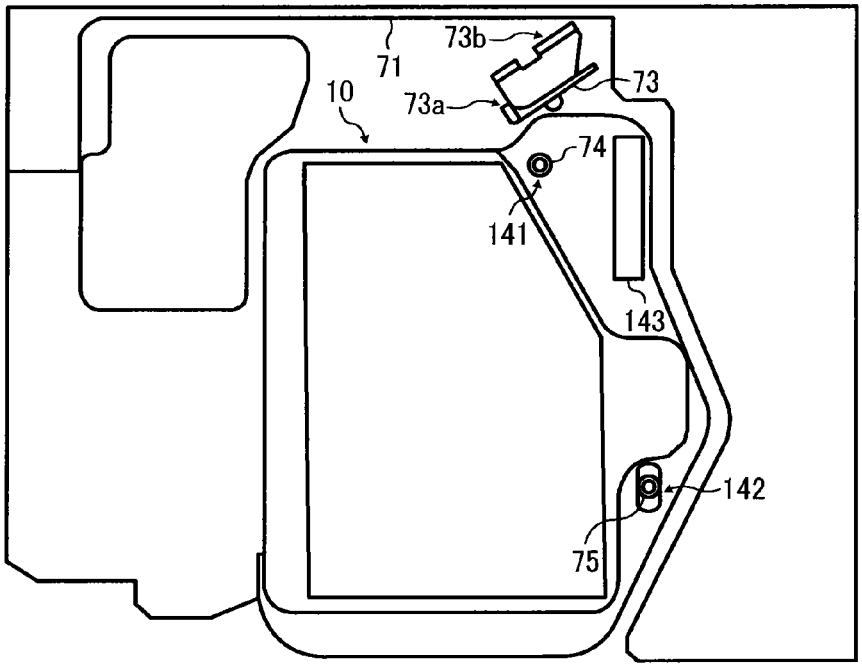
FIG. 27 is an external view of the belt cleaning device and the adjacent area of the belt cleaning device, in which the belt cleaning device is mounted to the intermediate transfer unit with the post cleaning roller separated from the intermediate transfer belt.

FIG. 26 is an external view of the belt cleaning device 10 and an adjacent area of the belt cleaning device 10, in which the belt cleaning device 10 is mounted to the intermediate transfer unit 70 in a state in which the post cleaning roller 107 is in contact with the intermediate transfer belt 2. FIG. 27 is an external view of the belt cleaning device 10 and an adjacent area of the belt cleaning device 10, in which the belt cleaning device 10 is mounted to the intermediate transfer unit 70 in a state in which the post cleaning roller 107 is separated from the intermediate transfer belt 2.

In the intermediate transfer unit 70, an operation lever 73 to rotate the eccentric cam 165 to move the post cleaning opposite roller 15 is disposed to be rotatable around a support shaft. The operation lever 73 is coupled to the eccentric cam 165 via a drive transmission assembly in the intermediate transfer unit 70, and, for example, when a user manually rotates the operation lever 73, the eccentric cam 165 also rotates with the rotation of the operation lever 73. When the operation lever 73 is placed at a regulating position illustrated in FIG. 26, the eccentric cam 165 is not in contact with the bump portion 164 of the bracket 160 and the post cleaning opposite roller 15 is placed at the abutment position at which the post cleaning opposite roller 15 abuts the post cleaning roller 107. Accordingly, the post cleaning roller 107 is in contact with the intermediate transfer belt 2.

When the operation lever 73 is rotated counterclockwise around the support shaft from the position illustrated in FIG. 26 and placed to a position illustrated in FIG. 27, the eccentric cam 165 also rotates with the rotation of the operation lever 73. Accordingly, the eccentric cam 165 bumps the bump portion 164 of the bracket 160. When the bracket 160 swings around the swing shaft 161, the post cleaning opposite roller 15 moves away from the post cleaning roller 107 to a position away from the intermediate transfer belt 2. Accordingly, as described above, a portion of the intermediate transfer belt 2 between the tension roller 2D and the second cleaning opposite roller 14 moves to a position away from the post cleaning roller 107, thus separating the post cleaning roller 107 from the intermediate transfer belt 2.

For the removal and mounting of the belt cleaning device 10 relative to the intermediate transfer unit 70, for example, a user manually moves the operation lever 73 to a release position illustrated in FIG. 27. Thus, in a state in which the post cleaning roller 107 is away from the intermediate transfer belt 2, the belt cleaning device 10 is mounted to or removed from the intermediate transfer unit 70.

Figure 28:
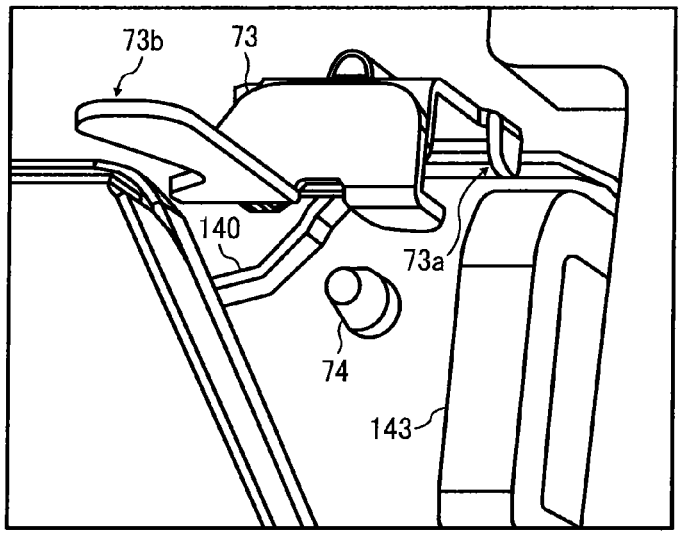
FIG. 28 is an illustration of a state in which a front side plate of the belt cleaning device interferes with a first regulating portion of an operation lever to regulate movement of the belt cleaning device.

However, a user might forget moving the operation lever 73 to the release position and pull the belt cleaning device 10 from the intermediate transfer unit 70 in the state in which the post cleaning roller 107 is in contact with the intermediate transfer belt 2. Hence, as illustrated in FIG. 26, the operation lever 73 includes a first regulating portion 73*a* to overlap the front side plate 140 of the belt cleaning device 10 in a direction of removal and mounting of the belt cleaning device 10 when the operation lever 73 is at the regulating position, to regulate movement of the belt cleaning device 10. Accordingly, even if a user tries to pull the belt cleaning device 10 out from the intermediate transfer unit 70 without placing the operation lever 73 at the release position, as illustrated in FIG. 28, the front side plate 140 and the first regulating portion 73*a* interfere with each other, thus regulating movement of the belt cleaning device 10. Such a configuration prevents the belt cleaning device 10 from being pulled out from the intermediate transfer unit 70 in the state in which the post cleaning roller 107 and the intermediate transfer belt 2 contact each other.

Figure 29:
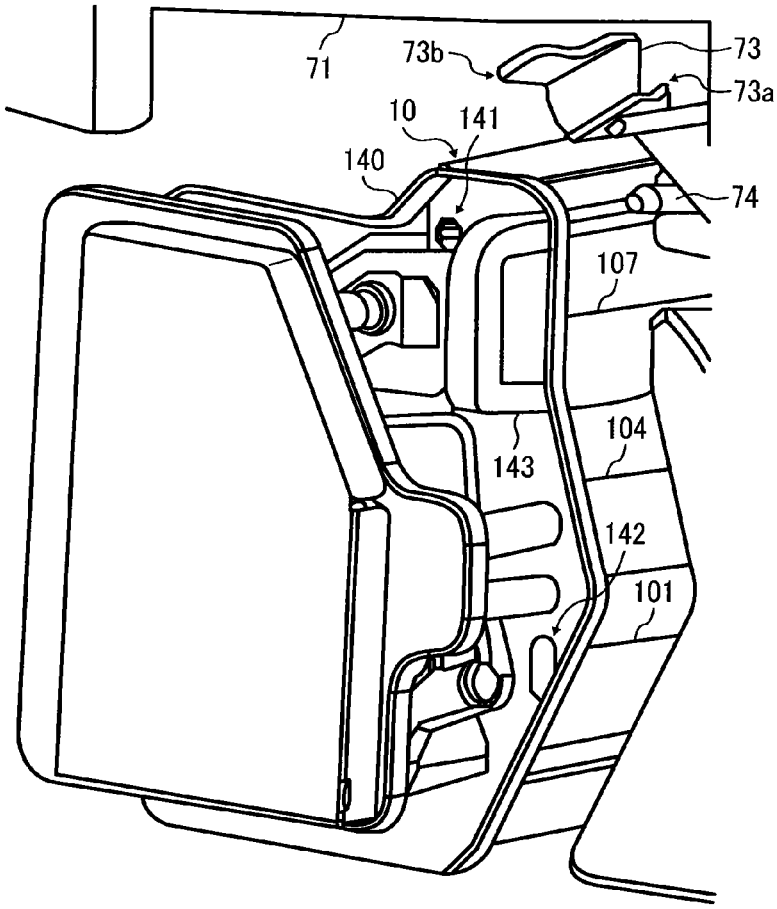
FIG. 29 is an illustration of a state in which the front side plate of the belt cleaning device does no interfere with the first regulating portion of the operation lever to regulate the movement of the belt cleaning device.

By contrast, when the operation lever 73 is placed at the release position, as illustrated in FIG. 27, the front side plate 140 of the belt cleaning device 10 does not overlay with the first regulating portion 73*a* of the operation lever 73 in the mounting-removal direction of the belt cleaning device 10. Accordingly, when the belt cleaning device 10 is pulled out from the intermediate transfer unit 70, as illustrated in FIG. 29, the front side plate 140 does not interfere with the first regulating portion 73*a*, thus allowing a user to pull the belt cleaning device 10 out from the intermediate transfer unit 70.

Figure 30:
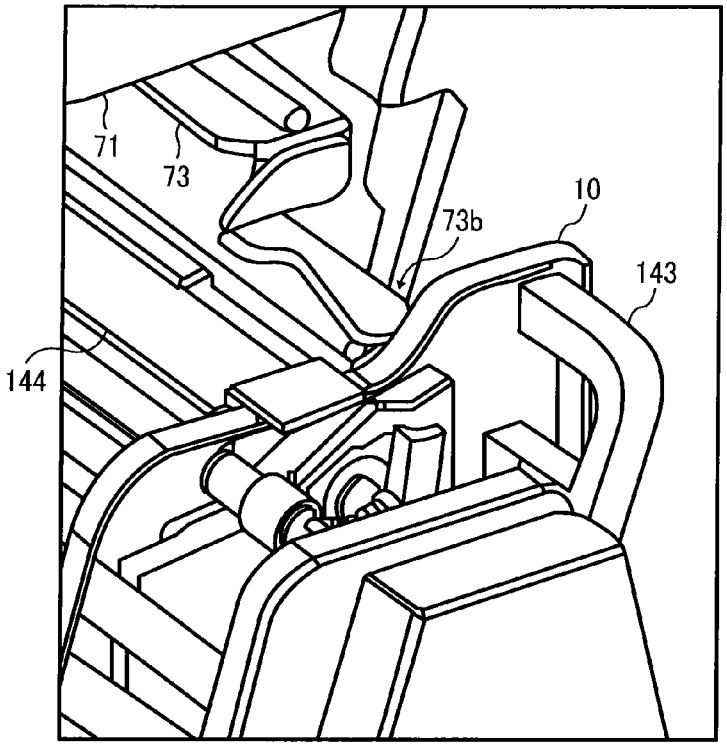
FIG. 30 is an illustration of a state in which the front side plate of the belt cleaning device interferes with a second regulating portion of the operation lever.

Here, when the belt cleaning device 10 is mounted to the intermediate transfer unit 70 with the operation lever 73 placed at the position illustrated in FIG. 26, the post cleaning opposite roller 15 presses the intermediate transfer belt 2 toward the post cleaning roller 107. Accordingly, the post cleaning roller 107 would rub against the intermediate transfer belt 2. Hence, as illustrated in FIG. 30, the operation lever 73 is provided with a second regulating portion 73*b* so that, when the operation lever 73 is placed at the regulating position, the second regulating portion 73*b* interferes with the front side plate 140 during mounting of the belt cleaning device 10 to the intermediate transfer unit 70 to regulate movement of the belt cleaning device 10. Accordingly, even if a user tries to mount the belt cleaning device 10 to the intermediate transfer unit 70 with the operation lever 73 placed at the release position, the front side plate 140 and the first regulating portion 73*a* interfere with each other, thus regulating movement of the belt cleaning device 10. Such a configuration prevents the belt cleaning device 10 from being mounted to the intermediate transfer unit 70 while the post cleaning roller 107 is rubbing the intermediate transfer belt 2.

As described above, the operation of mounting the belt cleaning device 10 to the intermediate transfer unit 70 is performed with the operation lever 73 placed at the position illustrated in FIG. 1, not the position illustrated in FIG. 26. However, after the belt cleaning device 10 is mounted to the intermediate transfer unit 70, a user might forget moving the operation lever 73 from the release position to the regulating position to contact the post cleaning roller 107 with the intermediate transfer belt 2. Accordingly, for example, an image forming operation might be performed with the post cleaning roller 107 separated from the intermediate transfer belt 2. As a result, the post cleaning roller 107 would not perform the cleaning function, thus causing cleaning failure.

Figure 31:
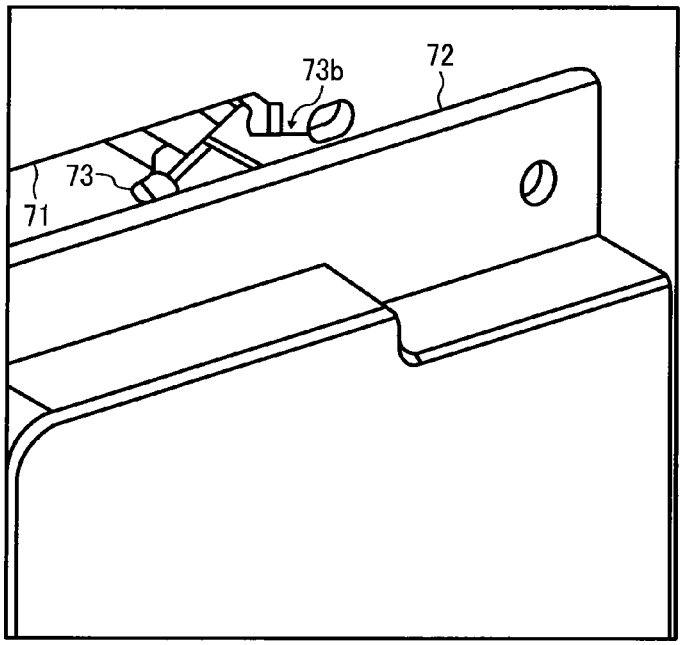
FIG. 31 is an illustration of a state in which the second regulating portion of the operation lever interferes with the second inner cover.

Hence, as illustrated in FIG. 31, when a user tries to mount the second inner cover 72 to the first inner cover 71 with the operation lever 73 placed at the release position, the second regulating portion 73*b* of the operation lever 73 interferes with the second inner cover 72. Accordingly, the second inner cover 72 is not mounted to the first inner cover 71, thus preventing an image forming operation and other operations from being performed in such an incomplete assembled state. Such a configuration prevents an image forming operation and other operations from being performed with the post cleaning roller 107 separated from the intermediate transfer belt 2.

Figure 32:
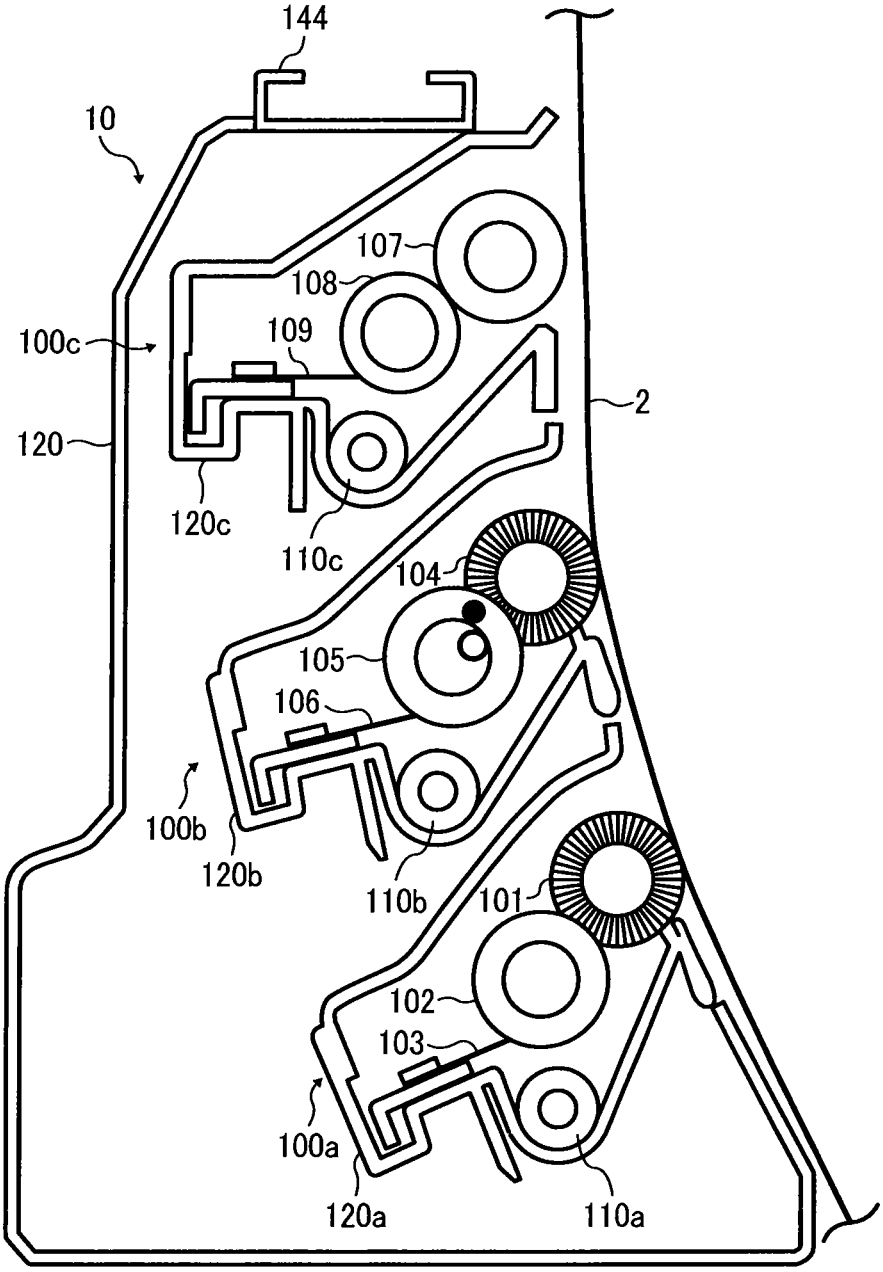
FIG. 32 is an illustration of a position of the center of gravity of the belt cleaning device.

Note that the belt cleaning device 10 hangs from the intermediate transfer unit 70 with the guide rail 76 and the slide rail 144 until the belt cleaning device 10 is positioned with the main reference pin 74 and the sub reference pin 75. In such a state, the belt cleaning device 10 takes an inclined posture relative to the intermediate transfer belt 2 as compared to a posture of the belt cleaning device 10 positioned to the intermediate transfer unit 70. For example, the belt cleaning device 10 takes such an inclined posture that the belt cleaning device 10 is placed at a position rotated around an engagement portion of the guide rail 76 and the slide rail 144 in a direction away from the intermediate transfer belt 2 relative to the positioned posture. As illustrated in FIG. 32, the center of gravity O of the belt cleaning device 10 is located closer to the intermediate transfer belt 2 than the slide rail 144 (slightly the right side from the slide rail 144 in FIG. 32). Accordingly, the center of gravity O of the belt cleaning device 10 hanging from the intermediate transfer unit 70 with the guide rail 76 and the slide rail 144 tries to move to a position vertically below the guide rail 76 and the slide rail 144. As a result, the belt cleaning device 10 takes the inclined posture.

In the inclined posture, the relationship in separation distance between the intermediate transfer belt 2 and each of the first cleaning brush roller 101, the second cleaning brush roller 104, and the post cleaning roller 107 of the belt cleaning device 10 is as follow. That is, the separation distance between the intermediate transfer belt 2 and the first cleaning brush roller 101 farthest from the slide rail 144 is the largest. The separation distance between the intermediate transfer belt 2 and the second cleaning brush roller 104 is the second largest. The separation distance between the intermediate transfer belt 2 and the post cleaning roller 107 closest to the slide rail 144 is the smallest. Accordingly, not only the separation of the post cleaning roller 107 from the intermediate transfer belt 2 by the inclined posture, but the post cleaning opposite roller 15 is also moved with the separation assembly 60 to the retreat position to separate the post cleaning roller 107 from the intermediate transfer belt 2. Such a configuration more reliably prevents the post cleaning roller 107 from rubbing the intermediate transfer belt 2 in a state in which the belt cleaning device 10 is not positioned in mounting or removing the belt cleaning device 10 to or from the intermediate transfer unit 70.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A cleaning device comprising:

an upstream cleaner configured to remove toner from a surface of a cleaning target;

a downstream cleaner disposed downstream from the upstream cleaner in a direction of movement of the surface of the cleaning target, the downstream cleaner configured to remove toner from the surface of the cleaning target;

a collection member configured to collect toner from the downstream cleaner; and a collection member to collect toner from the upstream cleaner, wherein a surface of the upstream cleaner includes a different texture from that of a surface of the downstream cleaner, each of the upstream cleaner and the downstream cleaner is configured to be applied with a voltage of a predetermined polarity, an absolute value of the voltage to be applied to the downstream cleaner is greater than an absolute value of the voltage to be applied to the upstream cleaner, and the upstream cleaner includes a cleaning brush having a planting density of not less than 15,000 and not greater than 20,000 brush fibers per square inch.

2. The cleaning device according to claim 1, wherein the polarity of the voltage to be applied to the downstream cleaner is opposite to a normal charge polarity of toner.

3. The cleaning device according to claim 1, wherein an absolute value of a current to be applied to the downstream cleaner is at least twice or greater than an absolute value of a current to be applied to the upstream cleaner.

4. An image forming apparatus, comprising:

an image bearer having a surface to bear a toner image;

a toner image forming unit configured to form the toner image on the surface of the image bearer;

a transfer device configured to transfer the toner image from the surface of the image bearer onto a recording medium; and a cleaning device including:

an upstream cleaner configured to remove toner from the surface of the image bearer;

a downstream cleaner disposed downstream from the upstream cleaner in a direction of movement of the surface of the image bearer, the downstream cleaner configured to remove toner from the surface of the image bearer;

a collection member configured to collect toner from the downstream cleaner; and a collection member to collect toner from the upstream cleaner, wherein the upstream cleaner includes a cleaning brush having a planting density of not less than 15,000 and not greater than 20,000 brush fibers per square inch.

5. The image forming apparatus according to claim 4, further comprising:

an upstream opposite member disposed opposite the upstream cleaner via the image bearer;

a downstream opposite member disposed opposite the downstream cleaner via the image bearer; and a separation assembly configured to move one cleaner of the upstream cleaner and the downstream cleaner or one opposite member of the upstream opposite member and the downstream opposite member opposite the one cleaner in a direction away from the image bearer, wherein the cleaning device is configured to be removable from and mountable to a body of the image forming apparatus in an axial direction of one of the upstream cleaner and the downstream cleaner.

6. The image forming apparatus according to claim 5, further comprising a guide configured to guide the cleaning device away from the body in the axial direction with the cleaning device inclined relative to the image bearer when the cleaning device is removed from the body, wherein, of the upstream cleaner and the downstream cleaner, the one cleaner has a minimum distance from the image bearer with the cleaning device inclined relative to the image bearer.

7. The image forming apparatus according to claim 6, wherein the cleaning device has a center of gravity at a position closer to the image bearer than the guide.

8. The image forming apparatus according to claim 5, wherein the separation assembly is configured to move the one opposite member.

9. The image forming apparatus according to claim 5, wherein the upstream cleaner includes:

a first cleaning brush roller configured to be applied with a voltage of a same polarity as a normal charge polarity of toner to electrostatically remove toner of an opposite polarity of the normal charge polarity from the image bearer; and a second cleaning brush roller disposed downstream from the first cleaning brush roller in the direction of movement of the surface of the image bearer and configured to be applied with a voltage of the opposite polarity to electrostatically remove toner of the same polarity as the normal charge polarity from the image bearer, wherein the downstream cleaner includes a cleaning roller disposed downstream from the upstream cleaner in the direction of movement of the image bearer and configured to be applied with a voltage of the opposite polarity to electrostatically remove toner of the same polarity as the normal charge polarity from the image bearer, and wherein the one cleaner is the cleaning roller.

10. The image forming apparatus according to claim 4, wherein a surface of the upstream cleaner includes a different texture from that of a surface of the downstream cleaner, each of the upstream cleaner and the downstream cleaner is configured to be applied with a voltage of a predetermined polarity, and an absolute value of the voltage to be applied to the downstream cleaner is greater than an absolute value of the voltage to be applied to the upstream cleaner.

11. A cleaning device comprising:

an upstream cleaner configured to remove toner from a surface of a cleaning target;

a downstream cleaner disposed downstream from the upstream cleaner in a direction of movement of the surface of the cleaning target, the downstream cleaner configured to remove toner from the surface of the cleaning target;

a collection member configured to collect toner from the downstream cleaner; and a collection member to collect toner from the upstream cleaner, wherein the upstream cleaner includes a cleaning brush having a planting density of not less than 15,000 and not greater than 20,000 brush fibers per square inch.

12. The cleaning device according to claim 11, wherein the downstream cleaner is a roller configured to rotate in a same direction as the direction of movement of the surface of the cleaning target at a contact position at which the downstream cleaner contacts the cleaning target.

13. The cleaning device according to claim 12, wherein the downstream cleaner is configured to rotate with the surface of the cleaning target.

14. The cleaning device according to claim 12, wherein the downstream cleaner is configured to rotate at a linear velocity of not less than 99% and not greater than 101% relative to a linear velocity of the cleaning target.

15. The cleaning device according to claim 11, wherein the downstream cleaner is configured to press the cleaning target at a depth of not less than 0.05 millimeters and not greater than 0.5 millimeters.

16. The cleaning device according to claim 11, wherein the surface of the downstream cleaner includes an Asker C hardness of not less than 28 degrees and not greater than 45 degrees.

17. The cleaning device according to claim 11, wherein the surface of the downstream cleaner includes a sponge with a cell diameter of not greater than 150 micrometers.

18. The cleaning device according to claim 11, wherein the collection member configured to collect toner from the downstream cleaner is configured to rotate with the downstream cleaner.

19. The cleaning device according to claim 11, wherein the upstream cleaner includes:

a first cleaning brush roller to electrostatically remove toner charged with a positive polarity on the cleaning target; and a second cleaning brush roller to electrostatically remove toner charged with a negative polarity on the cleaning target.

20. The cleaning device according to claim 11, wherein the brush fibers of the cleaning brush have a thickness of not less than 14 denier and not greater than 30 denier.

21. The cleaning device according to claim 11, further comprising another cleaning brush disposed upstream from the cleaning brush in the direction of movement of the surface of the cleaning target, wherein said another cleaning brush has a planting density of brush fibers greater than the planting density of the cleaning brush.

* * * * *